US010887950B2

(12) United States Patent
Yun et al.

(10) Patent No.: US 10,887,950 B2
(45) Date of Patent: Jan. 5, 2021

(54) COOKING APPARATUS

(71) Applicant: SAMSUNG ELECTRONICS CO., LTD., Suwon-si (KR)

(72) Inventors: Chang Sun Yun, Suwon-si (KR); Seung-Hwan Kim, Suwon-si (KR); Kwan Joon Kim, Hwaseong-si (KR); Eun Dae Bae, Anyang-si (KR); Heung Mun Oh, Seongnam-si (KR); Ji Hyeoung Lee, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 465 days.

(21) Appl. No.: 14/723,810

(22) Filed: May 28, 2015

(65) Prior Publication Data

US 2015/0351163 A1 Dec. 3, 2015

(30) Foreign Application Priority Data

May 30, 2014 (KR) ..... 10-2014-0066400

(51) Int. Cl.
*H05B 6/12* (2006.01)

(52) U.S. Cl.
CPC ..... *H05B 6/1218* (2013.01); *H05B 2206/022* (2013.01); *H05B 2213/05* (2013.01); *H05B 2213/06* (2013.01)

(58) Field of Classification Search
CPC ..... H05B 6/1218
USPC ..... 99/342
See application file for complete search history.

(56) References Cited

U.S. PATENT DOCUMENTS 9,640,174 B2 * 5/2017 Noh ..... G10L 15/00
2003/0076281 A1 * 4/2003 Morgan ..... F24C 7/004 345/44
2008/0018960 A1 * 1/2008 Kennedy ..... A45C 11/26 358/509
2010/0181890 A1 * 7/2010 Tseng ..... F21K 9/00 313/46
2011/0253693 A1 10/2011 Lyons et al.
(Continued)

FOREIGN PATENT DOCUMENTS

CN 101408286 A * 4/2009 ..... H01L 33/58
EP 0499972 A1 * 8/1992 ..... F24C 15/102
EP 2579680 A1 4/2011
(Continued)

OTHER PUBLICATIONS

European Examination Report dated Jun. 2, 2017 in related European Patent Application No. 15167024.7 (4 pages).
(Continued)

*Primary Examiner* — Serkan Akar
*Assistant Examiner* — Spencer H. Kirkwood
(74) *Attorney, Agent, or Firm* — Staas & Halsey LLP

(57) ABSTRACT

Provided is a cooking apparatus including: an induction heating coil that generates a magnetic field heating a cooking container; and an image generating unit that radiates light so that an image is generated on a surface of the cooking container, wherein the image generating unit includes: a plurality of light sources that radiate light toward the cooking container; a light source driving circuit that provides driving currents to the plurality of light sources; and a light-emitting controller that controls the light source driving circuit.

18 Claims, 68 Drawing Sheets

(56) References Cited

U.S. PATENT DOCUMENTS

| | | | | |
|---|---|---|---|---|
| 2014/0234496 | A1* | 8/2014 | Siegel | A47J 27/62<br>426/231 |

FOREIGN PATENT DOCUMENTS

| | | | | |
|---|---|---|---|---|
| EP | 2469973 | A1 * | 6/2012 | H05B 6/1218 |
| EP | 2469973 | A1 * | 6/2012 | H05B 6/1218 |
| EP | 2876976 | A1 | 11/2014 | |
| JP | 2004-47283 | | 2/2004 | |
| JP | 2014-96877 | | 5/2014 | |
| KR | 2003-0074065 | | 9/2003 | |
| KR | 10-2010-0010249 | | 2/2010 | |
| WO | WO 97/37515 | | 10/1997 | |

OTHER PUBLICATIONS

Extended European Search Report dated Oct. 15, 2015 in related European Patent Application No. 15167024.7 (7 pages).
Korean Office Action dated Apr. 6, 2020 from Korean Application No. 10-2014-0066400, 10 pages.

* cited by examiner

COOKING APPARATUS

CROSS-REFERENCE TO RELATED APPLICATION

This application claims the benefit of Korean Patent Application No. 10-2014-0066400, filed on May 30, 2014 in the Korean Intellectual Property Office, the disclosure of which is incorporated herein by reference.

BACKGROUND

1. Field

Embodiments of the present invention relate to a cooking apparatus, and more particularly, to a cooking apparatus in which a user can easily check information regarding an operation of a cooking container.

2. Description of the Related Art

In general, an induction heating cooking apparatus is a cooking apparatus that heats and cooks food using the principle of induction heating. The induction heating cooking apparatus includes a cooking table on which a cooking container is put, and an induction coil that generates a magnetic field when a current is applied.

When the current is applied to the induction coil and thus the magnetic field is generated, a secondary current is induced into the cooking container, and Joule' heat is generated by a resistance component of the cooking container. Thus, the cooking container is heated, and food accommodated in the cooking container is cooked.

In comparison with a gas range or a kerosene small kitchen range that heats the cooking container by using combustion heat generated by combusting a fossil fuel, such as a gas or an oil, the induction heating cooking apparatus can be rapidly heated, and a noxious gas is not generated, and there is no risk of the outbreak of fire.

However, in the induction heating cooking apparatus, flames are not generated when the cooking container is heated. Thus, it is difficult to intuitively recognize a heating state of the cooking container from the outside.

Thus, a digital display in the form of a level meter is also disposed in the induction heating cooking apparatus so as to display the heating state of the cooking container. However, recognition characteristics of the digital display are lowered such that the user is distant from the induction heating cooking apparatus by a predetermined distance or the user cannot easily recognize the heating state of the cooking container without minutely observing the heating state of the cooking container. In addition, even when the heating state of the cooking container is recognized, it is difficult to provide an instantaneous sense to the user.

SUMMARY

Therefore, it is an aspect of the present invention to provide a cooking apparatus that displays visual flame images on a cooking container.

It is another aspect of the present invention to provide a cooking apparatus that is capable of delivering various messages to a user by using movement of flame images displayed on a cooking container.

Additional aspects of the invention will be set forth in part in the description which follows and, in part, will be obvious from the description, or may be learned by practice of the invention.

In accordance with one aspect of the present invention, a cooking apparatus includes: an induction heating coil that generates a magnetic field heating a cooking container; and a flame image generating unit that radiates light so that flame images can be generated on a surface of the cooking container, wherein the flame image generating unit may include: a plurality of light sources that radiate light toward the cooking container; a light source driving circuit that provides driving currents to the plurality of light sources; and a light-emitting controller that controls the light source driving circuit.

The plurality of light sources may include at least two light source groups including at least two light sources connected to each other in series, and the at least two light source groups are connected to each other in parallel.

The light source driving circuit may include a plurality of switching units that are connected to the at least two light source groups in series and control driving currents supplied to each of the at least two light source groups.

The light-emitting controller may control the light source driving circuit so that the plurality of light sources can be simultaneously turned on/off.

The light-emitting controller may control the light source driving circuit so that the at least two light sources that belong to the at least two light source groups can be simultaneously turned on/off.

The light-emitting controller may control the light source driving circuit so that each of the at least two light source groups can be turned on/off at different times.

The light source driving circuit may include a switching unit that is connected to the at least two light source groups in series and controls driving currents supplied to all of the at least two light source groups.

The plurality of light sources may be connected to each other in parallel.

The light source driving circuit may include a plurality of switching units that are connected to each of the plurality of light sources in series and control driving currents supplied to each of the plurality of light sources.

The plurality of light sources may be connected to each other in series.

The light source driving circuit may include a switching unit that is connected to the plurality of light sources in series and controls driving currents supplied to all of the plurality of light sources.

The cooking apparatus may further include: a user interface that receives output levels from a user; and a controller that controls an intensity of the magnetic field according to the output levels and controls a shape of the flame images according to the output levels.

The controller may control the flame image generating unit so that brightness of the flame images can be changed according to the output levels.

The controller may control the flame image generating unit so that sizes of the flame images can be changed according to the output levels.

The controller may control the flame image generating unit so that colors of the flame images can be changed according to the output levels.

The cooking apparatus may further include: a position detection unit that detects a position of the cooking container; and a light source movement unit that moves the flame image generating unit.

The controller may control the light source movement unit so as to move the flame image generating unit according to the position of the cooking container.

The cooking apparatus may further include a position detection unit that detects the position of the cooking container, wherein the plurality of light sources may include at least two light source groups disposed at different distances from the induction heating coil.

The controller may control the flame image generating unit so that one from among the at least two light source groups can operate according to the position of the cooking container.

The cooking apparatus may further include: a temperature detection unit that detects a temperature of the cooking container; and a communication unit that communicates with portable mobile terminal equipment.

If a request for cooking progression information is received from the portable mobile terminal equipment, the controller may transmit the cooking progression information including the temperature of the cooking container and a cooking progression time to the portable mobile terminal equipment through the communication unit.

If a cooking method is received from the portable mobile terminal equipment, the controller may control the intensity of the magnetic field according to the cooking method and may control the shape of the flame images according to the cooking method.

The cooking apparatus may further include: a microphone that receives voice signals from the user; and a speaker that outputs a sound.

If the voice signals are received through the microphone, the controller may recognize control instructions from the voice signals.

If failure is detected, the controller may control the speaker so as to output a warning sound and may control the flame image generating unit so as to generate flame images that flicker.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
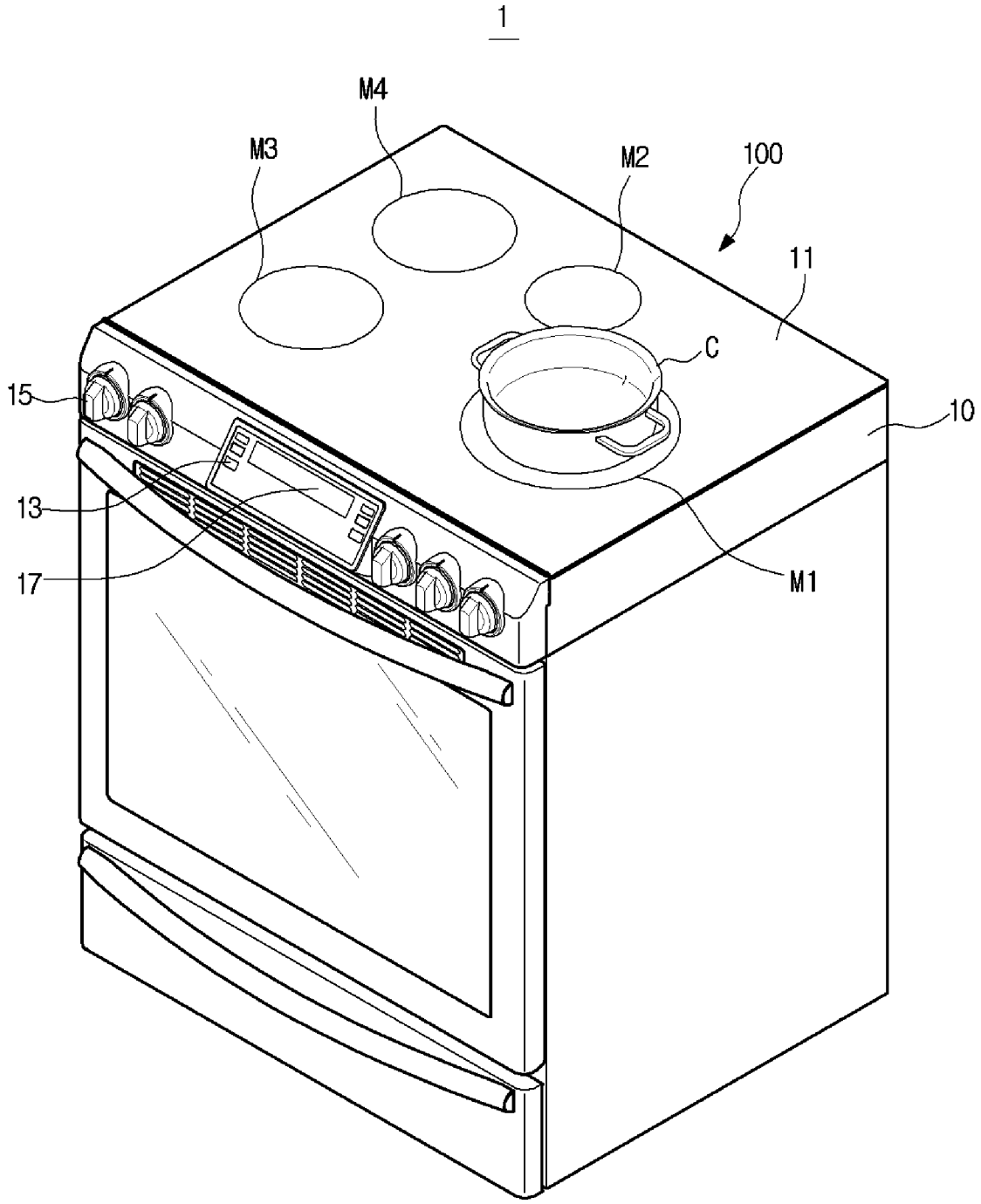
FIG. 1 is a view of an exterior of a cooking apparatus in accordance with an embodiment of the present invention.

Reference will now be made in detail to the embodiments of the present invention, examples of which are illustrated in the accompanying drawings, wherein like reference numerals refer to like elements throughout.

Hereinafter, embodiments of the present invention will be described in detail with reference to the accompanying drawings.

Figure 2:
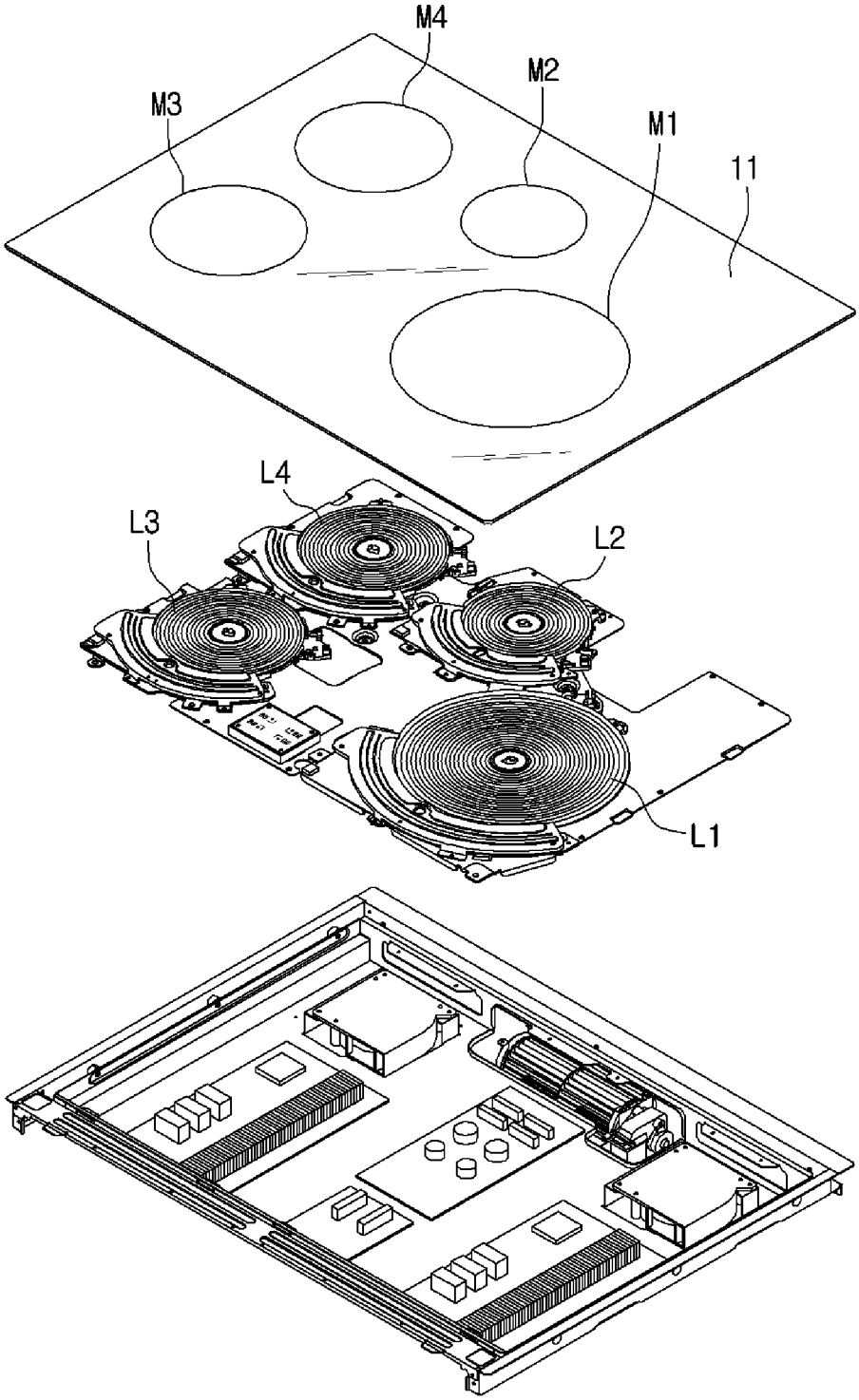
FIG. 2 is a view of an inside of the cooking apparatus in accordance with an embodiment of the present invention.
Figure 3:
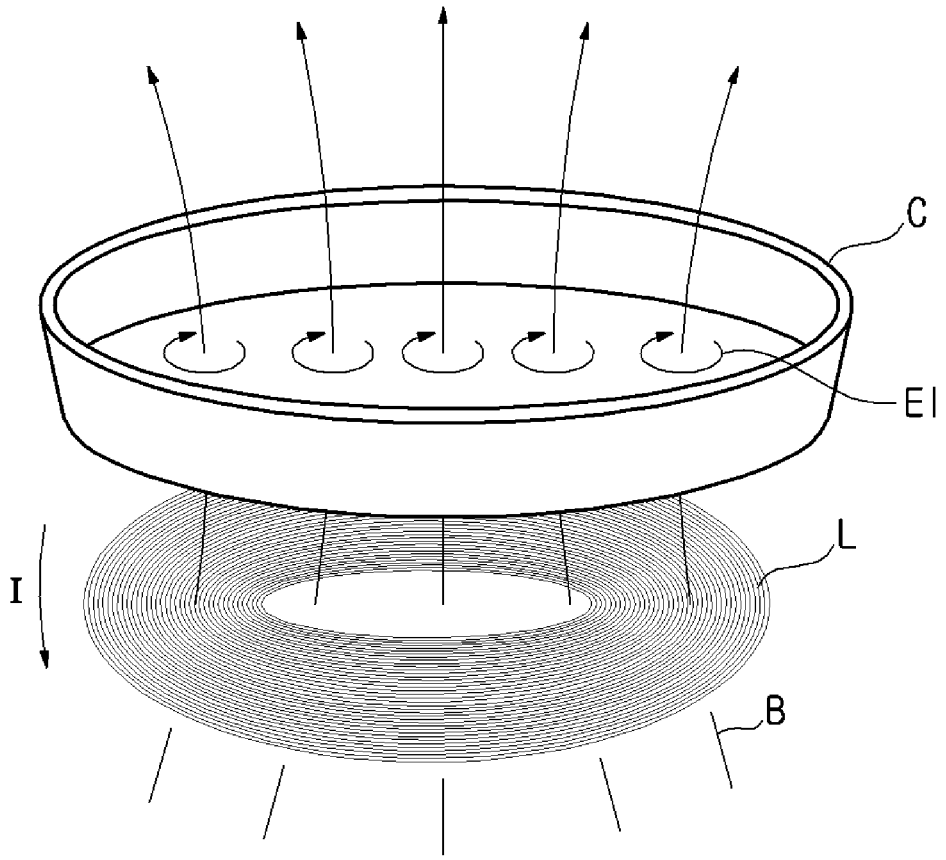
FIG. 3 is a view of the principle of heating a cooking container by using the cooking apparatus in accordance with an embodiment of the present invention.
Figure 4:
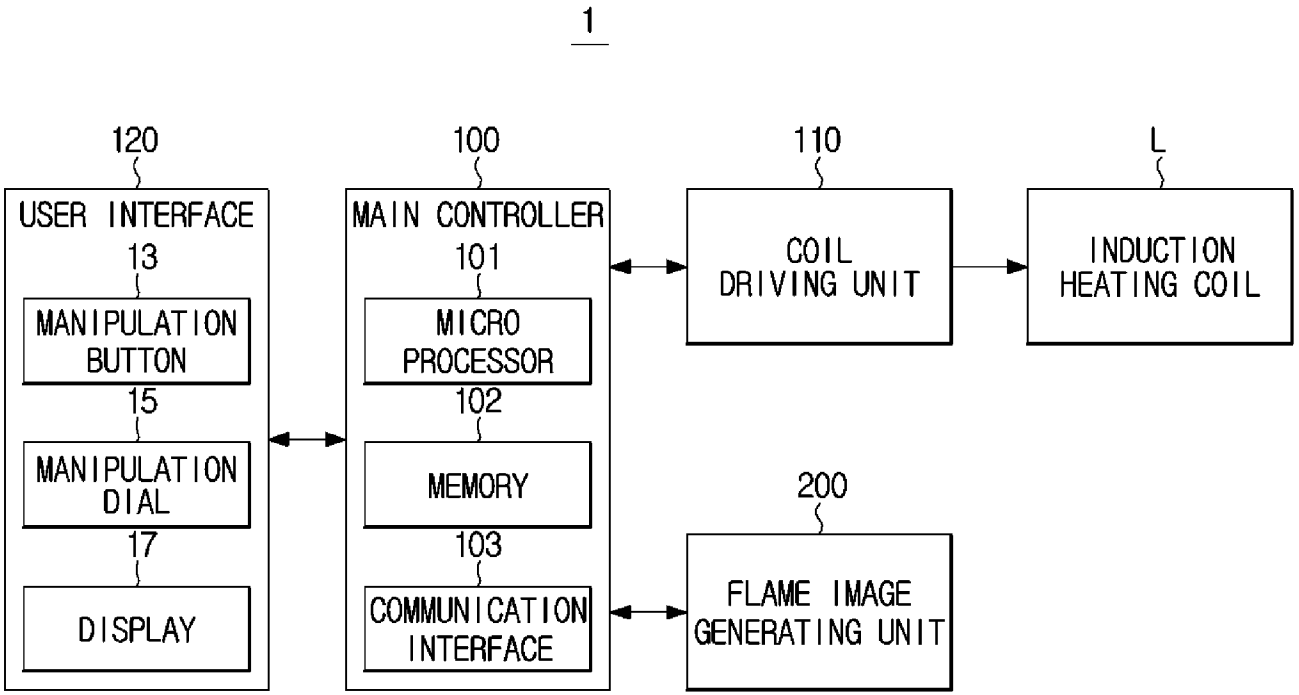
FIG. 4 is a view of a configuration of the cooking apparatus in accordance with an embodiment of the present invention.
Figure 5A:
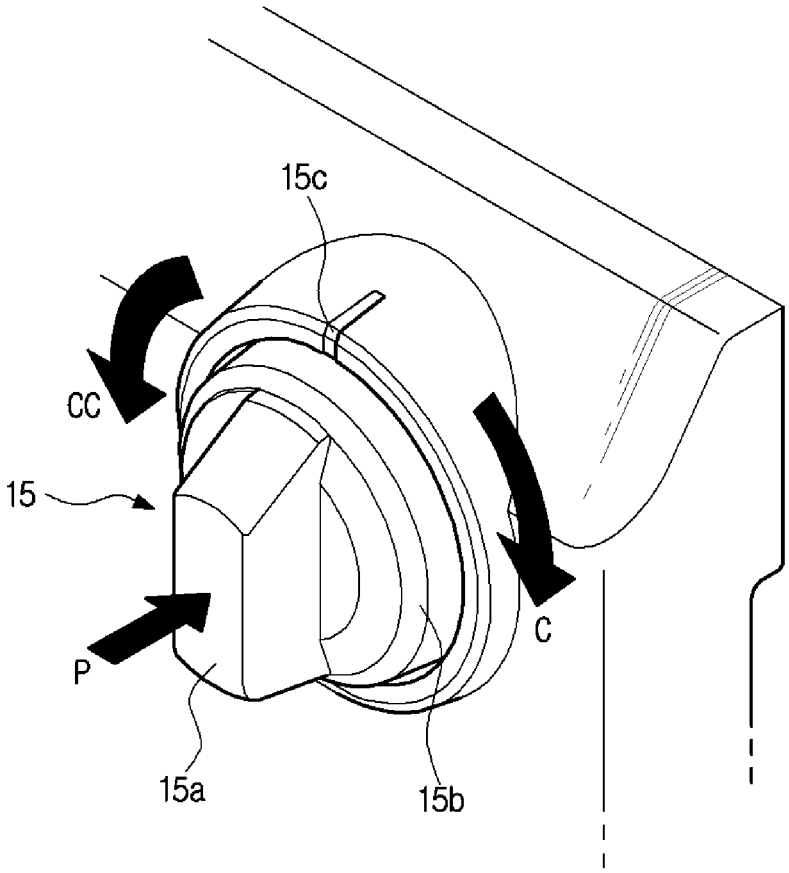
FIGS. 5A and 5B are views of a user interface included in the cooking apparatus in accordance with an embodiment of the present invention.
Figure 5B:
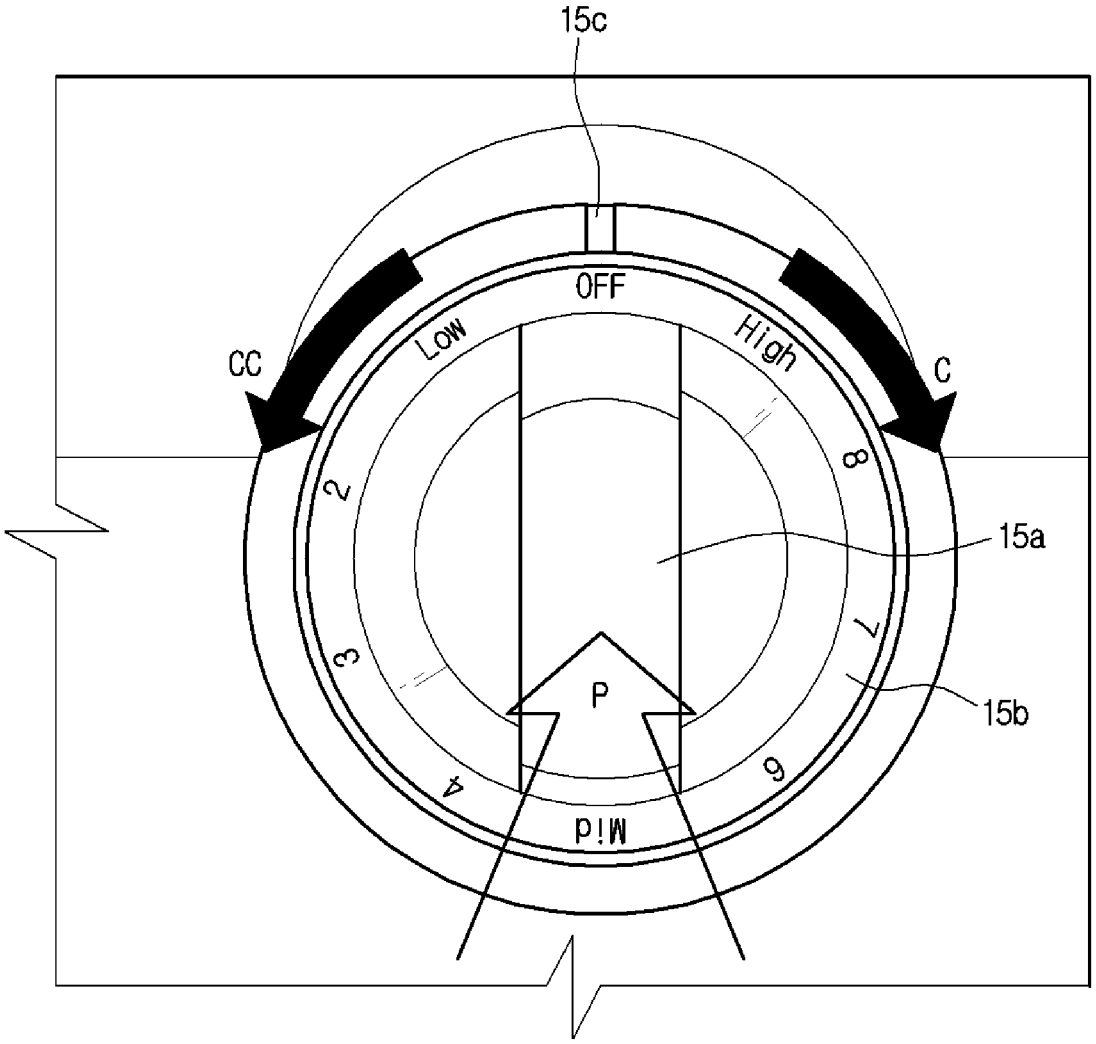
Figure 6:
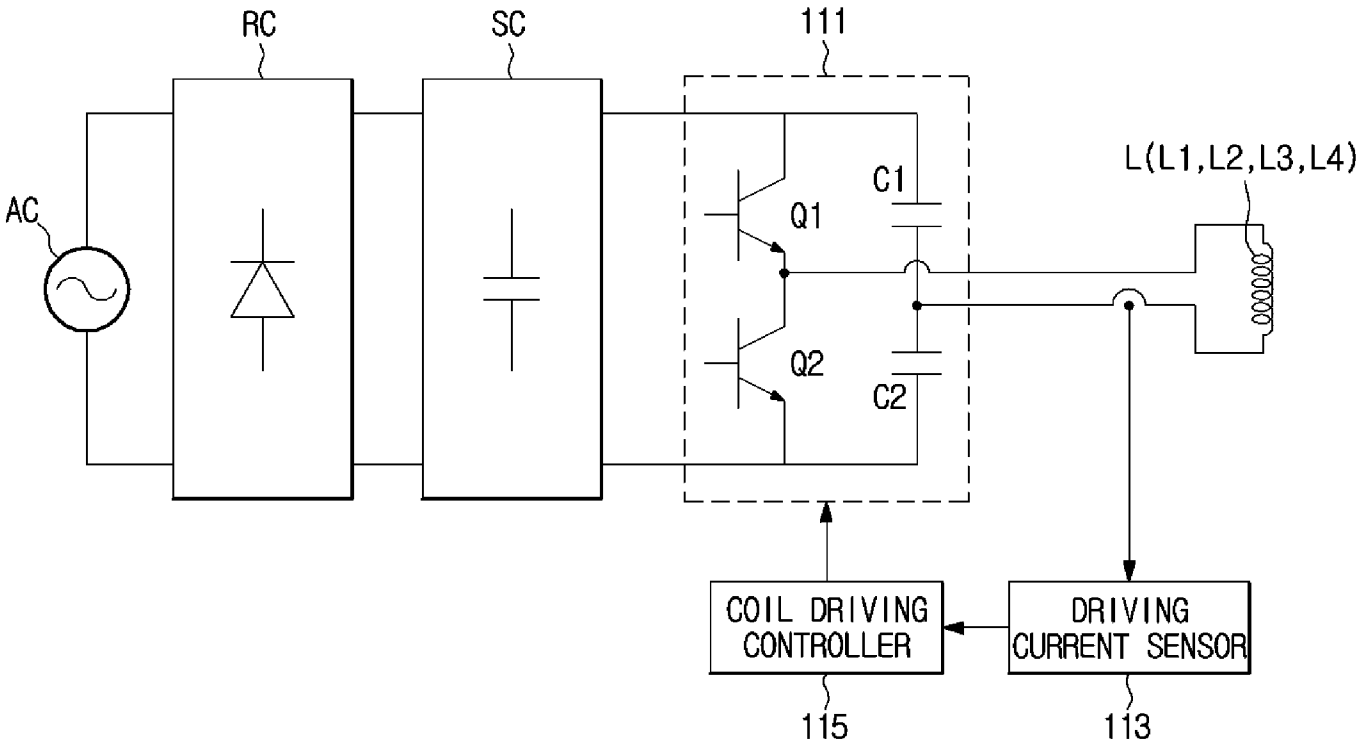
FIG. 6 is a view of a configuration of a coil driving unit included in the cooking apparatus in accordance with an embodiment of the present invention.

FIG. 1 is a view of an exterior of a cooking apparatus in accordance with an embodiment of the present invention, and FIG. 2 is a view of an inside of the cooking apparatus in accordance with an embodiment of the present invention, and FIG. 3 is a view of the principle of heating a cooking container by using the cooking apparatus in accordance with an embodiment of the present invention. FIG. 4 is a view of a configuration of the cooking apparatus in accordance with an embodiment of the present invention, and FIGS. 5A and 5B are views of a user interface included in the cooking apparatus in accordance with an embodiment of the present invention, and FIG. 6 is a view of a configuration of a coil driving unit included in the cooking apparatus in accordance with an embodiment of the present invention.

Referring to FIGS. 1 through 6, a cooking apparatus 1 in accordance with an embodiment of the present invention includes a main body 10 that constitutes an exterior of the cooking apparatus 1 and accommodates various elements of the cooking apparatus 1 therein.

A cooking plate 11 on which a cooking container C is placed, is disposed on a top surface of the main body 10.

The cooking plate 11 may be formed of reinforced glass, such as ceramic glass, not to be easily broken. Also, guide marks M1, M2, M3, and M4 may be formed on the cooking plate 11 so that a user may guide the position of the cooking container C, as illustrated in FIG. 1.

A plurality of induction heating coils L1, L2, L3, and L4 that generate a magnetic field are disposed under the cooking plate 11. Also, the plurality of induction heating coils L1, L2, L3, and L4 may be respectively disposed in positions corresponding to the guide marks M1, M2, M3, and M4.

The plurality of induction heating coils L1, L2, L3, and L4 may include a first induction heating coil L1, a second induction heating coil L2, a third induction heating coil L3, and a fourth induction heating coil L4, as illustrated in FIG. 2. The cooking apparatus 1 in accordance with an embodiment of the present invention includes four induction heating coils L1, L2, L3, and L4. However, embodiments of the present invention are not limited thereto, and the cooking apparatus 1 may include three or less or five or more induction heating coils.

As illustrated in FIG. 3, when a current is supplied to the induction heating coil L (L1, L2, L3, and L4), a magnetic field B is induced to pass through an inside of the induction heating coil L. In particular, when a current that changes over time, i.e., an alternating current (AC), is supplied to the induction heating coil L, the magnetic field B that changes over time is induced into the inside of the induction heating coil L.

The magnetic field B generated by the induction heating coil L in this way passes through a bottom surface of the cooking container C.

When the magnetic field B that changes over time passes through a conductor, a current that rotates about the magnetic field B is generated in the conductor. A phenomenon in which a current is induced by the magnetic field B that changes over time, is referred to as electromagnetic induction, and the rotating current is referred to as an eddy current.

In the cooking apparatus 1 using induction heating, electromagnetic induction and the eddy current occur in the bottom surface of the cooking container C. In detail, when the magnetic field B generated by the induction heating coil L passes through the bottom surface of the cooking container C, an eddy current EI that rotates about the magnetic field B is generated in the bottom surface of the cooking container C.

The cooking container C is heated by the eddy current EI. In detail, when the eddy current EI flows through the cooking container C having electrical resistance, an atomic nucleus that constitutes the cooking container C and electrons caused by the eddy current EI move. Heat is generated by movement between the atomic nucleus and the electrons.

In this way, the cooking apparatus 1 may supply currents to the induction heating coils L1, L2, L3, and L4 and may heat the cooking container C by using the magnetic field B generated by the induction heating coils L1, L2, L3, and L4.

Also, a user interface 120 including a manipulation button 13 to which control instructions are input from the user, may be disposed at a front side of the main body 10.

The user interface 120 will now be described in detail.

The user interface 120 that interacts with the user, a coil driving unit 110 that supplies driving currents to the induction heating coils L1, L2, L3, and L4, a flame image generating unit 200 that generates flame images, and a main controller 100 that controls an operation of the cooking container C, may be disposed in the main body 10.

The user interface 120 receives an input of the control instructions from the user and provides manipulation signals corresponding to the input control instructions to the main controller 100.

The user interface 120 may be disposed at the front side of the main body 10, as described above.

Also, the user interface 120 may receive an input of the control instructions, such as inputting power, and starting/stopping an operation, from the user and may receive an input of output levels for adjusting intensity of the magnetic field B generated by each of the induction heating coils L1, L2, L3, and L4.

Here, the output levels are obtained by discretely classifying the intensity of the magnetic field B generated by each of the induction heating coils L1, L2, L3, and L4. For example, as the output levels are increased, the induction heating coils L1, L2, L3, and L4 generate a larger magnetic field B, and the cooking container C may be more quickly heated.

The user interface 120 may include the manipulation button 13 to which the control instructions, such as inputting power and staring/stopping an operation, are input from the user, and a manipulation dial 15 to which the output levels are input from the user. The manipulation button 13 may be a microswitch, a membrane switch, or a touch switch.

The manipulation dial 15 includes a holder 15*a* that protrudes from the main body 10 and an output level mark 15*b* that indicates output levels along an outer circumference of the holder 15*a*, as illustrated in FIG. 5A. Also, an indication mark 15*c* for indicating a selected output level is disposed on the main body 10.

The user may pressurize P the holder 15*a* toward the main body 10 of the cooking apparatus 1 and then may rotate the holder 15*a* clockwise C or counterclockwise CC.

When the user rotates the holder 15*a* clockwise C or counterclockwise CC, the output level mark 15*b* is rotated together with the holder 15*a*, and an output level that faces the indication mark 15*c* among a plurality of output levels indicated on the output level mark 15*b* is input to the cooking apparatus 1.

For example, when the user rotates the holder 15*a* counterclockwise CC, output levels 1, 2, 3, . . . , and 9 may face the indication mark 15*c* according to rotation of the holder 15*a*, and the output levels 1, 2, 3, . . . , and 9 may be input to the cooking apparatus 1, as illustrated in FIG. 5B.

In addition, when the user rotates the holder 15*a* clockwise C in a state in which the cooking apparatus 1 is turned off, a maximum output level is input to the cooking apparatus 1.

In other words, when the user rotates the holder 15*a* counterclockwise CC in the state in which the cooking apparatus 1 is turned off, the output levels indicated on the output level mark 15*b* are sequentially input to the cooking apparatus 1, and when the user rotates the holder 15*a* clockwise C in the state in which the cooking apparatus 1 is turned off, the maximum output level may be immediately input to the cooking apparatus 1.

Also, the user interface 120 may display operation information of the cooking apparatus 1.

For example, when an operation start instruction is input from the user together with the output level, the user interface 120 may display that the cooking apparatus 1 is in operation, and may display the input output level.

The user interface 120 may include a display 17, such as a liquid crystal display (LCD), a light-emitting diode (LED), or an organic light-emitting diode (OLED).

Also, the user interface 120 may include a touch screen panel (TSP) in which the manipulation button 13 and the display 17 are formed integrally.

The coil driving unit 110 supplies driving currents to the plurality of induction heating coils L1, L2, L3, and L4 that generate the magnetic field B so as to heat the cooking container C.

The coil driving unit 110 includes a coil driving circuit 111 that supplies a driving current to each of the plurality of induction heating coils L1, L2, L3, and L4, a driving current sensor 113 that detects the size of the driving current supplied to each of the plurality of induction heating coils L1, L2, L3, and L4, and a coil driving controller 115 that controls an operation of the coil driving circuit 111.

Each of the induction heating coils L1, L2, L3, and L4 may have a two-dimensional (2D) spiral shape and may generate the magnetic field B that changes over time.

The coil driving circuit 111 supplies a driving current that changes over time, i.e., an AC, to the induction heating coil L so that the induction heating coil L may generate the magnetic field B that changes over time.

In detail, the coil driving circuit 111 converts AC power into direct current (DC) power and provides the DC to the induction heating coil L. Here, the DC power is generated when an AC power supplied from an external AC power supply is rectified by a rectification circuit RC and is smoothed by a smoothing circuit SC, as illustrated in FIG. 6.

The coil driving circuit 111 may have a half bridge shape, as illustrated in FIG. 6.

For example, the coil driving circuit 111 includes a pair of switches Q1 and Q2 connected to each other in series and a pair of capacitors C1 and C2 connected to each other in series. The pair of switches Q1 and Q2 and the pair of capacitors C1 and C2 are connected to each other in parallel. Also, both ends of the induction heating coil L may be connected to a node at which the pair of switches Q1 and Q2 are connected in series, and a node at which the pair of capacitors C1 and C2 are connected in series.

The pair of switches Q1 and Q2 connected to each other in series may include an upper switch Q1 and a lower switch Q2. The pair of capacitors C1 and C2 connected to each other in series may include an upper capacitor C1 and a lower capacitor C2.

The coil driving circuit 111 may supply an AC driving current to the induction heating coil L depending on whether the upper switch Q1 and the lower switch Q2 are turned on/off.

In detail, when the upper switch Q1 is turned on and the lower switch Q2 is turned off, the driving current is supplied to the induction heating coil L from the upper capacitor C1. The driving current in this case flows from an upper portion to a lower portion of the induction heating coil L based on FIG. 6.

On the other hand, when the upper switch Q1 is turned off and the lower switch Q2 is turned on, the driving current is supplied to the induction heating coil L from the lower capacitor C2. The driving current in this case flows from the lower portion to the upper portion of the induction heating coil L based on FIG. 6.

The driving current sensor 113 detects the driving current supplied to the induction heating coil L.

For example, the driving current sensor 113 may include a current transformer (CT) that proportionally reduces the size of the driving current supplied to the induction heating coil L, and an ampere meter that detects the size of the proportionally-reduced current.

As another example, the driving current sensor 113 may dispose a shunt resistor between the coil driving circuit 111 and the induction heating coil L and may detect a current value of the driving current by using voltage drop that occurs in the shunt resistor. Here, the position of the shunt resistor is not limited to a space between the coil driving circuit 111 and the induction heating coil L. The shunt resistor may be disposed between the smoothing circuit SC and the coil driving circuit 111.

The coil driving controller 115 controls the coil driving circuit 111 according to control signals of the main controller 100.

In detail, the coil driving controller 115 alternately turns on/off the upper switch Q1 and the lower switch Q2 of the coil driving circuit 111 so that the AC driving current may be supplied to the induction heating coil L.

Also, the size of the driving current supplied to the induction heating coil L is adjusted according to a frequency at which the coil driving controller 115 turns on/off the upper switch Q1 and the lower switch Q2. Also, the intensity of the magnetic field B generated by the induction heating coil L is adjusted according to the size of the driving current supplied to the induction heating coil L.

The flame image generating unit 200 radiates light toward the cooking container C according to the control signals of the main controller 100 so that flame images may be formed on the cooking container C.

The flame image generating unit 200 will be described in detail below.

The main controller 100 controls an overall operation of the cooking apparatus 1.

In detail, the main controller 100 may include memory 102 in which a program and data for controlling the operation of the cooking apparatus 1 are memorized, a microprocessor 101 that processes data according to the program stored in the memory 102, and a communication interface 103 that modulates data transmitted to the coil driving unit 110 or the flame image generating unit 200 and demodulates the data received from the coil driving unit 110 or the flame image generating unit 200.

For example, when an output level is input through the user interface 120, the main controller 100 may provide the control signals to the coil driving unit 110 so that the coil driving unit 110 may generate the magnetic field B having the intensity corresponding to the input output level.

Also, the main controller 100 may provide the control signals to the flame image generating unit 200 so that the flame image generating unit 200 may generate flame images corresponding to the input output level.

Figure 7:
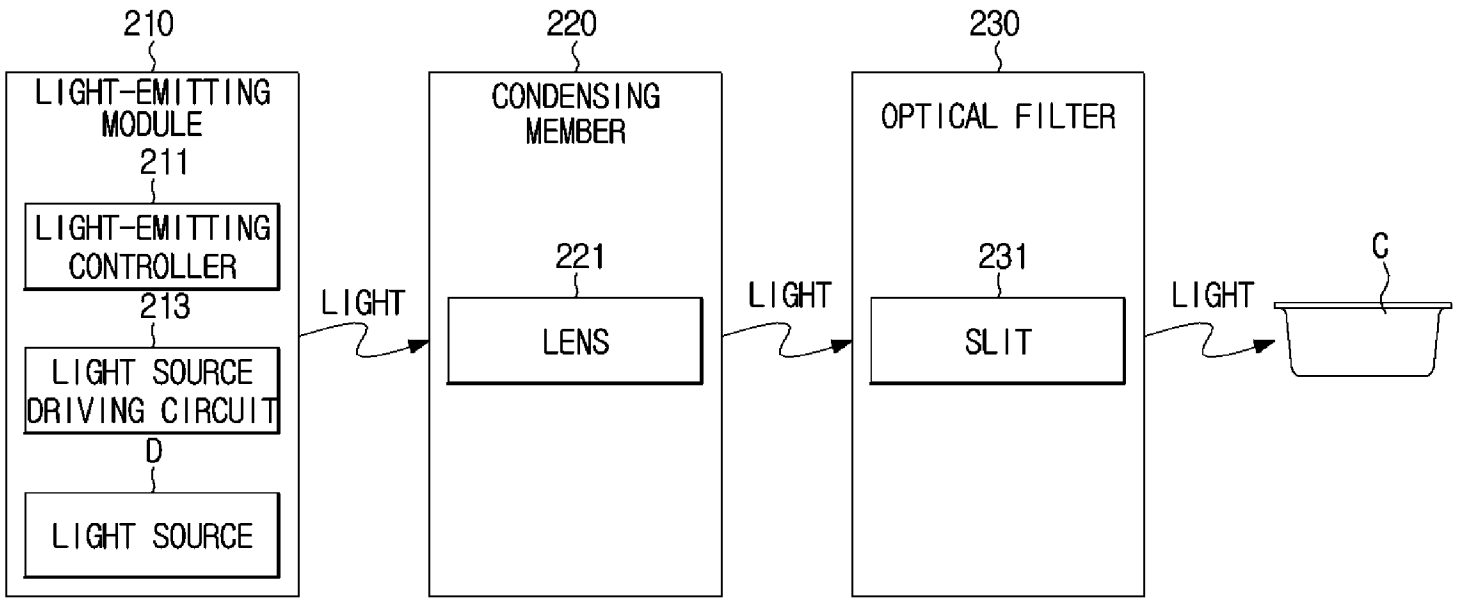
FIG. 7 is a view of a configuration of a flame image generating unit included in the cooking apparatus in accordance with an embodiment of the present invention.
Figure 8:
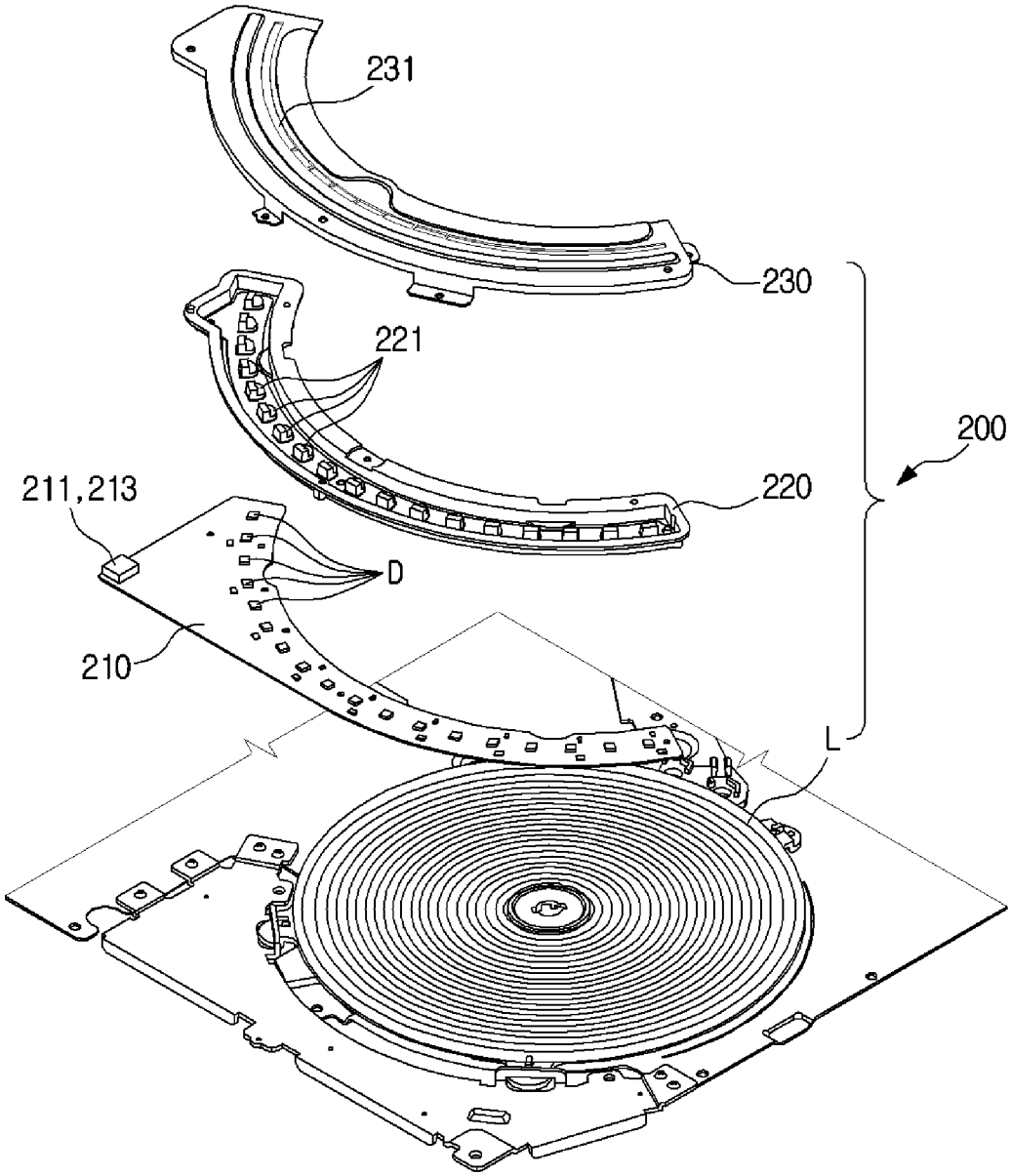
FIG. 8 is an exploded view of the flame image generating unit included in the cooking apparatus in accordance with an embodiment of the present invention.

FIG. 7 is a view of a configuration of a flame image generating unit included in the cooking apparatus in accordance with an embodiment of the present invention, and FIG. 8 is an exploded view of the flame image generating unit included in the cooking apparatus in accordance with an embodiment of the present invention.

Figure 9:
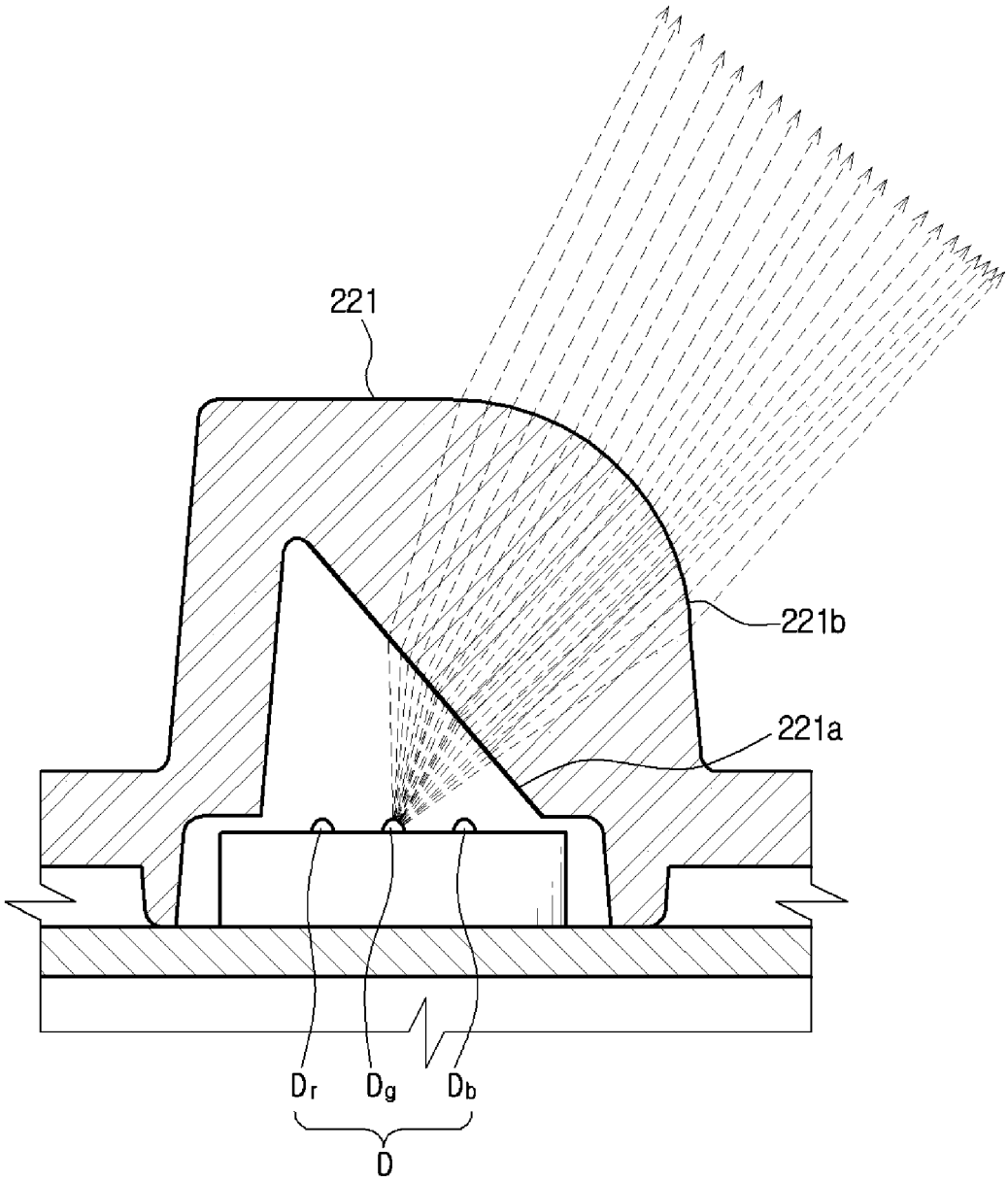
FIG. 9 is a view of a light source and an optical lens included in the cooking apparatus in accordance with an embodiment of the present invention.
Figure 10:
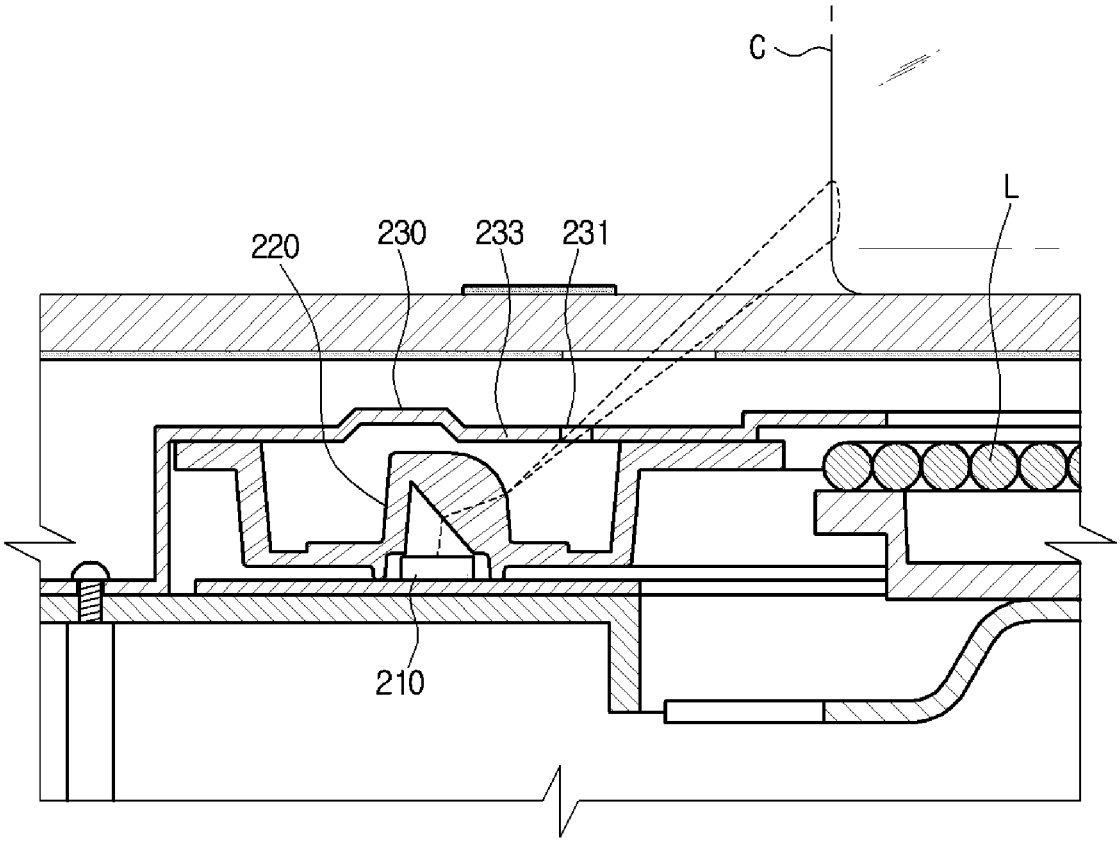
FIG. 10 is a view of a path of light radiated by the flame image generating unit included in the cooking apparatus in accordance with an embodiment of the present invention.
Figure 11:
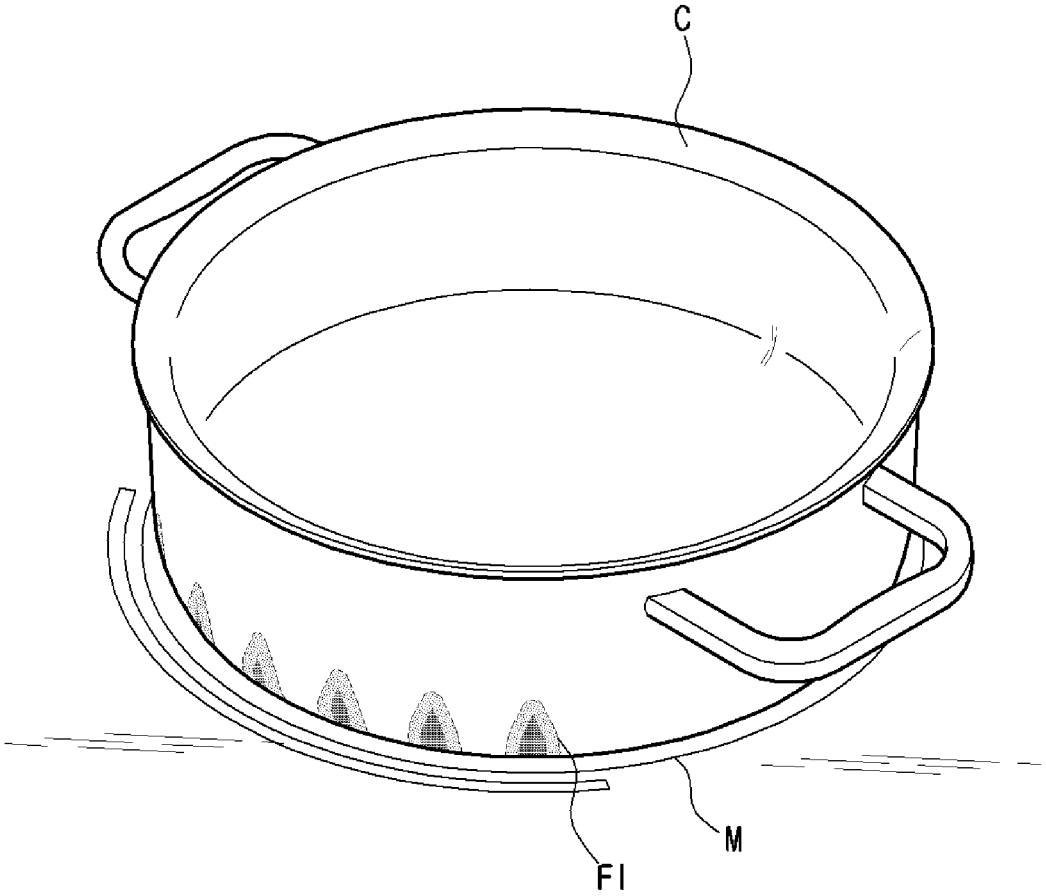
FIG. 11 is a view of flame images generated by the flame image generating unit included in the cooking apparatus in accordance with an embodiment of the present invention.

Also, FIG. 9 is a view of a light source and an optical lens included in the cooking apparatus in accordance with an embodiment of the present invention, and FIG. 10 is a view of a path of light radiated by the flame image generating unit included in the cooking apparatus in accordance with an embodiment of the present invention, and FIG. 11 is a view of flame images generated by the flame image generating unit included in the cooking apparatus in accordance with an embodiment of the present invention.

The configuration and function of the flame image generating unit 200 will be described with reference to FIGS. 7 through 11.

As illustrated in FIG. 8, the flame image generating unit 200 is disposed at one side of the induction heating coil L and includes a light-emitting module 210 that outputs light corresponding to the flame images, a condensing member 220 that refracts or totally reflects light, and an optical filter 230 that selectively transmits light.

The light-emitting module 210 may include light sources D that output light, a light source driving circuit 213 that supplies driving currents to the light sources D, and a light-emitting controller 211 that controls the light source driving circuit 213.

A plurality of light sources D may be disposed, as illustrated in FIG. 8. The plurality of light sources D are disposed to form a circular arc corresponding to an outline of the induction heating coil L and output light by receiving the driving currents from the light source driving circuit 213.

Also, the light sources D may include a red light source $D_r$ that outputs red light, a green light source $D_g$ that outputs green light, and a blue light source $D_b$ that outputs blue light, as illustrated in FIG. 9. However, embodiments of the present invention are not limited thereto, and the light sources D may be configured of a single white light source.

The light sources D may be an LED or a light amplification by stimulated emission of radiation (LASER) that outputs light by using the driving currents.

The light source driving circuit 213 may include a plurality of switches that supply the driving currents to the light sources D or cut off the supply of the driving currents according to control signals of the light-emitting controller 211.

The light source driving circuit 213 will be described in detail below.

A condensing member 220 may include lenses 221 that reflect or refract light output by the light sources D and concentrate the light.

The same number of lenses 221 as the number of the light sources D may be disposed. The lenses 221 may be disposed in positions corresponding to the light sources D, as illustrated in FIG. 8.

Each of the lenses 221 includes a first refracting surface 221*a* that changes progression of light output by the light sources D, and a second refracting surface 221*b* that concentrates light transmitted through the first reflection surface 221*a*, as illustrated in FIG. 9.

The first refracting surface 221*a* may be disposed to be oblique with respect to a direction in which light is output, as illustrated in FIG. 9, and light output in a vertical upward direction is refracted on the first refracting surface 221*a* toward the cooking container C.

The second refracting surface 221*b* may be disposed to be inclined toward the cooking container C and may have a convex shape, and light refracted by the first refracting surface 221*a* is concentrated on the second refracting surface 221*b*, as illustrated in FIG. 9. Light is concentrated on the second refracting surface 221*b* so that linearity of light may be improved and clearer flame images FI may be generated.

The optical filter 230 includes a filter main body 233 that constitutes an exterior of the optical filter 230 and blocks light that is not directed toward the cooking container C among light output by the light sources D, and a slit 231 that is formed in the main body 233 and transmits only light directed toward the cooking container C among light output by the light sources D.

As illustrated in FIG. 10, the slit 231 may be disposed in a path on which light output by the light sources D proceeds toward the cooking container C. In detail, the slit 231 may be formed between the second refracting surface 221*b* and the cooking container C.

Light directed toward the cooking container C among light transmitted by the condensing member 220 passes through the slit 231 and forms the flame images FI in the cooking container C. Light that is not directed toward the cooking container C is blocked by the filter main body 233.

Light output from the light-emitting module 210 is concentrated by the condensing member 220, passes through the optical filter 230, and is radiated onto sides of the cooking container C.

As a result, flame images FI illustrated in FIG. 11 are formed in the sides of the cooking container C.

Hereinafter, arrangement of the plurality of light sources D included in the light-emitting module 210 will be described.

The plurality of light sources D may be disposed to form a circular arc corresponding to the outline of the induction heating coil L.

Figure 12:
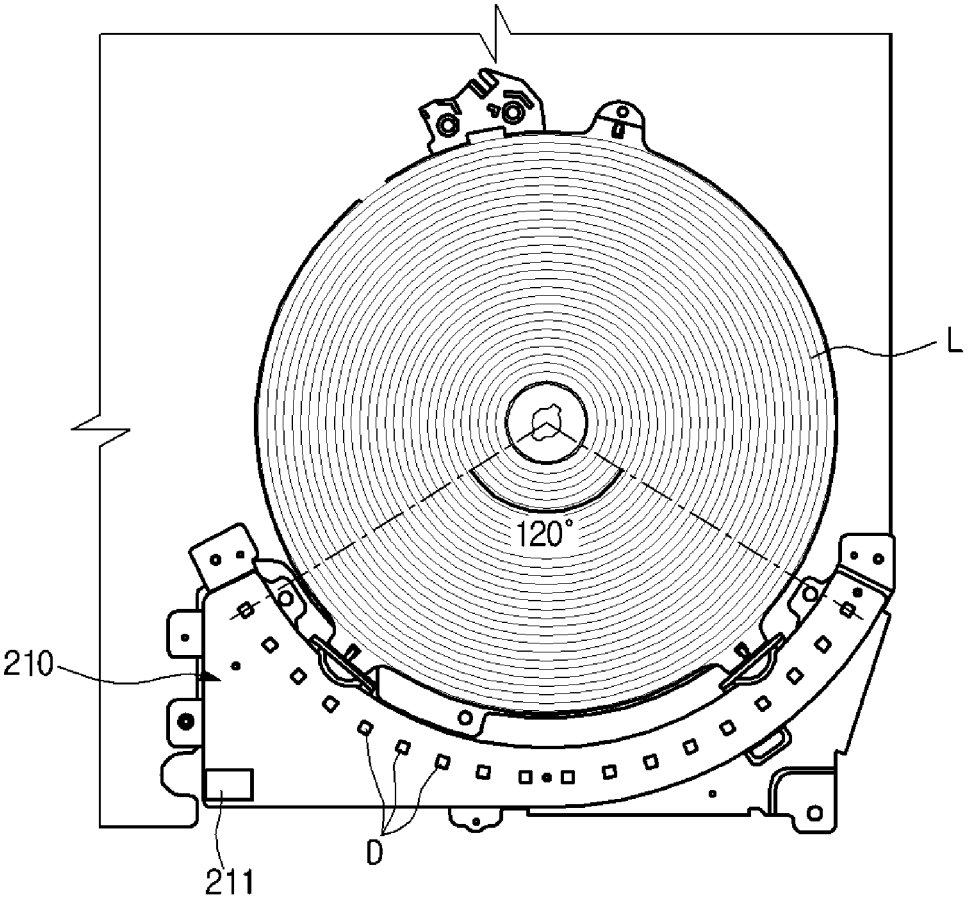
FIG. 12 is a view of an example of arrangement of light sources included in the cooking apparatus in accordance with an embodiment of the present invention.
Figure 13:
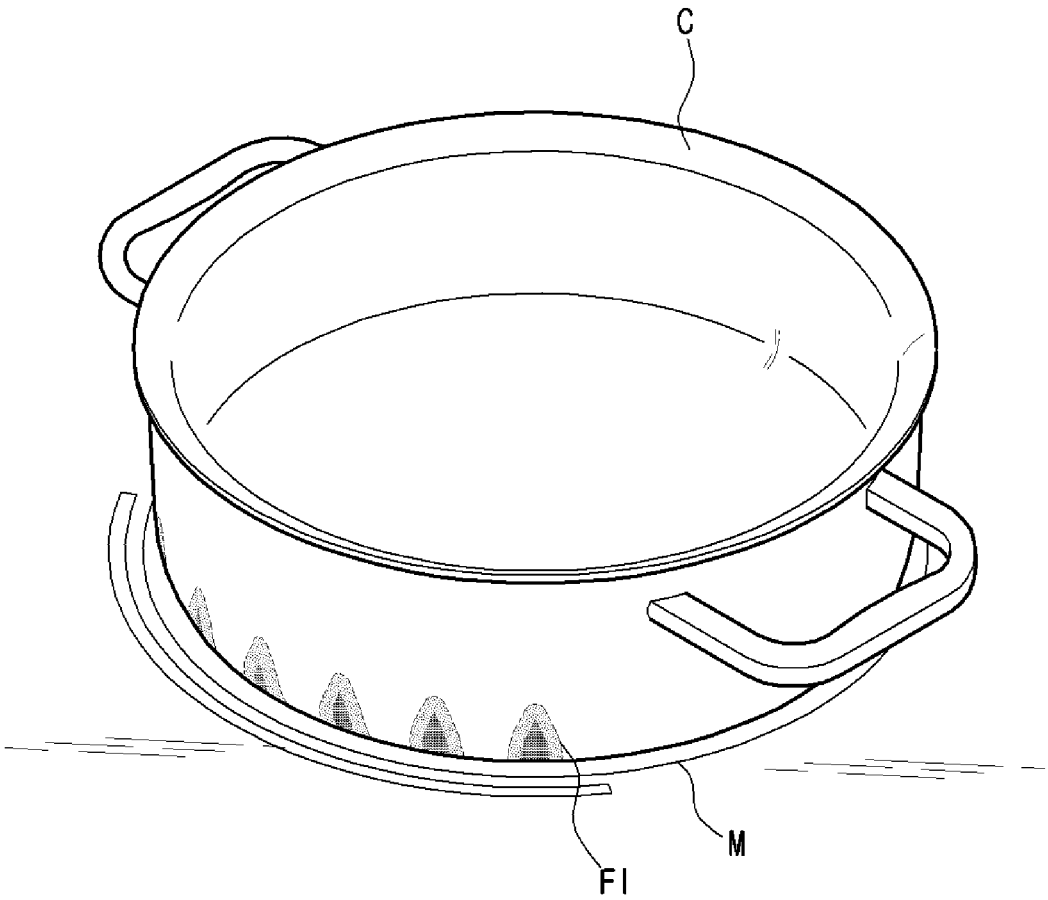
FIG. 13 is a view of flame images when the light sources included in the cooking apparatus in accordance with an embodiment of the present invention are arranged, as illustrated in FIG. 12.

FIG. 12 is a view of an example of arrangement of light sources included in the cooking apparatus in accordance with an embodiment of the present invention, and FIG. 13 is a view of flame images when the light sources included in the cooking apparatus in accordance with an embodiment of the present invention are arranged, as illustrated in FIG. 12.

For example, as illustrated in FIG. 12, the light-emitting module 210 including the light sources D may be disposed in front of the induction heating coil L. The light sources D may be disposed to form a circular arc of about 120 degrees with respect to the center of the induction heating coil L.

When the light sources D are disposed to form the circular arc of about 120 degrees, flame images FI illustrated in FIG. 13 may be formed in the sides of the cooking container C.

In detail, the flame images FI are formed in a position corresponding to a position in which the light sources D are disposed, i.e., in the range of 120 degrees in front of the sides of the cooking container C.

In this way, when the flame images FI are formed in the range of 120 degrees in front of the cooking container C, the user may easily recognize the flame images FI in front of the cooking apparatus 1.

Also, in FIGS. 12 and 13, twelve flame images FI are formed by twelve light sources D. However, the number of light sources D and the number of flame images FI are not limited thereto. A different number of light sources D may be disposed according to the size of the cooking container C and an interval at which the light sources D are disposed, and a different number of flame images FI may be formed according to the number of light sources D.

Figure 14:
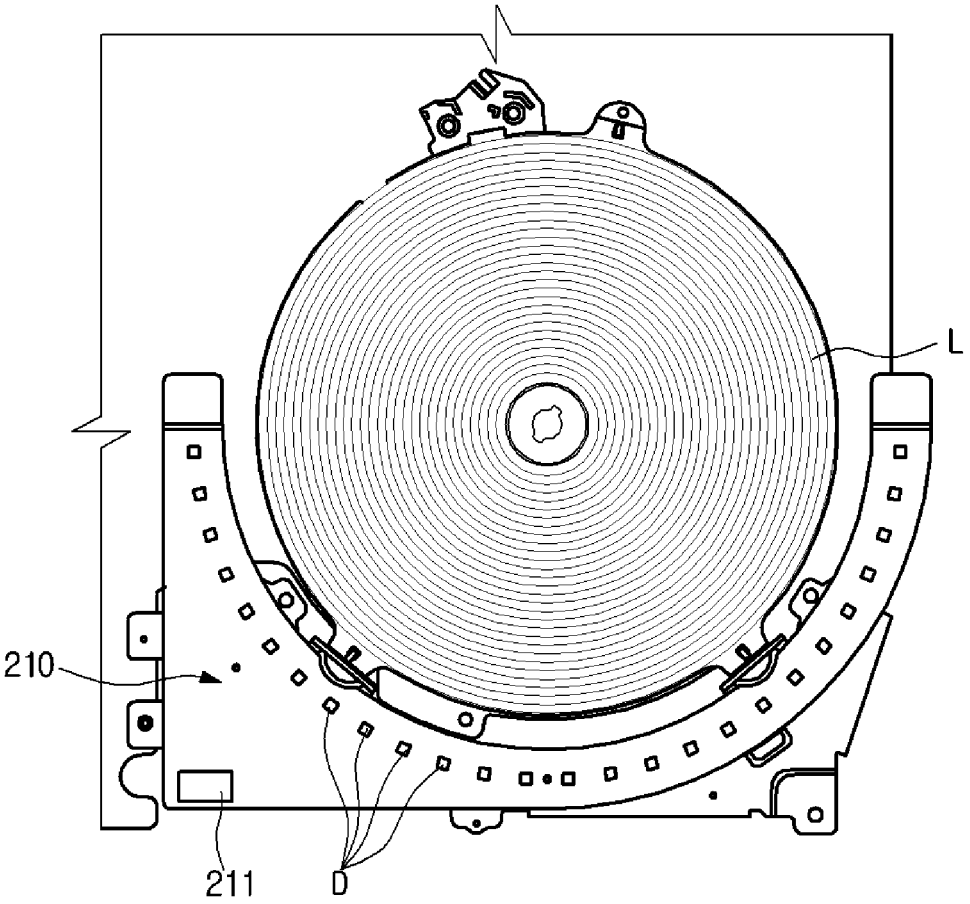
FIG. 14 is a view of another example of arrangement of light sources included in the cooking apparatus in accordance with an embodiment of the present invention.
Figure 15:
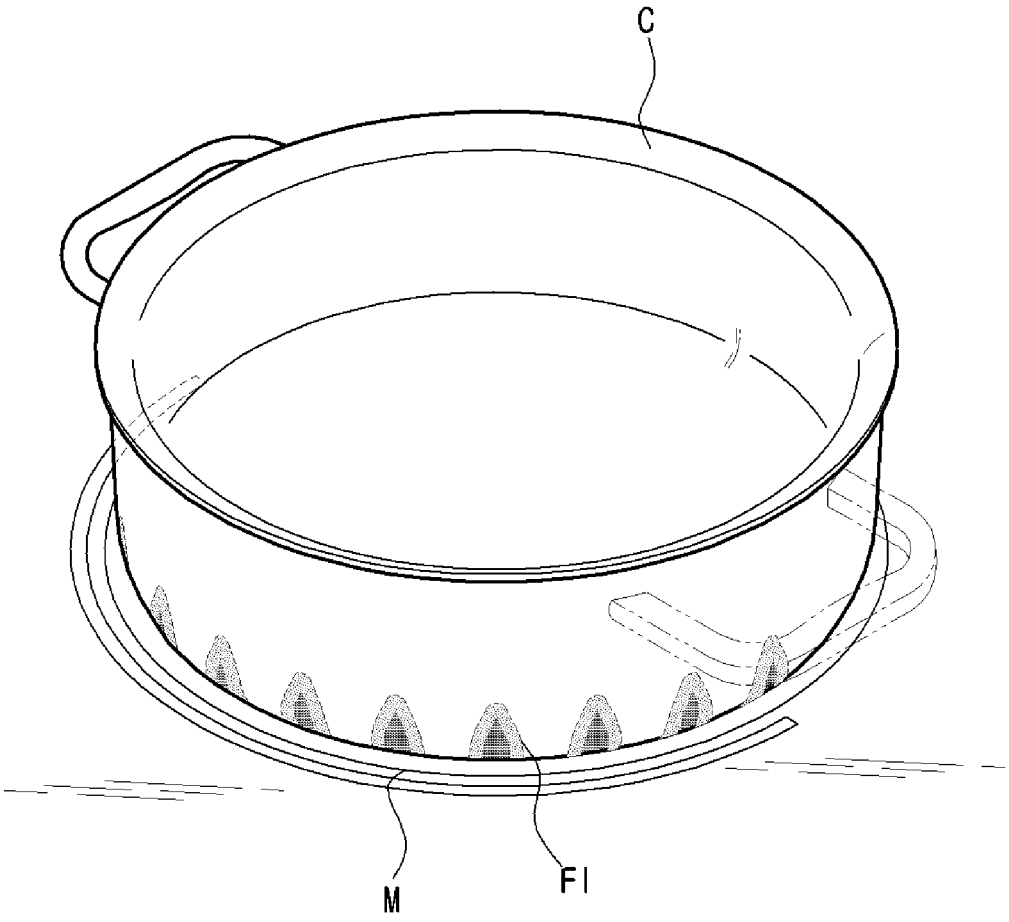
FIG. 15 is a view of flame images when the light sources included in the cooking apparatus in accordance with an embodiment of the present invention are arranged, as illustrated in FIG. 14.

FIG. 14 is a view of another example of arrangement of light sources included in the cooking apparatus in accordance with an embodiment of the present invention, and FIG. 15 is a view of flame images when the light sources included in the cooking apparatus in accordance with an embodiment of the present invention are arranged, as illustrated in FIG. 14.

As another example, as illustrated in FIG. 14, the light-emitting module 210 including the light sources D may be disposed in front of the induction heating coil L, and the light sources D may be disposed to form a circular arc of about 180 degrees with respect to the center of the induction heating coil L.

When the light sources D are disposed to form the circular arc of about 180 degrees, flame images FI illustrated in FIG. 15 may be formed in the sides of the cooking container C.

In detail, the flame images FI are formed in a position corresponding to the position in which the light sources D are disposed, i.e., in the range of front 180 degrees of the sides of the cooking container C.

In this way, when the flame images FI are formed in the range of 180 degrees in front of the cooking container C, the user may recognize the flame images FI in front of the cooking apparatus 1.

Also, in FIGS. 14 and 15, eighteen flame images FI are formed by the eighteen light sources D. However, the number of light sources D and the number of flame images FI are not limited thereto. However, a different number of light sources D may be disposed according to the size of the cooking container C and an interval at which the light sources D are disposed, and a different number of flame images FI may be formed according to the number of light sources D.

Figure 16:
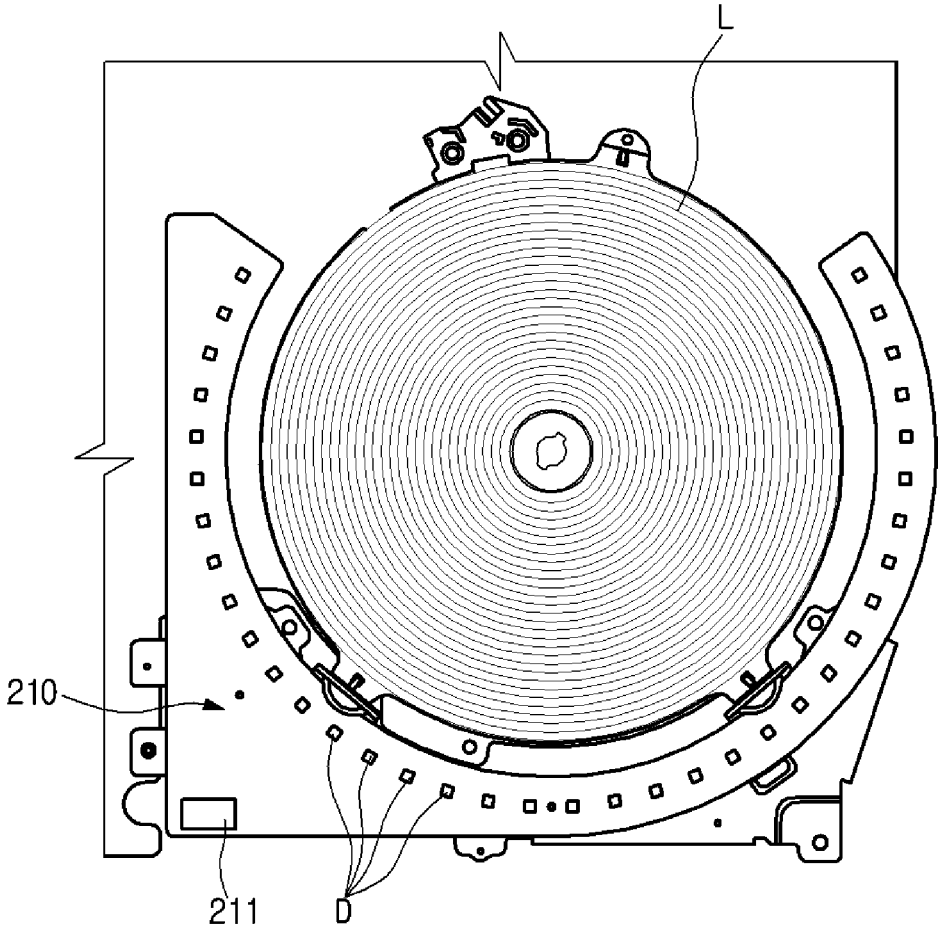
FIGS. 16 through 18 are views of still another example of arrangement of light sources included in the cooking apparatus in accordance with an embodiment of the present invention.

FIG. 16 is a view of still another example of arrangement of light sources included in the cooking apparatus in accordance with an embodiment of the present invention.

As still another example, as illustrated in FIG. 16, the light-emitting module 210 including the light sources D may be disposed in front of the induction heating coil L, and the light sources D may be disposed to form a circular arc of about 240 degrees with respect to the center of the induction heating coil L.

In this way, when the light sources D are disposed to form the circular arc of about 240 degrees, the flame images FI are formed in the range of 240 degrees in front of the sides of the cooking container C.

In this way, when the flame images FI are formed in the range of 240 degrees in front of the cooking container C, the user may recognize the flame images FI from the sides of the cooking apparatus 1 in addition to the front of the cooking apparatus 1.

Also, in FIG. 16, twenty-four light sources D are disposed. However, the number of light sources D is not limited thereto, and a different number of light sources D may be disposed according to the size of the cooking container C and an interval at which the light sources D are disposed.

Figure 17:
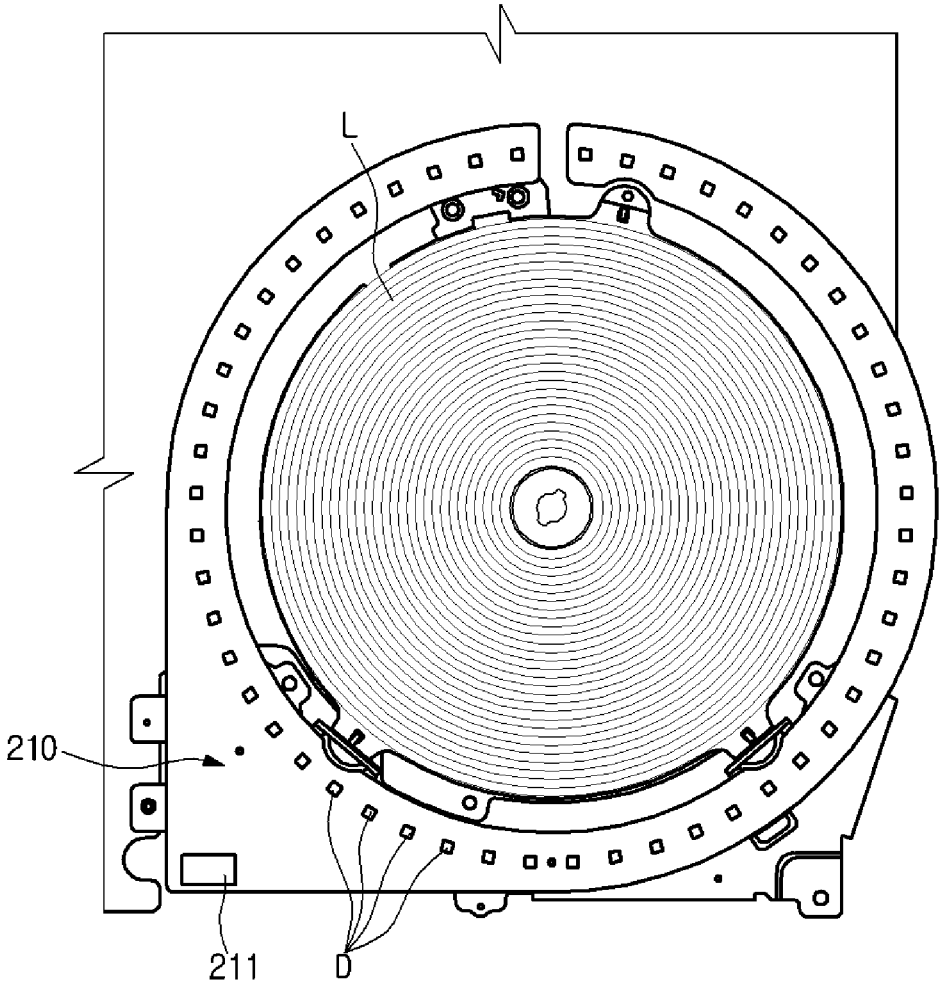

FIG. 17 is a view of still another example of arrangement of light sources included in the cooking apparatus in accordance with an embodiment of the present invention.

As still another example, as illustrated in FIG. 17, the light-emitting module 210 including the light sources D may be disposed in front of the induction heating coil L, and the light sources D may be disposed to form a circular arc based on the center of the induction heating coil L.

In this way, when the light sources D are disposed to form the circular arc, the flame images FI are formed in both sides of the cooking container C.

In this way, when the flame images FI are formed in both sides of the cooking container C, the user may recognize the flame images FI in all directions of the cooking apparatus 1.

Also, in FIG. 17, thirty-six light sources D are disposed. However, the number of light sources D is not limited thereto, and a different number of light sources D may be disposed according to the size of the cooking container C and an interval at which the light sources D are disposed.

As described above, when the plurality of light sources D are disposed to form the circular arc, light radiated by the light sources D may generated natural flame images FI in the sides of the cooking container C having a circular shape.

However, the arrangement of the plurality of light sources D is not limited to the circular arc. For example, when the cooking container C has an angulated shape, for example, a square shape or a rectangular shape, the plurality of light sources D may be disposed in a straight line shape or a "U" shape.

Figure 18:
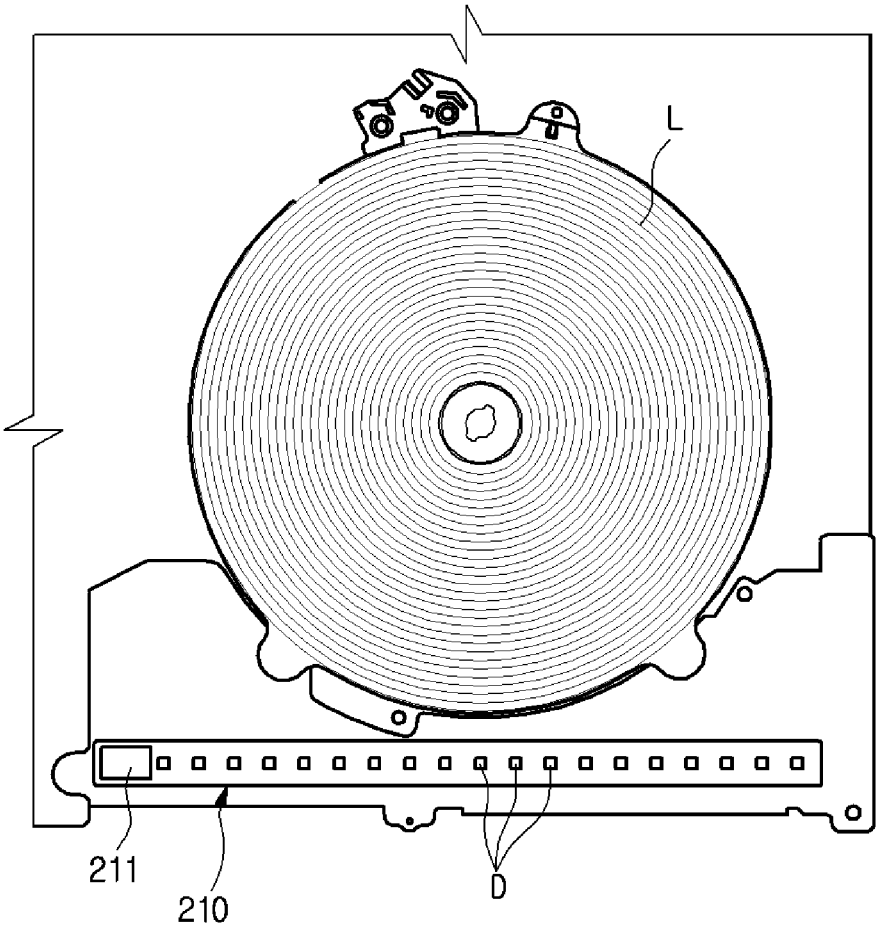
Figure 19:
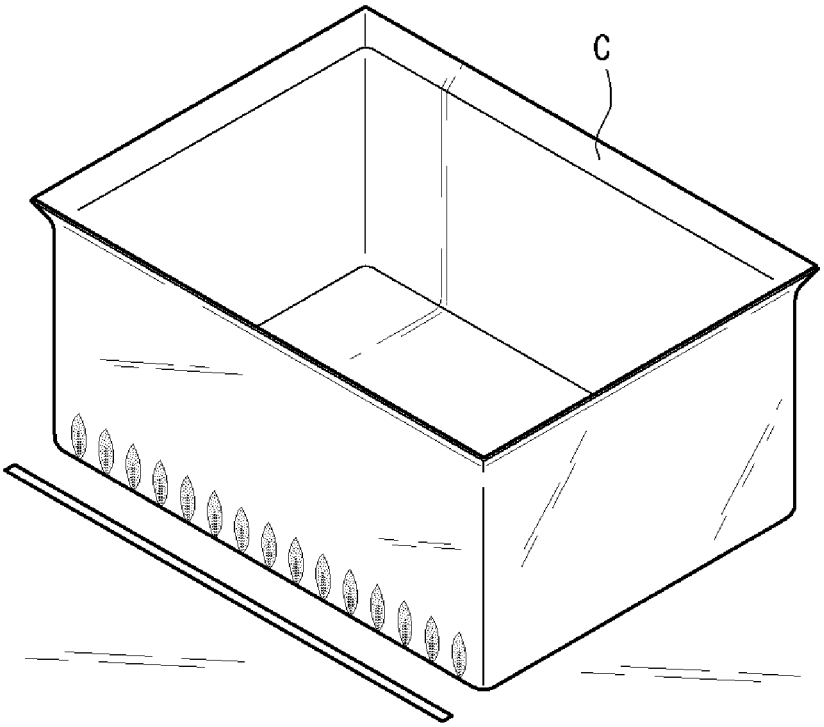
FIG. 19 is a view of flame images when the light sources included in the cooking apparatus in accordance with an embodiment of the present invention are arranged, as illustrated in FIG. 18.

FIG. 18 is a view of still another example of the arrangement of light sources included in the cooking apparatus in accordance with an embodiment of the present invention, and FIG. 19 is a view of flame images when the light sources included in the cooking apparatus in accordance with an embodiment of the present invention are arranged, as illustrated in FIG. 18.

For example, as illustrated in FIG. 18, the light-emitting module 210 including the light sources D may be disposed in front of the induction heating coil L, and the light sources D may be disposed to form a straight line having a length corresponding to the diameter of the induction heating coil L.

When the light sources D are disposed to form the straight line, the flame images FI illustrated in FIG. 19 may be formed in the sides of the cooking container C.

In detail, the flame images FI are formed in a position in which the light sources D are disposed, i.e., in a front side of the sides of the cooking container C.

In this way, when the flame images FI are formed in the front side of the cooking container C, the user may recognize the flame images FI in front of the cooking apparatus 1.

Also, in FIGS. 18 and 19, twelve flame images FI are formed by twelve light sources D. However, the number of light sources D and the number of flame images FI are not limited thereto, and a different number of light sources D may be disposed according to the size of the cooking container C and an interval at which the light sources D are disposed, and a different number of flame images FI may be formed according to the number of light sources D.

Figure 20:
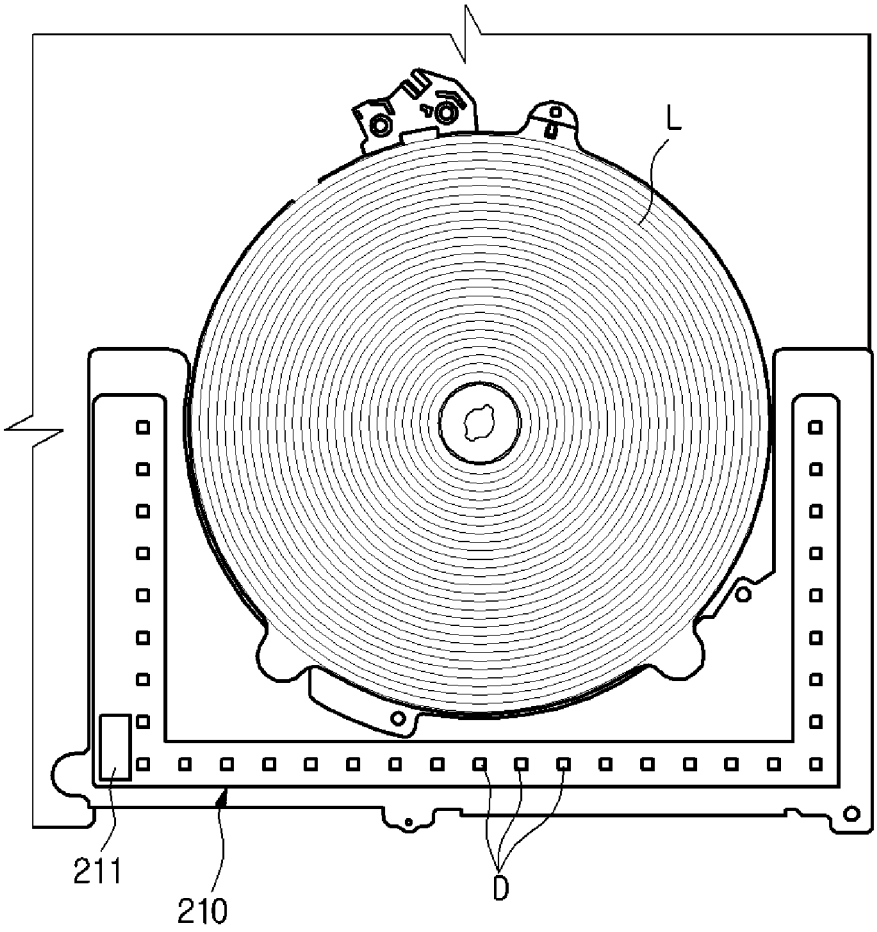
FIG. 20 is a view of still another example of arrangement of light sources included in the cooking apparatus in accordance with an embodiment of the present invention.

FIG. 20 is a view of still another example of arrangement of light sources included in the cooking apparatus in accordance with an embodiment of the present invention.

As another example, as illustrated in FIG. 20, the light-emitting module 210 including the light sources D may be disposed in front of the induction heating coil L, and the light sources D may be disposed to form the "U" shape having the size corresponding to the diameter of the induction heating coil L.

When the light sources D are disposed to form the "U" shape, the flame images FI are formed in a position in which the light sources D are disposed, of the sides of the cooking container C, i.e., in a front side and a lateral side of the cooking container C.

In this way, when the flame images FI are formed in the front side and the lateral side of the cooking container C, the user may recognize the flame images FI from the sides of the cooking apparatus 1 in addition to the front of the cooking apparatus 1.

As described above, the plurality of light sources D may be disposed to have various shapes according to the shape of the cooking container C.

Hereinafter, a circuit configuration of the light-emitting module 210 will be described.

To aid in understanding, it is assumed that the light-emitting module 210 includes twelve light sources D.

Figure 21:
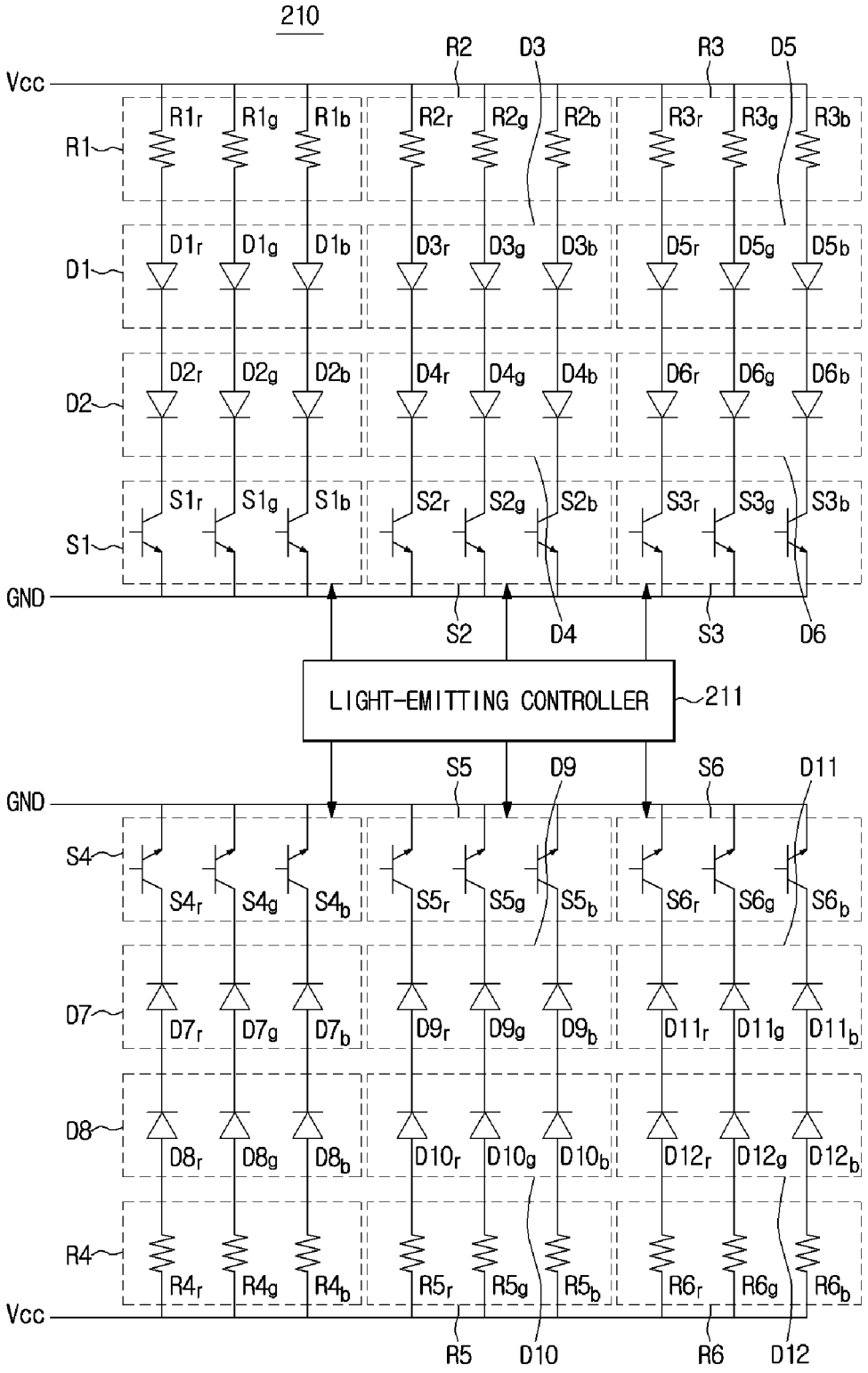
FIG. 21 is a view of an example of a circuit for implementing a light-emitting module included in the cooking apparatus in accordance with an embodiment of the present invention.

FIG. 21 is a view of an example of a circuit for implementing a light-emitting module included in the cooking apparatus in accordance with an embodiment of the present invention, and FIGS. 22 through 25 are views of an example of control signals of a light-emitting controller included in the cooking apparatus in accordance with an embodiment of the present invention.

Referring to FIG. 21, the light-emitting module 210 includes a plurality of light sources D1 through D12 that output light, a plurality of switching units S1 through S6 that control driving currents supplied to the plurality of light sources D1 through D12, a plurality of resistive units R1 through R6 that limit the sizes of the driving currents supplied to the light sources D1 through D12, and a light-emitting controller 211 that controls turning on/off of the plurality of switching units S1 through S6.

Here, the plurality of switching units S1 through S6 and the plurality of resistive units R1 through R6 constitute the above-described light source driving circuit 213.

The plurality of light sources D1 through D12 output light for forming the flame images FI. The plurality of light sources D1 through D12 include twelve light sources D1 through D12. For example, the plurality of light sources D1 through D12 may include a first light source D1, a second light source D2, a third light source D3, . . . , and a twelfth light source D12.

Also, each of the light sources D1 through D12 includes R light sources $D1_r$ through $D12_r$ that output red light, G light sources $D1_g$ through $D12_g$ that output green light, and B light sources $D1_b$ through $D12_b$ that output blue light. For example, the first light source D1 may include a first R light source $D1_r$, a first G light source $D1_g$, and a first B light source $D1_b$.

However, each of the light sources D1 through D12 is not limited to include the R light sources $D1_r$ through $D12_r$, the G light sources $D1_g$ through $D12_g$, and the B light sources $D1_b$ through $D12_b$ and may be configured of a single white light source.

Also, each of the plurality of light sources D1 through D12 forms a group of two light sources of the light sources D1 through D12, and two light sources are connected to each other in series, as illustrated in FIG. 21.

In detail, the first R light source $D1_r$ and the second R light source $D2_r$ may be connected to each other in series, and the first G light source $D1_g$ and the second G light source $D2_g$ may be connected to each other in series, and the first B light source $D1_b$ and the second B light source $D2_b$ may be connected to each other in series. The third through twelfth light sources D3 through D12 are also connected to the first and second light sources D1 and D2 in the same shape.

Also, different light source groups (D1, D2), (D3, D4), . . . , and (D11, D12) may be connected to each other in parallel.

As a result, light sources D1 and D2, D3 and D4, . . . , and D11 and D12 that are connected to each other in series of one group may be simultaneously turned on/off, and different adjacent light source groups (D1, D2), (D3, D4), . . . , and (D11, D12) that are connected to each other in parallel may operate independently.

The plurality of light sources D1 through D12 may be an LED or an LASER that outputs light by a driving current.

The plurality of switching units S1 through S6 control the driving currents supplied to the plurality of light sources D1 through D12. The plurality of switching units S1 through S6 include six switching units S1 through S6. For example, the plurality of switching units S1 through S6 may include a first switching unit S1, a second switching unit S2, . . . , and a sixth switching unit S6.

Also, each of the switching units S1 through S6 includes R switches S1, through S6, that control the driving currents supplied to the R light sources D1$r$ through D12$_r$, G switches S1$_g$ through S6$_g$ that control the driving currents supplied to the G light sources D1$_g$ through D12$_g$, and B switches S1$_b$ through S6$_b$ that control the driving currents supplied to the B light sources D1$_b$ through D12$_b$. For example, the first switching unit S1 may include a first R switch S1$_r$, a first G switch S1$_g$, and a first B switch S1$_b$.

However, each of the switching units S1 through S6 is not limited to include the R switches S1, through S6$_r$, the G switches S1$_g$ through S6$_g$, and the B switches S1$_b$ through S6$_b$ and may be configured of a single switch.

Also, each of the plurality of switching units S1 through S6 may be connected in series to light sources D1 and D2, D3 and D4, . . . , and D11 and D12 connected to each other in series of one group, as illustrated in FIG. 21.

In detail, the first R switch S1$_r$ may be connected to the first R light source D1$_r$ and the second R light source D2$_r$ in series, and the first G switch S1g may be connected to the first G light source D1$_g$ and the second G light source D2$_g$ in series, and the first B switch S1$_b$ may be connected to the first B light source D1$_b$ and the second B light source D2$_b$ in series.

Driving currents are supplied to the plurality of light sources D1 through D12 or the supply of the driving currents is cut off depending on whether the plurality of switching units S1 through S6 are turned on/off.

For example, when the first R switch S1$_r$ included in the first switching unit S1 is turned on, driving currents are supplied to the first R light source D1$_r$ and the second R light source D2$_r$ connected to the first R switch S1$_r$ in series, and each of the first R light source D1$_r$ and the second R light source D2$_r$ outputs red light.

Also, when the first R switch S1, included in the first switching unit S1 is turned off, the supply of driving currents to the first R light source D1$_r$ and the second R light source D2$_r$ connected to the first R switch S1$_r$ in series, is cut off, and the first R light source D1$_r$ and the second R light source D2$_r$ do not output light.

The plurality of switching units S1 through S6 may employ a metal-oxide-semiconductor field effect transistor (MOSFET) or a bipolar junction transistor (BJT)

The plurality of resistive units R1 through R6 limit the driving currents supplied to the plurality of light sources D1 through D12. When there are no plurality of resistive units R1 through R6, a very large driving current may be supplied to each of the plurality of light sources D1 through D12 so that the plurality of light sources D1 through D12 and the plurality of switching units S1 through S6 may be damaged.

Also, the plurality of resistive units R1 through R6 include six resistive units R1 through R6. For example, the plurality of resistive units R1 through R6 may include a first resistive unit R1, a second resistive unit R2, . . . , and a sixth resistive unit R6.

Also, each of the resistive units R1 through R6 includes R resistors R1$_r$ through R6$_r$ that limit driving currents supplied to the R light sources D1$_r$ through D12$_r$, G resistors R1$_g$ through R6$_g$ that limit driving currents supplied to the G light sources D1$_g$ through D12$_g$, and B resistors R1$_b$ through R6$_b$ that control driving currents supplied to the B light sources D1$_b$ through D12$_b$. For example, the first resistive unit R1 may include a first R resistor R1$_r$, a first G resistor R1$_g$, and a first B resistor R1$_b$.

However, each of the resistive units R1 through R6 is not limited to include the R resistors R1$_r$ through R6$_r$, the G resistors R1$_g$ through R6$_g$, and the B resistors R1$_b$ through R6$_b$ and may be configured of a single resistor.

Also, each of the plurality of resistive units S1 through S6 may be connected in series to light sources D1 and D2, D3 and D4, . . . , and D11 and D12 connected to each other in series of one group, as illustrated in FIG. 21.

In detail, the first R resistor R1$_r$ may be connected to the first R light source D1$_r$ and the second R light source D2$_r$ in series, and the first G resistor R1$_g$ may be connected to the first G light source D1$_g$ and the second G light source D2$_g$ in series, and the first B resistor R1$_b$ may be connected to the first B light source D1$_b$ and the second B light source D2$_b$ in series.

The light-emitting controller 211 turns on/off the plurality of switching units S1 through S6 according to the control signals provided by the main controller 100.

For example, when the light-emitting controller 211 turns on all of the switching units S1 through S6, the flame images FI are formed in the sides of the cooking container C, and when the light-emitting controller 211 turns off all of the switching units S1 through S6, the flame images F1 in the sides of the cooking container C disappear.

Also, the cooking apparatus 1 may change colors of the flame images FI formed in the sides of the cooking container C.

Figure 22:
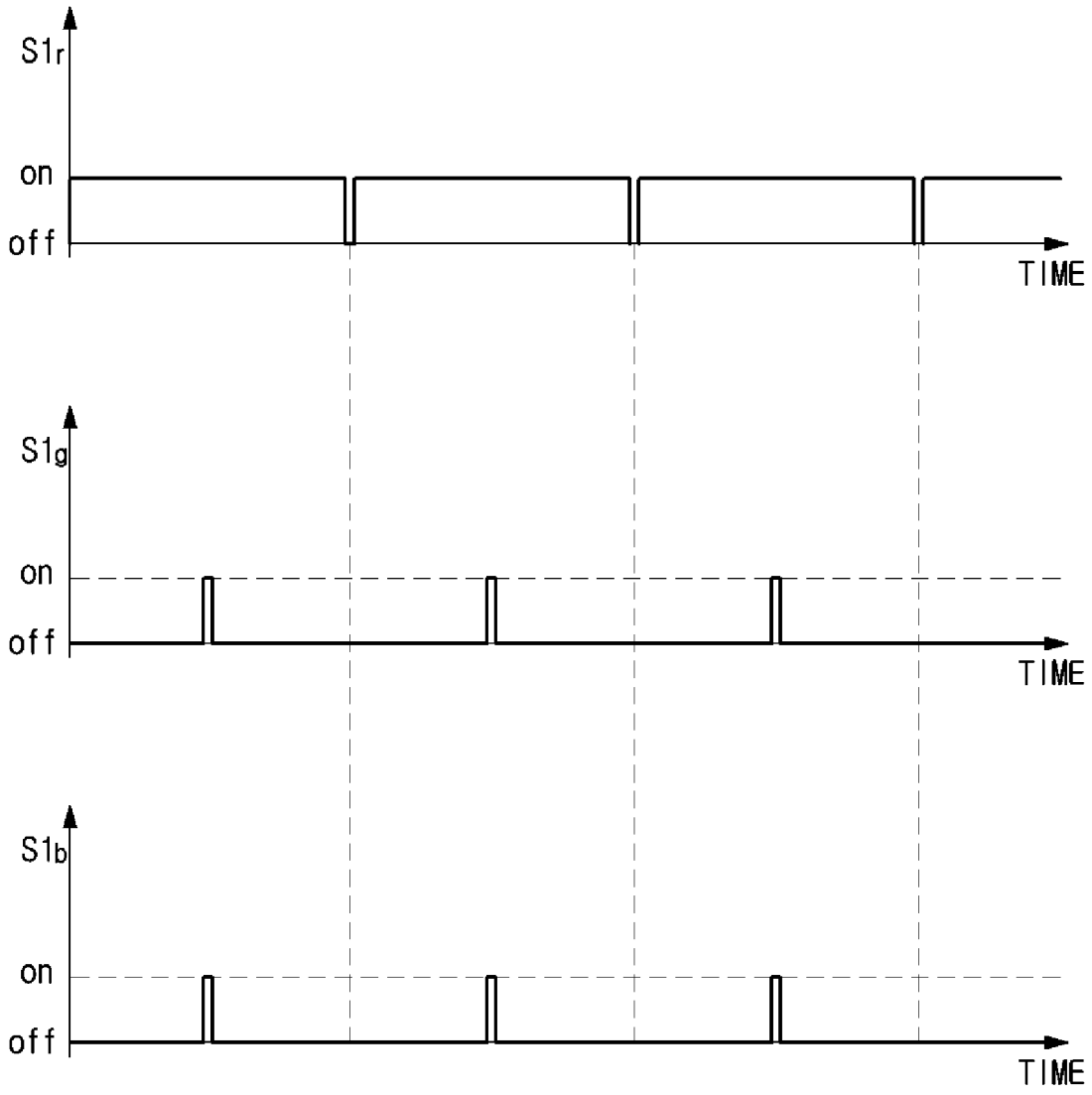
FIGS. 22, 23, 24A, 24B, 24C, and 25 are views of an example of control signals of a light-emitting controller included in the cooking apparatus in accordance with an embodiment of the present invention.

For example, in order to output red light, the light-emitting controller 211 may output control signals illustrated in FIG. 22 to the switching units S1 through S6. In detail, the light-emitting controller 211 may output on signals to the first through sixth R switches S1$_r$ through S6$_r$, off signals to the first through sixth G switches S1$_g$ through S6$_g$, and off signals to the first through sixth B switches S1$_b$ through S6$_b$.

Figure 23:
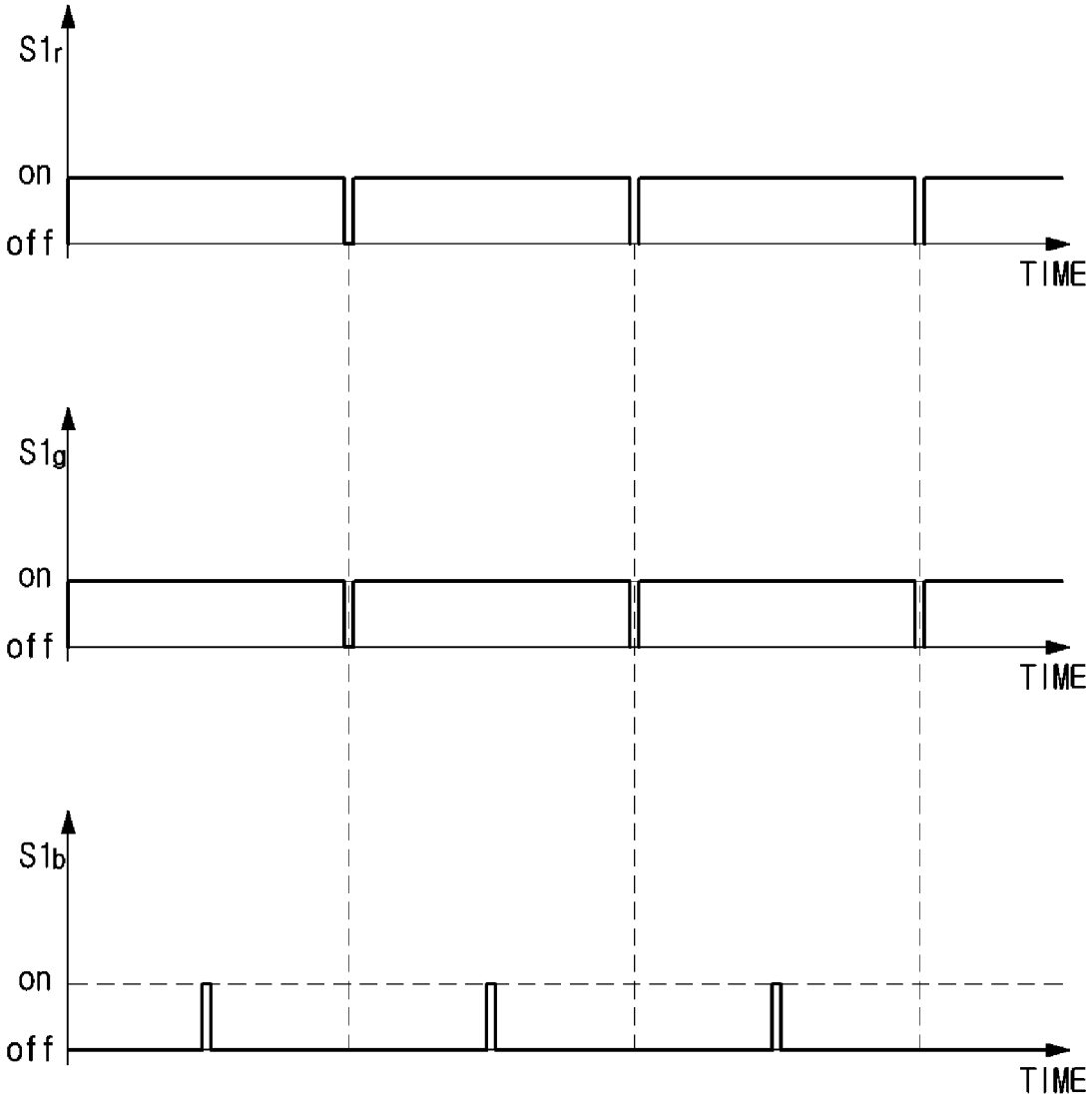

As another example, in order to output orange light, the light-emitting controller 211 may output control signals illustrated in FIG. 23 to the switching units S1 through S6. In detail, the light-emitting controller 211 may output on signals to the first through sixth R switches S1$_r$ through S6$_r$, on signals to the first through sixth G switches S1$_g$ through S6$_g$, and off signals to the first through sixth B switches S1$_b$ through S6$_b$.

In this way, the light-emitting controller 211 may control the plurality of switching units S1 through S6 so that the plurality of light sources D1 through D12 may output various colors.

The light-emitting controller 211 controls turning on/off of the plurality of switching units S1 through S6 so that the plurality of light sources D1 through D12 may output red light, green light, blue light, yellow light, cyan light, magenta light, and white light.

Also, the cooking apparatus 1 may adjust brightness and sizes of the flame images FI formed in the sides of the cooking container C.

In detail, the light-emitting controller 211 may control intensities of light output by the plurality of light sources D1 through D12 using pulse width modulation (PWM) control.

For example, the light-emitting controller 211 sets a PWM period T0 for PWM and adjusts duty ratios of turning-on signals output to the switching units S1 through S6 within the PWM period T0. Here, the duty ratios of the turning-on signals are ratios of output time T1 of the on signals with respect to the PWM period T0.

In other words, the light-emitting controller 211 may adjust the duty ratios of the turning-on signals with respect to the switching units S1 through S6, thereby adjusting the intensities of light output by the light sources D1 through D12.

Figure 24A:
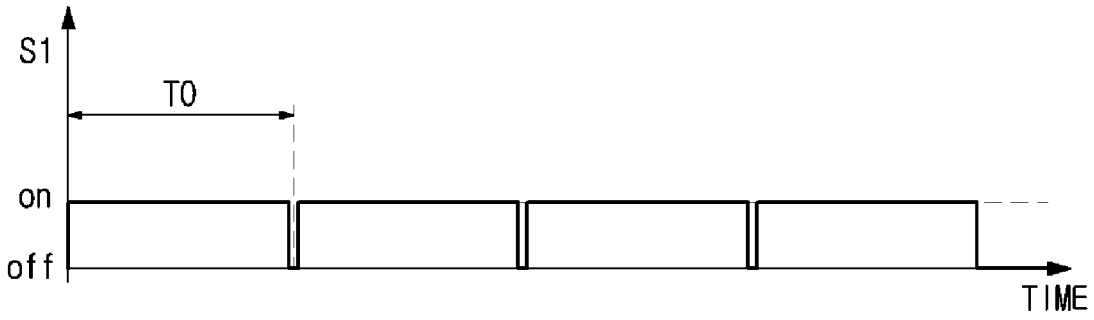

The light-emitting controller 211 may adjust the duty ratios of the turning-on signals output to the switching units S1 through S6 to be 100%, as illustrated in FIG. 24A, so that the light sources D1 through D12 may output light having a maximum intensity.

Figure 24B:
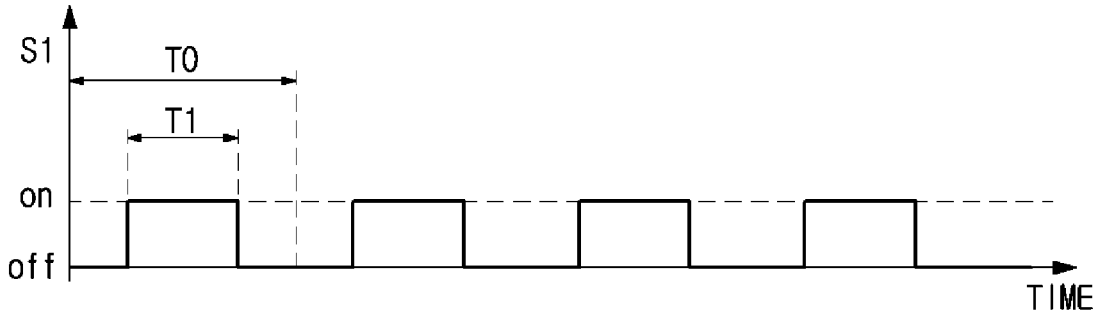

Also, the light-emitting controller 211 may adjust the duty ratios of the turning-on signals to be 50%, as illustrated in FIG. 24B, so that the light sources D1 through D12 may output light having half of an intensity.

Figure 24C:
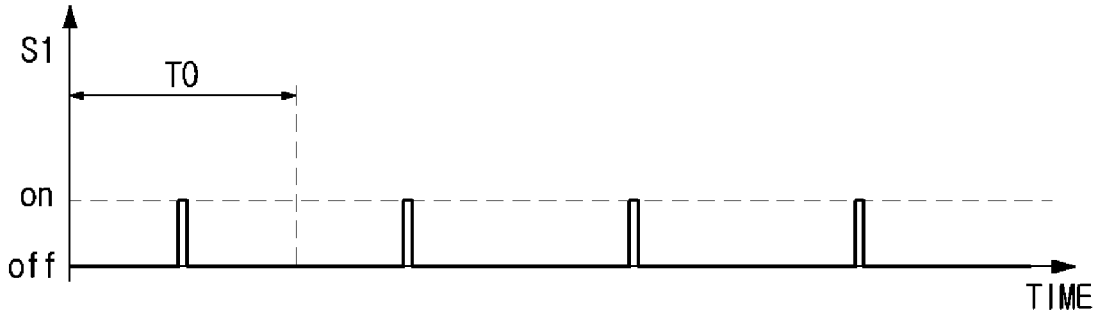

Also, when the light-emitting controller 211 sets the duty ratios of the turning-on signals to 0%, as illustrated in FIG. 24C, the light sources D1 through D12 do not output light.

In this way, the light-emitting controller 211 may adjust brightness and sizes of the flame images FI by adjusting the duty ratios of the turning-on signals with respect to the switching units S1 through S6.

By using this function, the cooking apparatus 1 adjusts the intensity of the magnetic field B generated by the plurality of induction heating coils L1, L2, L3, and L4 according to output levels input by the user and simultaneously, the cooking apparatus 1 may adjust the intensities of light output by the plurality of light sources D1 through D12 according to output levels input by the user.

For example, when the user inputs output levels corresponding to half of a maximum output level, the cooking apparatus 1 may control the coil driving unit 110 so that the plurality of induction heating coils L1, L2, L3, and L4 may output the magnetic field B having an intensity corresponding to half of a maximum output intensity, and the plurality of light sources D1 through D12 may control the flame image generating unit 200 so as to output light having an intensity corresponding to half of the maximum output intensity.

As a result, the cooking container C may be heated at a speed of half of maximum heating speed, and the flame images FI corresponding to half of maximum brightness may be formed in the sides of the cooking container C.

Also, the cooking apparatus 1 may form the flame images FI having various colors by using PWM control.

Figure 25:
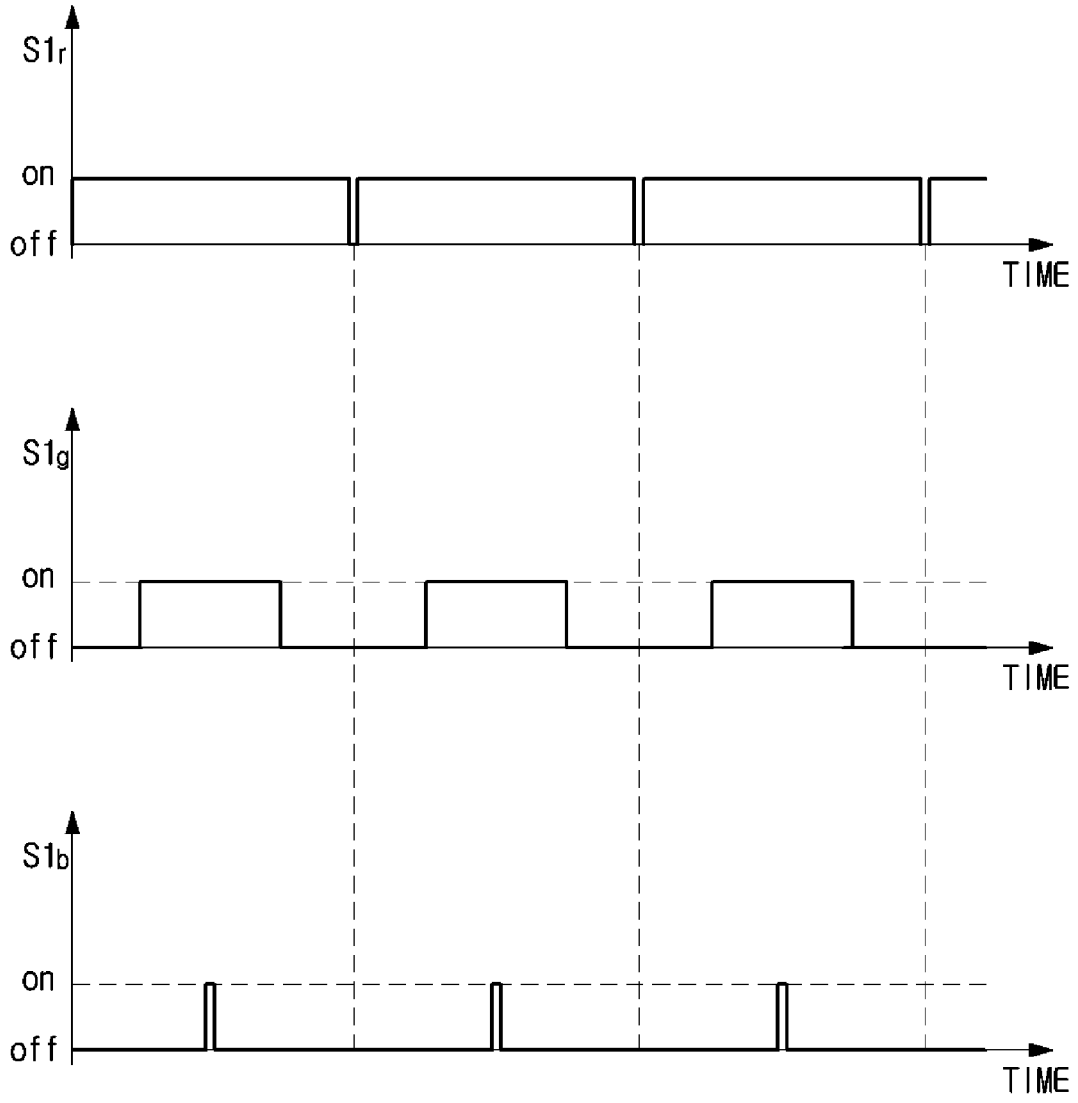

For example, as illustrated in FIG. 25, when the light-emitting controller 211 sets duty ratios of the R switches $S1_r$ through $S6_r$ to 100%, sets duty ratios of the G switches $S1_g$ through $S6_g$ 50% and sets duty ratios of the B switches $S1_b$ through $S6_b$ to 0%, the light sources D1 through D12 may output orange light.

In this way, the light-emitting controller 211 may PWM control the switching units S1 through S6 so that the light sources D1 through D12 may output light having various colors.

By using this function, the cooking apparatus 1 may change colors of light output by the plurality of light sources D1 through D12 according to output levels input by the user.

For example, when the user inputs a maximum output level, the cooking apparatus 1 may control the flame image generating unit 200 so as to form blue flame images FI. Also, the cooking apparatus 1 may control the flame image generating unit 200 so that yellow flame images FI may be formed when the user inputs an output level corresponding to half of the maximum output level, and may control the flame image generating unit 200 so that red flame images FI may be formed when the user inputs a minimum output level.

As described above, the flame image generating unit 200 may generate flame images having various brightness, sizes, and colors.

Hereinafter, changing brightness, sizes, or colors of the flame images FI by using the flame image generating unit 200 will be described.

As described above, the plurality of light sources D1 through D12 are disposed to form a circular arc corresponding to the outline of the induction heating coil L, and each of the plurality of light sources D1 through D12 forms a group of two light sources of the light sources D1 through D12, and two light sources are connected to each other in series.

Also, light sources D1 and D2, D3 and D4, . . . , and D11 and D12 connected to each other in series of one group may be simultaneously turned on/off, and different adjacent light source groups (D1, D2), (D3, D4), . . . , and (D11, D12) connected to each other in parallel may operate independently.

As a result, different dynamic effects may be given to the flame images FI according to the order of arrangement of light sources D1 and D2, D3 and D4, . . . , and D11 and D12 connected to each other in series of one group.

Figure 26:
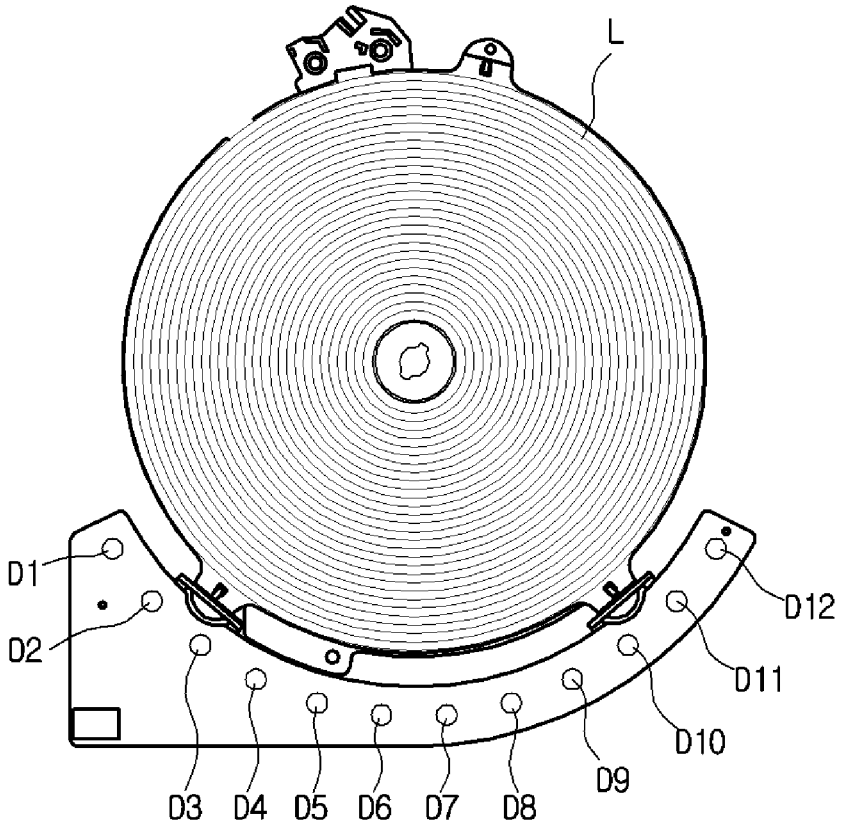
FIG. 26 is a view of an example of the order of arrangement of light sources included in the cooking apparatus in accordance with an embodiment of the present invention.

FIG. 26 is a view of an example of the order of arrangement of light sources included in the cooking apparatus in accordance with an embodiment of the present invention.

Light sources D1 and D2, D3 and D4, . . . , and D11 and D12 of one group among the plurality of light sources D1 through D12 that are electrically connected to each other in series may be disposed to be adjacent to each other.

For example, as illustrated in FIG. 26, the plurality of light sources D1 through D12 may be disposed in the order of the first light source D1, the second light source D2, the third light source D3, . . . , and the twelfth light source D12.

Hereinafter, movement of flame images when it is assumed that the plurality of light sources D1 through D12 are disposed, as illustrated in FIG. 26, will be described.

Figure 27A:
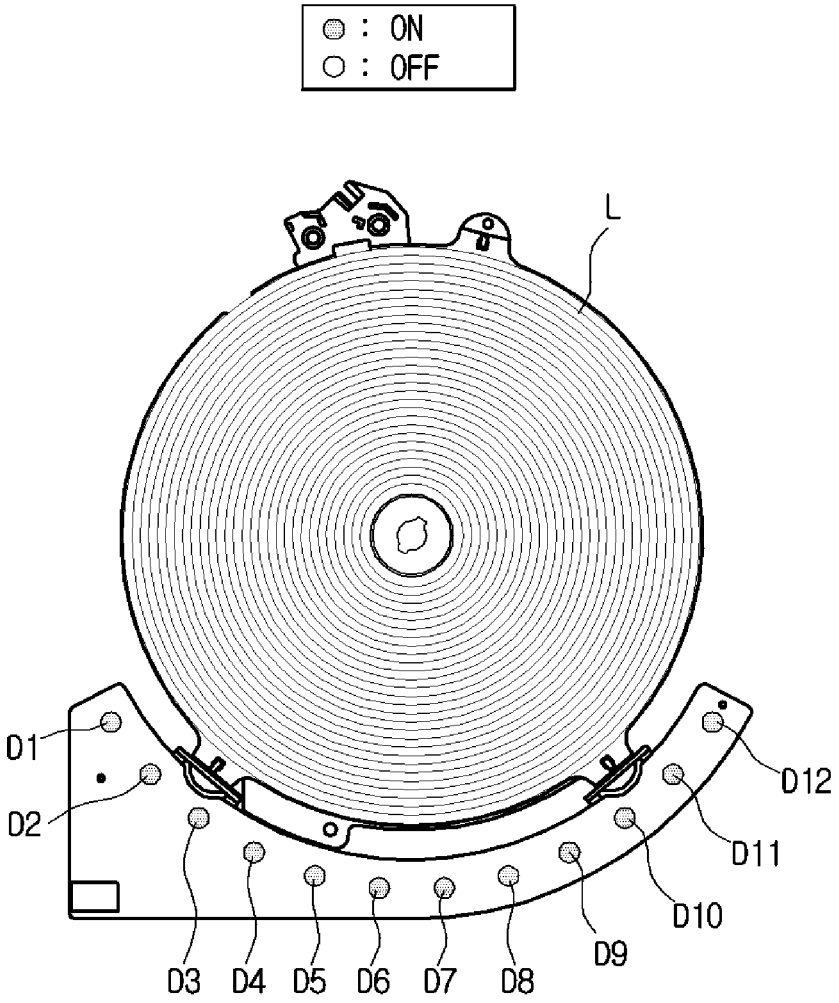
FIGS. 27A and 27B are views of an example of an operation of light sources arranged, as illustrated in FIG. 26.
Figure 27B:
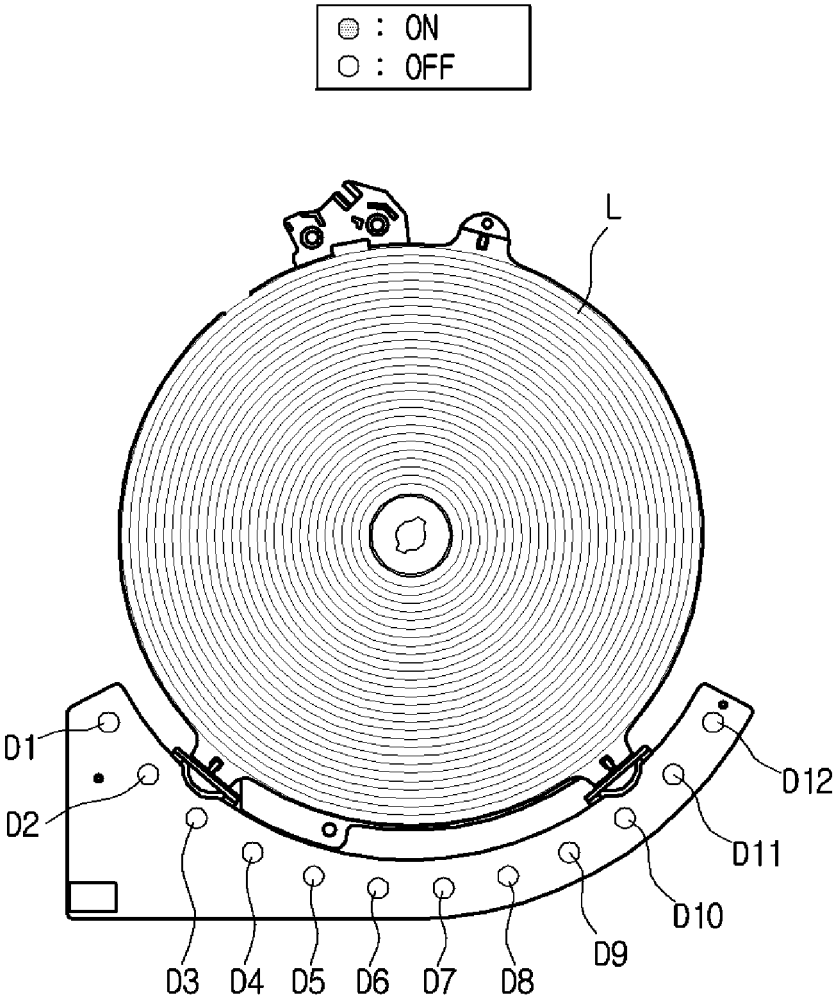
Figure 28A:
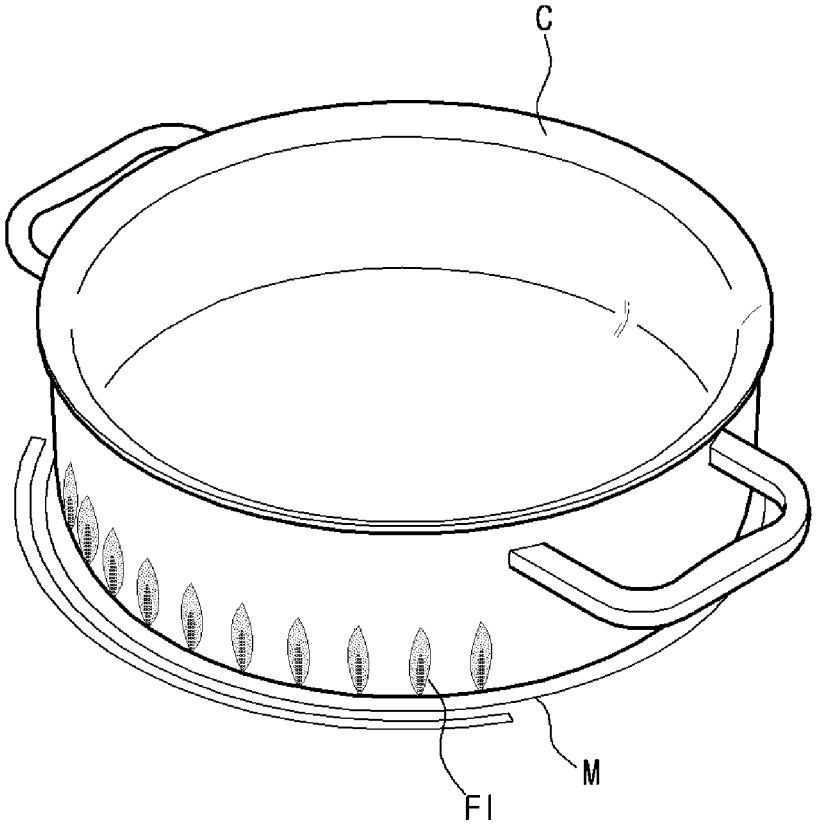
FIGS. 28A and 28B are views of movement of flame images formed by the light sources that operate, as illustrated in FIGS. 27A and 27B.
Figure 28B:
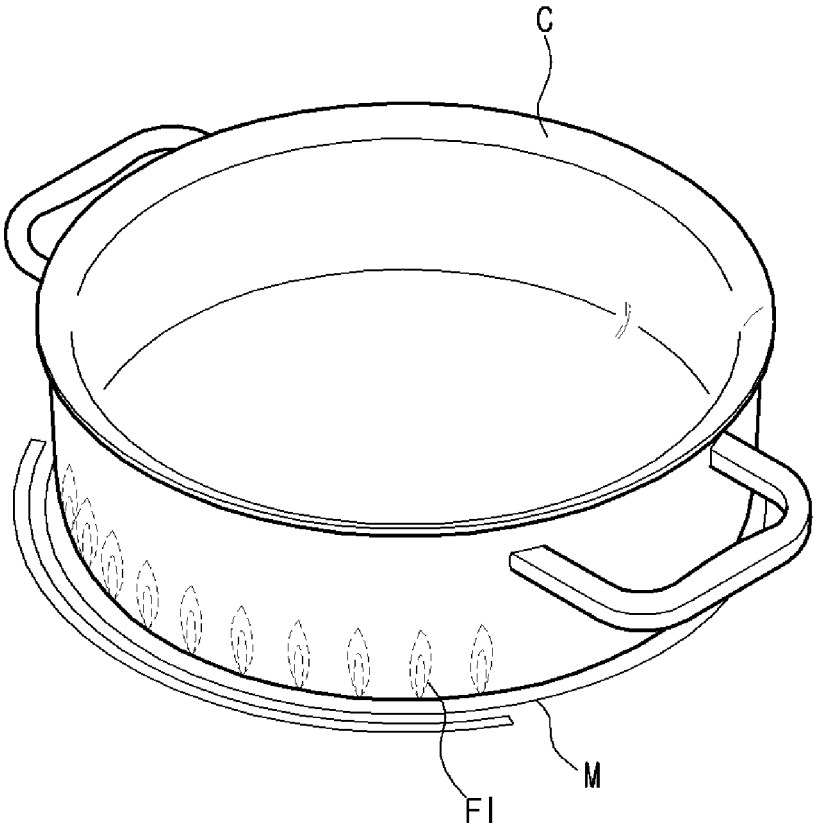

FIGS. 27A and 27B are views of an example of an operation of light sources arranged, as illustrated in FIG. 26, and FIGS. 28A and 28B are views of movement of flame images formed by the light sources that operate, as illustrated in FIGS. 27A and 27B.

The light-emitting controller 211 may control the light source driving circuit 213 so that the plurality of light sources D1 through D12 may be simultaneously turned on/off, as illustrated in FIGS. 27A and 27B.

In detail, the light-emitting controller 211 may turn on all of the switching units S1 through S6 for a first time and then may turn off all of the switching units S1 through S6 for a second time.

In this way, when the light-emitting controller 211 repeatedly turns on/off all of the switching units S1 through S6, the plurality of light sources D1 through D12 may repeatedly turn on/off all of the switching units S1 through S6, as illustrated in FIGS. 27A and 27B.

When the plurality of light sources D1 through D12 are simultaneously turned on/off, as illustrated in FIGS. 27A and 27B, flame images FI are formed, as illustrated in FIGS. 28A and 28B.

In detail, the flame images FI are formed for the first time depending on whether the plurality of light sources D1 through D12 are turned on/off, and subsequently, the flame images FI are not formed for the second time.

In other words, the cooking apparatus 1 may generate the flame images FI that flicker over time.

The cooking apparatus 1 may generate the flame images FI that overall flicker so that the user may inform that a cooking time set by the user has elapsed.

Also, the cooking apparatus 1 may change the first time at which the flame images FI are generated, and the second time at which the flame images FI are not generated. For example, the light-emitting controller 211 may gradually make the first time and the second time long or short.

For example, as the elapse of the cooking time set by the user approaches, the cooking apparatus 1 may generate flame images FI that flicker more quickly, by gradually making the first time and the second time short.

Also, the cooking apparatus 1 may generate the flame images FI that overall flicker and may generate the flame images FI, color of which changes overall.

For example, the cooking apparatus 1 may generate the red flame images FI for the first time and then, may generate the blue flame images FI for the second time.

In other words, the cooking apparatus 1 may alternately form the red flame images FI and the blue flame images FI.

In addition, the cooking apparatus 1 may switch between the first time at which the red flame images FI are generated, and the second time at which the blue flame images FI are generated.

As described above, the cooking apparatus 1 may generate the flame images FI that overall flicker and thus may deliver a warning message to the user.

Figure 29A:
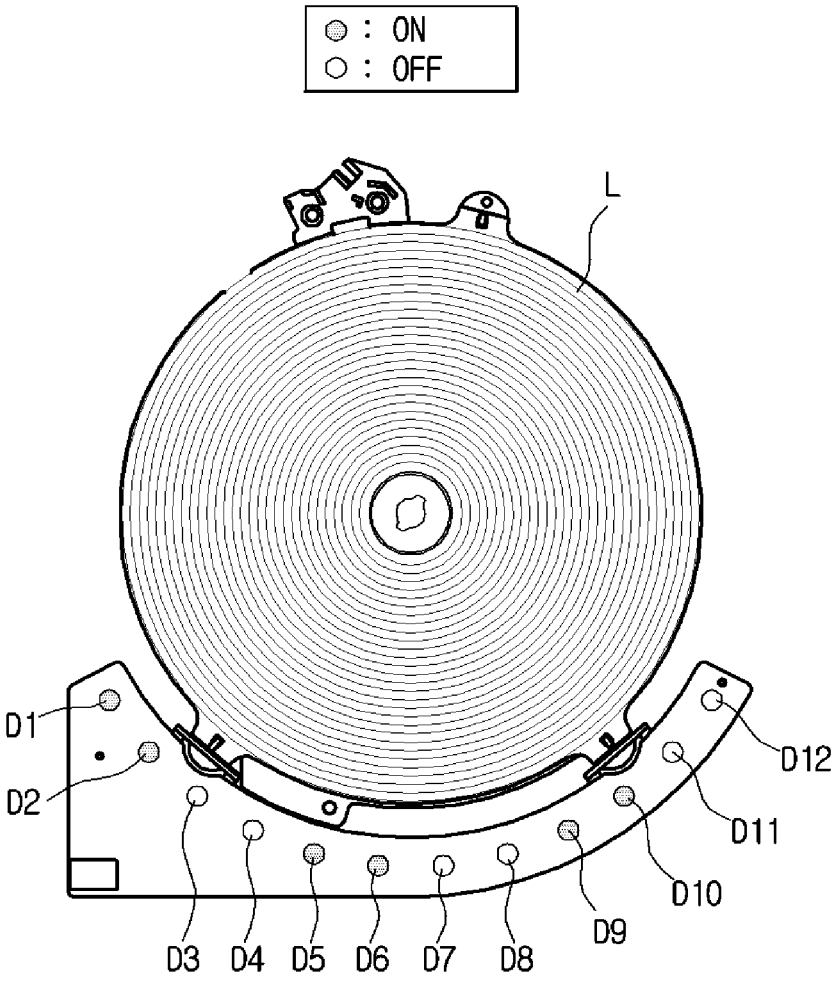
FIGS. 29A and 29B are views of another example of an operation of light sources arranged, as illustrated in FIG. 26.
Figure 29B:
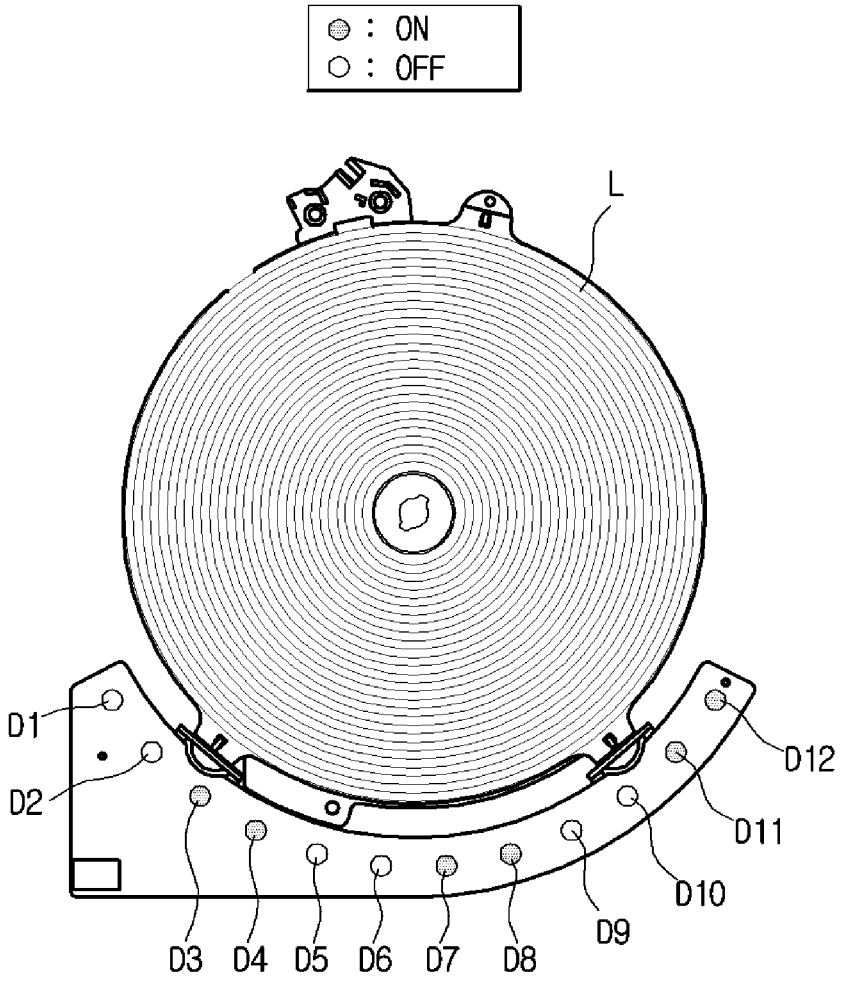
Figure 30A:
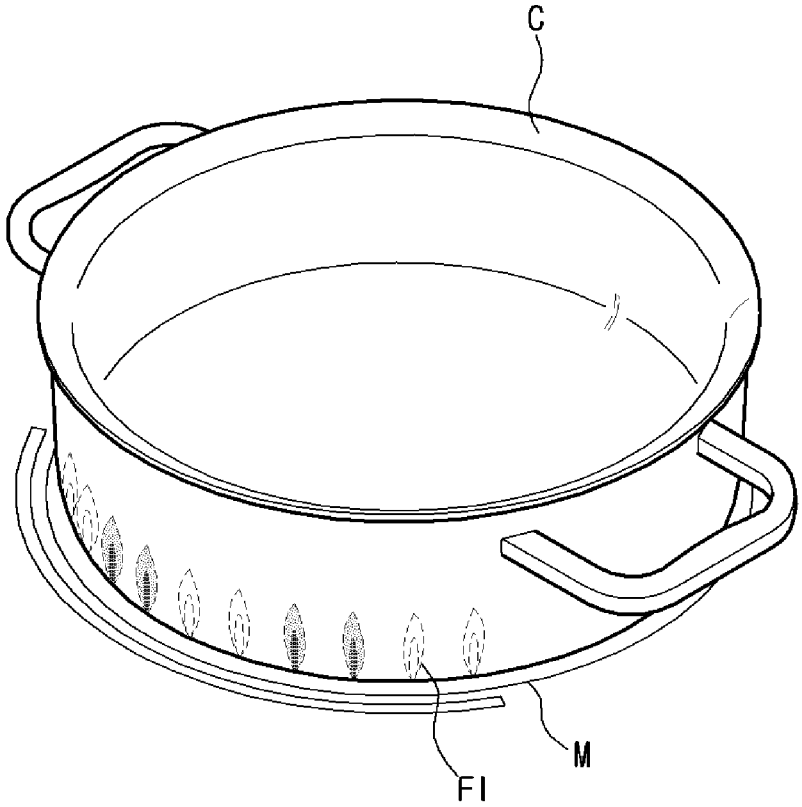
FIGS. 30A and 30B are views of movement of flame images formed by the light sources that operate, as illustrated in FIGS. 29A and 29B.
Figure 30B:
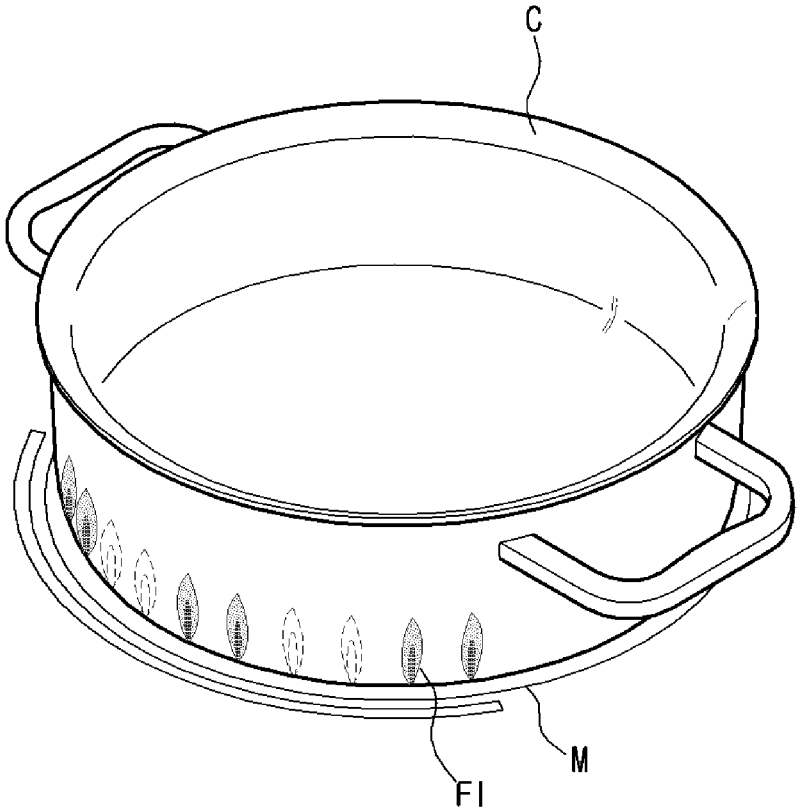

FIGS. 29A and 29B are views of another example of an operation of light sources arranged, as illustrated in FIG. 26, and FIGS. 30A and 30B are views of movement of flame images formed by the light sources that operate, as illustrated in FIGS. 29A and 29B.

The light-emitting controller 211 may control the light source driving circuit 213 so that light sources D1 and D2, D3 and D4, . . . , and D11 and D12 of one group may be simultaneously turned on/off and different adjacent light source groups (D1, D2), (D3, D4), . . . , and (D11, D12) may be turned on/off in the other way, as illustrated in FIGS. 29A and 29B.

In detail, the light-emitting controller 211 may turn on the first, third, and fifth switching units S1, S3, and S5 for the first time and may turn off the second, fourth, and sixth switching units S2, S4, and S6. Subsequently, the light-emitting controller 211 may turn off the first, third, and fifth switching units S1, S3, and S5 for the second time and may turn on the second, fourth, and sixth switching units S2, S4, and S6.

As a result, light sources D1 and D2, D3 and D4, . . . , and D11 and D12 of one group among the plurality of light sources D1 through D12 is simultaneously turned on/off, and adjacent light source groups (D1, D2), (D3, D4), . . . , and (D11, D12) are turned on/off opposite to each other, as illustrated in FIGS. 29A and 29B.

Also, when adjacent light source groups (D1, D2), (D3, D4), . . . , and (D11, D12) are turned on/off opposite of each other, flame images FI illustrated in FIG. 30 are formed.

In detail, the flame images FI that flicker alternately each pair are formed depending on whether the plurality of light sources D1 through D12 are turned on/off.

When malfunction of the cooking apparatus 1 is detected, the cooking apparatus 1 may generate the flame images FI that flicker alternately each pair so as to inform malfunction to the user.

Also, the cooking apparatus 1 may generate the flame images FI that flicker alternately each pair and may generate the flame images FI, of which color changes each pair.

For example, the light-emitting controller 211 may control the switching units S1 through S6 so that the first, second, fifth, sixth, ninth, and tenth light sources D1, D2, D5, D6, D9, D10 may output red light for the first time and the third, fourth, seventh, eighth, eleventh, and twelfth light sources D3, D4, D7, D8, D11, and D12 may output blue light. Subsequently, the light-emitting controller 211 may control the switching units S1 through S6 so that the first, second, fifth, sixth, ninth, and tenth light sources D1, D2, D5, D6, D9, and D10 may output blue light for the second time and the third, fourth, seventh, eighth, and twelfth light sources D3, D4, D7, D8, D11, and D12 may output red light.

Also, the cooking apparatus 1 may switch between the first time and the second time. For example, the light-emitting controller 211 may gradually make the first time and the second time long or short.

As described above, the cooking apparatus 1 may generate the flame images FI that flicker alternately and may deliver a warning message to the user by using the flame images FI that flicker alternately.

The cooking apparatus 1 may control formation of the flames images FI over time and may change brightness and sizes of the flame images FI over time.

Figure 31A:
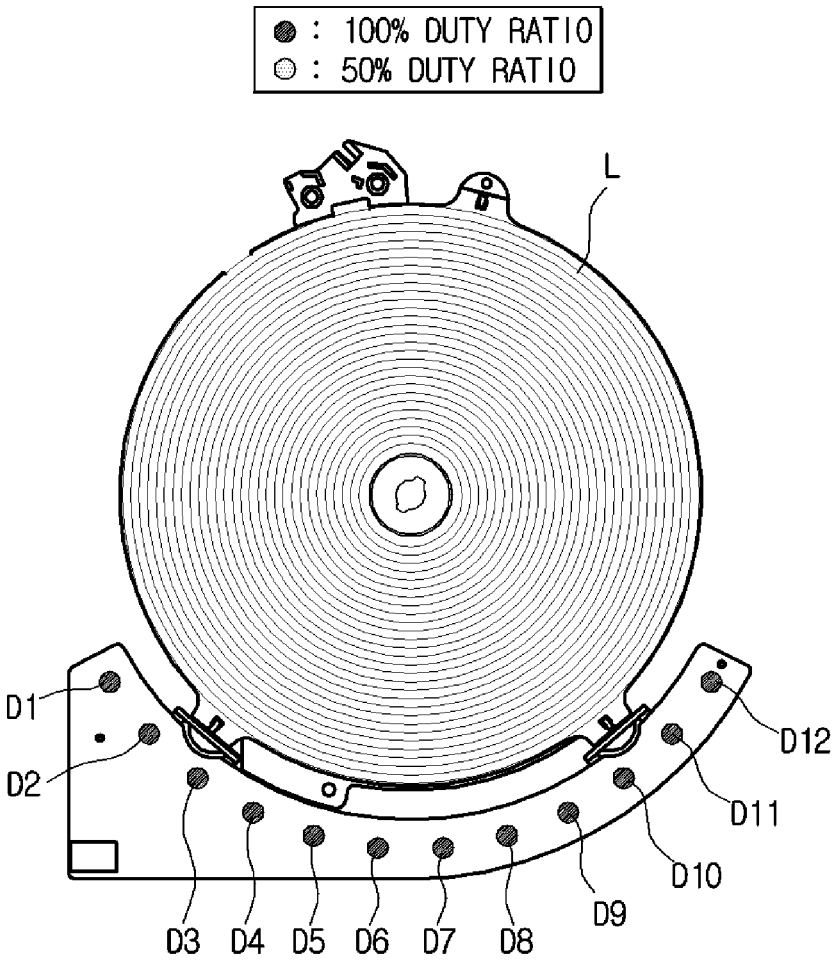
FIGS. 31A and 31B are views of still another example of an operation of light sources arranged, as illustrated in FIG. 26.
Figure 31B:
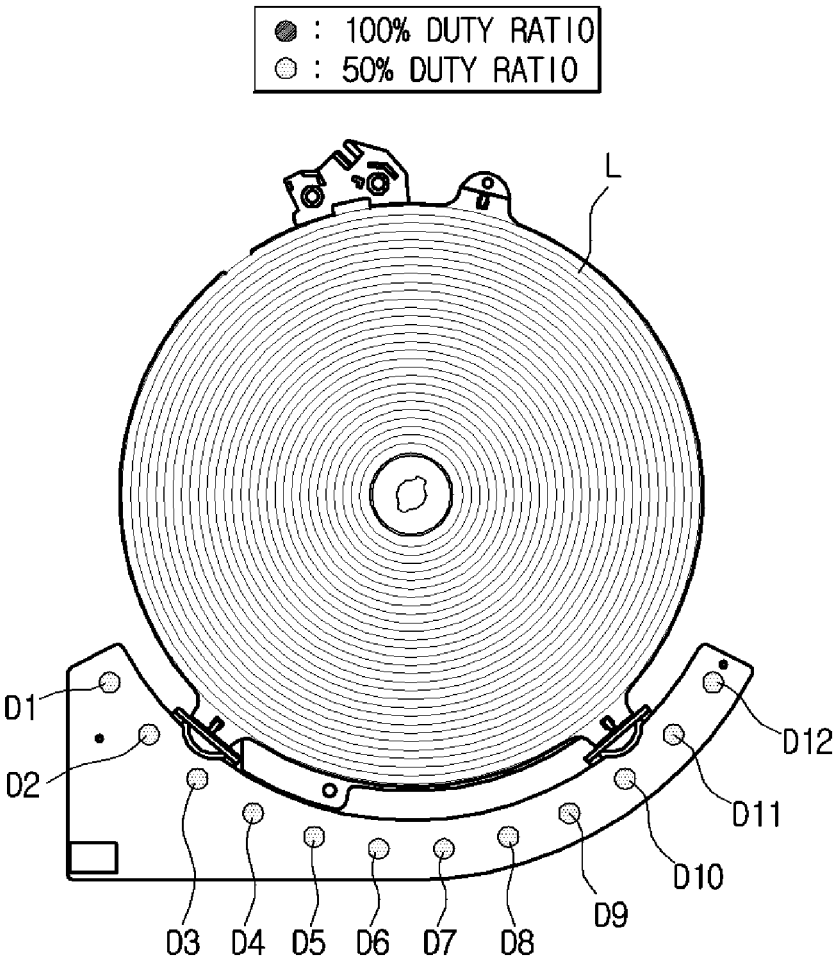
Figure 32A:
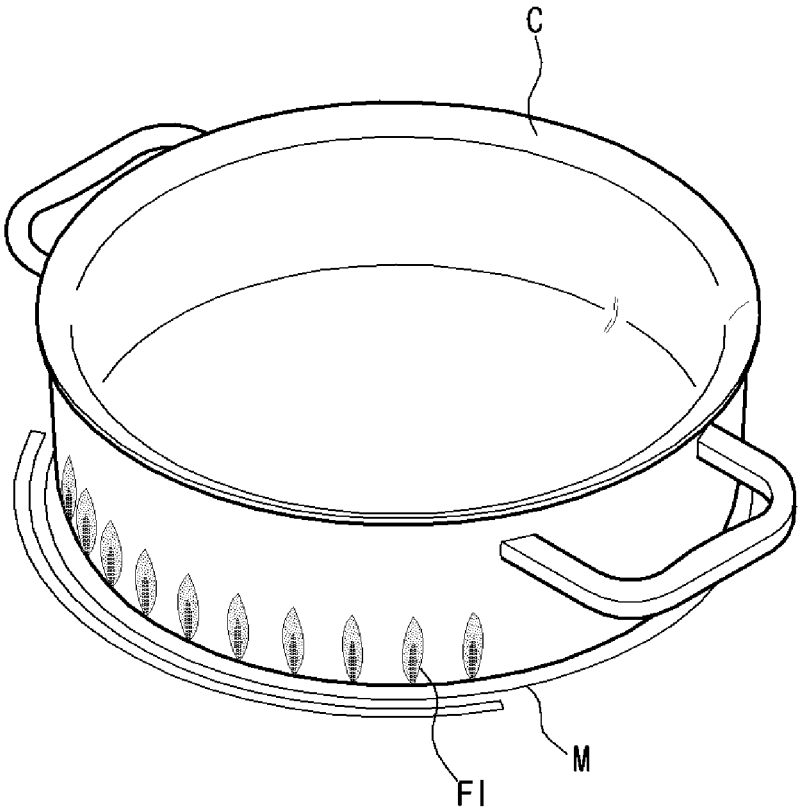
FIGS. 32A and 32B are views of movement of flame images formed by the light sources that operate, as illustrated in FIGS. 31A and 31B.
Figure 32B:
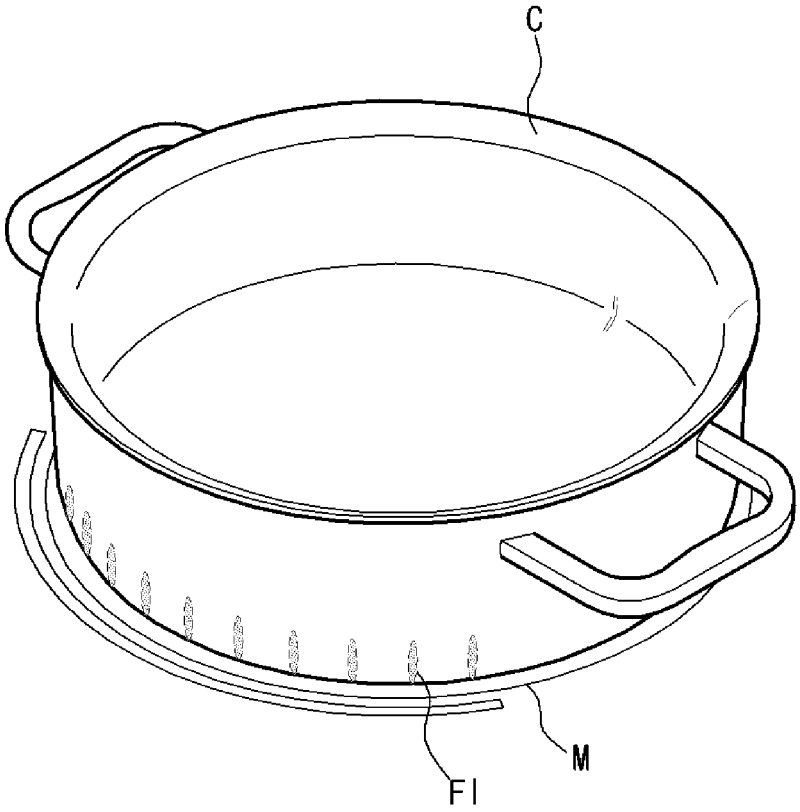

FIGS. 31A and 31B are views of still another example of an operation of light sources arranged, as illustrated in FIG. 26, and FIGS. 32A and 32B are views of movement of flame images formed by the light sources that operate, as illustrated in FIGS. 31A and 31B.

The light-emitting controller 211 may control the light source driving circuit 213 so as to change the intensities of light output by all of the plurality of light sources D1 through D12, as illustrated in FIGS. 31A and 31B.

In detail, the light-emitting controller 211 may turn on/off the switching units S1 through S6 so that duty ratios of a turning-on time of all of the switching units S1 through S6 may be 100% for the first time and then the duty ratios of the turning-on time of all of the switching units S1 through S6 may be 50% for the second time.

In this way, when the light-emitting controller 211 changes the turning-on time duty ratios of the switching units S1 through S6, the intensities of light output by the plurality of light sources D1 through D12 changes with a predetermined period, as illustrated in FIGS. 31A and 31B.

When the intensities of light output by the plurality of light sources D1 through D12 change, as illustrated in FIGS. 31A and 31B, flame images FI illustrated in FIGS. 32A and 32B are formed.

In detail, the flame images FI having maximum brightness and maximum sizes are formed for the first time, and the flame images FI having half of brightness and half of a size are formed for the second time.

In other words, the cooking apparatus 1 may generate the flame images FI, brightness and sizes of which change over time.

The cooking apparatus 1 may change brightness and sizes of all flame images FI so as to display the user that the cooking apparatus 1 is normally in operation.

In other words, the cooking apparatus 1 changes brightness and sizes of the flame images FI and may form the flame images FI that move like flames flickering similar to while a gas cooking apparatus (gas range) using gas is in operation.

Also, the cooking apparatus 1 may change the first time at which the flame images FI having maximum brightness and a maximum size are generated, and the second time at which the flame images FI having half of brightness and half of a size are generated. For example, the light-emitting controller 211 may gradually make the first time and the second time long or short.

For example, as the elapse of the cooking time set by the user approaches, the cooking apparatus 1 may cause the flame images FI to move gradually quickly, by gradually making the first time and the second time short.

Figure 33A:
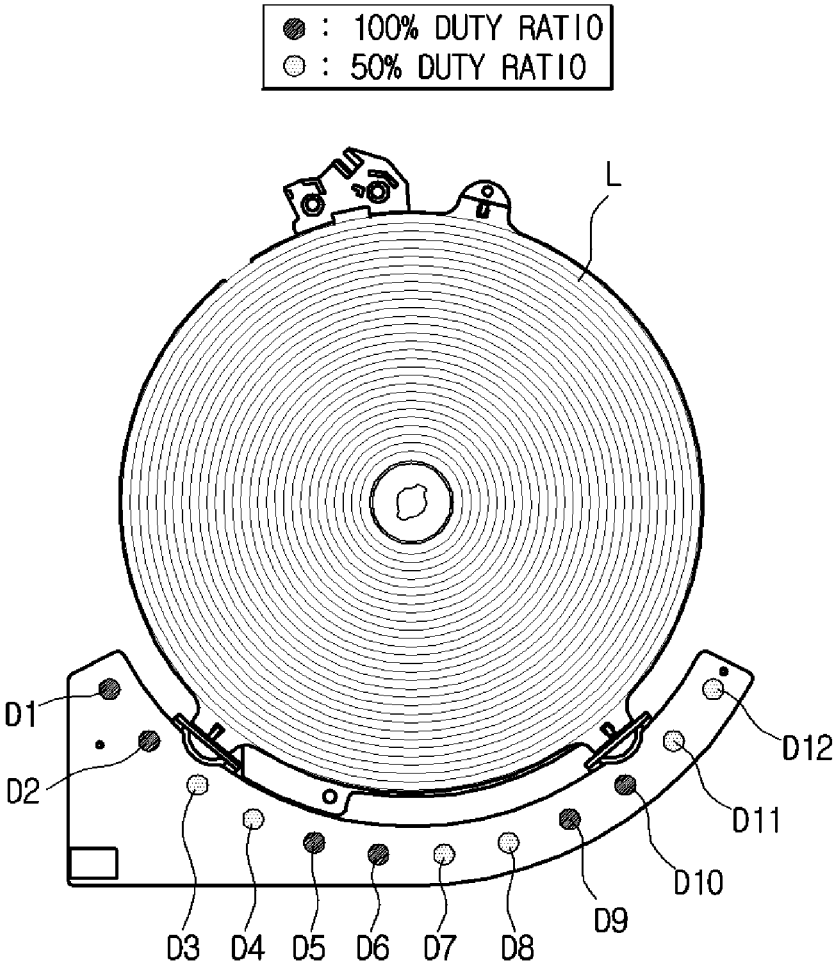
FIGS. 33A and 33B are views of still another example of an operation of light sources arranged, as illustrated in FIG. 26.
Figure 33B:
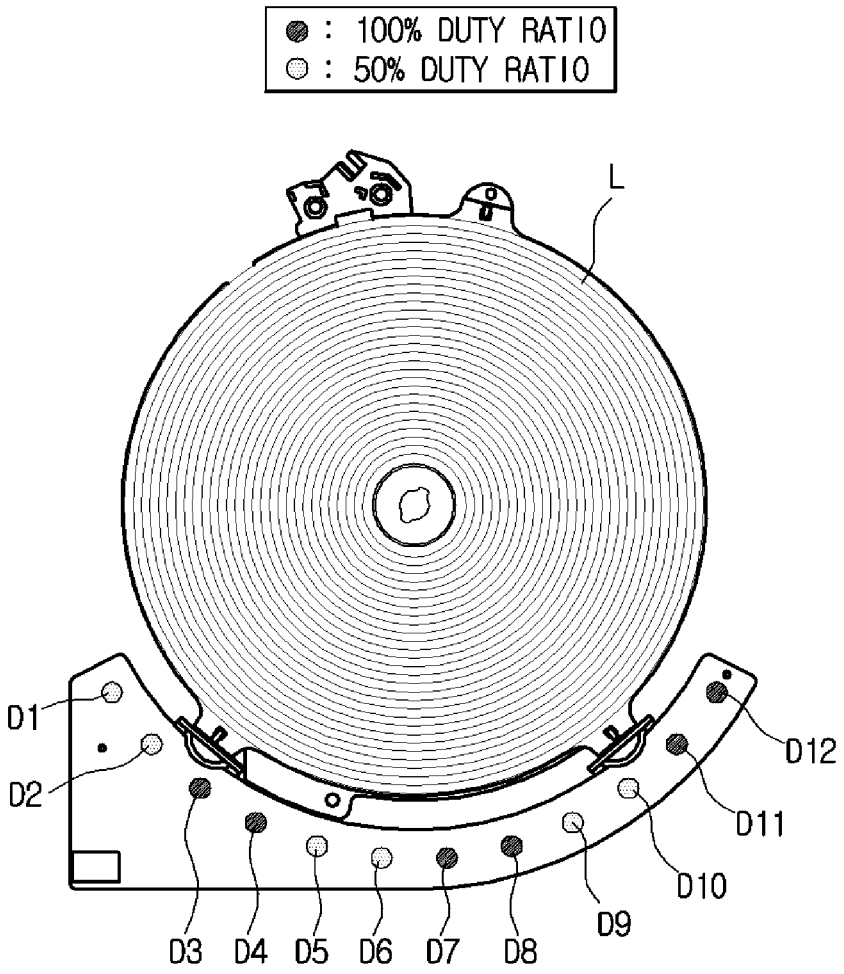
Figure 34A:
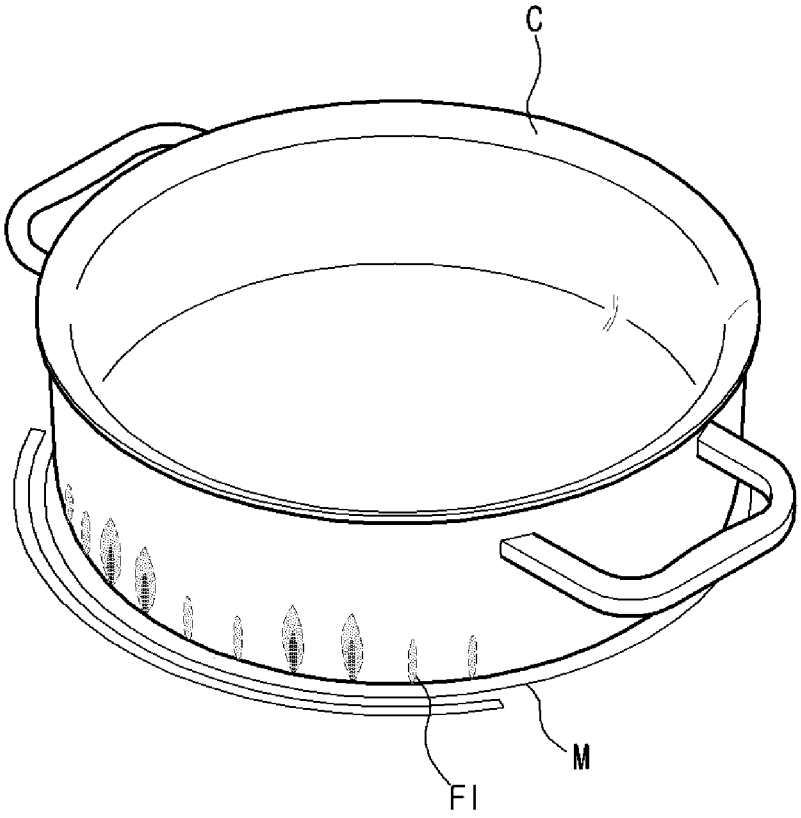
FIGS. 34A and 34B are views of movement of flame images formed by the light sources that operate, as illustrated in FIGS. 33A and 33B.
Figure 34B:
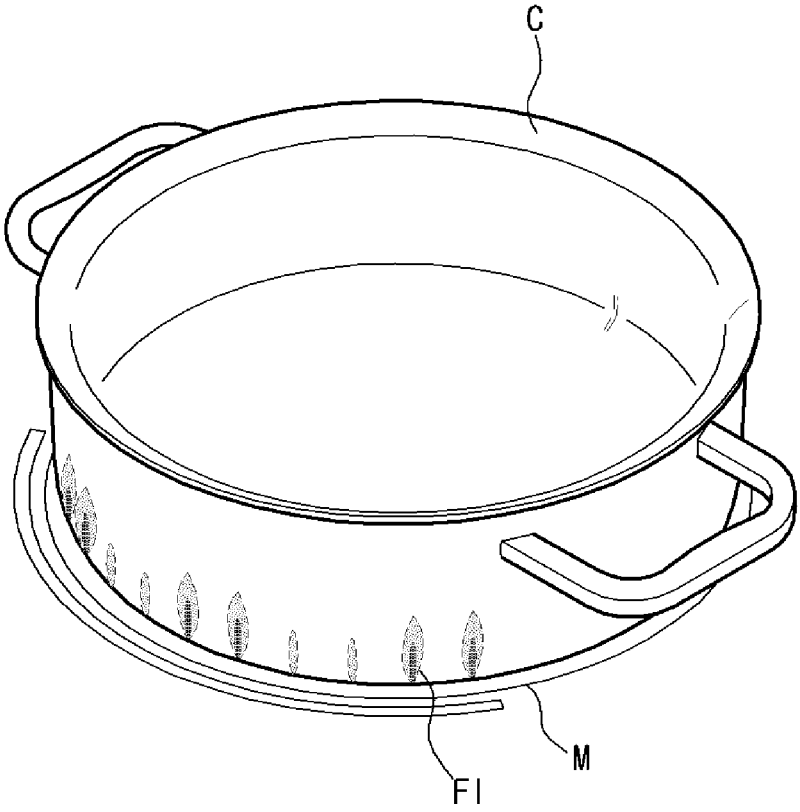

FIGS. 33A and 33B are views of still another example of an operation of light sources arranged, as illustrated in FIG. 26, and FIGS. 34A and 34B are views of movement of flame images formed by the light sources that operate, as illustrated in FIGS. 33A and 33B.

As illustrated in FIGS. 33A and 33B, the light-emitting controller 211 may control the light source driving circuit 213 so as to simultaneously change intensities of light output by light sources D1 and D2, D3 and D4, . . . , and D11 and D12 adjacent to each other of one group.

In detail, the light-emitting controller 211 may turn on/off the switching units S1 through S6 so that the duty ratios of the turning-on time of the first, third, and fifth switching units S1, S3, and S5 may be 100% for the first time and the duty ratios of the turning-on time of the second, fourth, and sixth switching units S2, S4, and S6 may be 50% for the second time. Subsequently, the light-emitting controller 211 may turn on/off the switching units S1 through S6 so that the duty ratios of the turning-on time of the first, third, and fifth switching units S1, S2, and S3 may be 50% for the first time and the duty ratios of the turning-on time of the second, fourth, and sixth switching units S2, S4, and S6 may be 100% for the second time.

As a result, among the plurality of light sources D1 through D12, light sources D1 and D2, D3 and D4, . . . , and D11 and D12 adjacent to each other of one group may output light having the same intensity and different adjacent light source groups (D1, D2), (D3, D4), . . . , and (D11, D12) may output light having different intensities, as illustrated in FIGS. 33A and 33B.

Also, when light sources D1 and D2, D3 and D4, . . . , and D11 and D12 adjacent to each other of one group output light having the same intensity and light sources D1 and D2, D3 and D4, . . . , and D11 and D12 of one group output light having different intensities, the flame images FI are formed, as illustrated in FIGS. 34A and 34B.

In detail, brightness and sizes of one group of the flame images FI may change depending on whether the plurality of light sources D1 through D12 are turned on/off.

The cooking apparatus 1 may change brightness and sizes of the flame images FI by one group so as to display the user that the cooking apparatus 1 is normally in operation, to the user.

In other words, the cooking apparatus 1 changes brightness and sizes of the flame images FI, thereby forming the flame images FI that move like flames flickering similar to when a gas cooking apparatus (gas range) using gas is in operation.

In addition, the cooking apparatus 1 may change the first time and the second time. For example, the light-emitting controller 211 may gradually make the first time and the second time short or long.

As described above, a case where light sources D1 and D2, D3 and D4, . . . , and D11 and D12 connected to each other in series of one group has been described.

Hereinafter, a case where light source groups D1 and D2, D3 and D4, . . . , and D11 and D12 connected to each other in series are disposed spaced a predetermined distance from each other.

Figure 35:
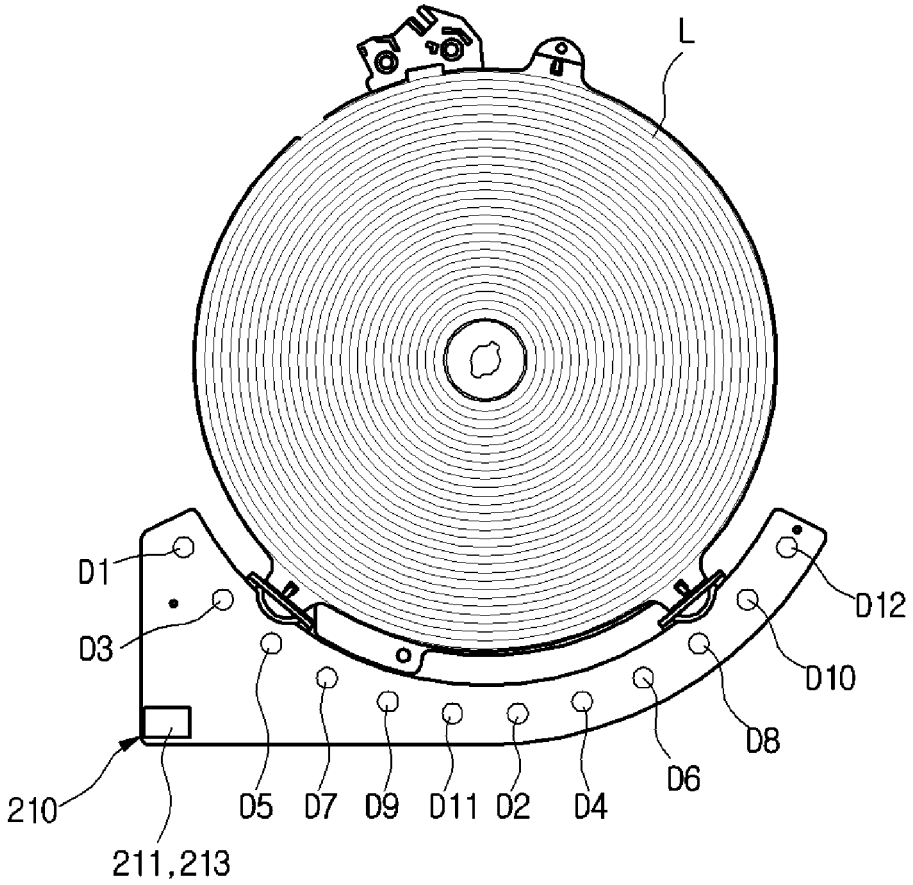
FIG. 35 is a view of another example of the order of arrangement of light sources included in the cooking apparatus in accordance with an embodiment of the present invention.

FIG. 35 is a view of another example of the order of arrangement of light sources included in the cooking apparatus in accordance with an embodiment of the present invention.

Light sources D1 and D2, D3 and D4, . . . , and D11 and D12 electrically connected to each other in series of one group among the plurality of light sources D1 through D12 may be disposed not to be adjacent to each other.

For example, the plurality of light sources D1 through D12 may be disposed in the order of the first light source D1, the third light source D3, . . . , the eleventh light source D11, the second light source D2, the fourth light source D4, . . . , and the twelfth light source D12, as illustrated in FIG. 35.

Also, as described above, light sources D1 and D2, D3 and D4, . . . , and D11 and D12 connected to each other in series of one group may be simultaneously turned on/off, and each of the light source groups (D1, D2), (D3, D4), . . . , and (D11, D12) may be independently turned on/off.

Hereinafter, movement of the flame images when it is assumed that the plurality of light sources D1 through D12 are disposed, as illustrated in FIG. 35, will be described.

Even when the plurality of light sources D1 through D12 are disposed, as illustrated in FIG. 35, the light-emitting controller 211 may control the light source driving circuit 213 so that the plurality of light sources D1 through D12 may be simultaneously turned on/off.

An operation in which the plurality of light sources D1 through D12 are simultaneously turned on/off, has been described above and thus, a description thereof will be omitted.

Figure 36A:
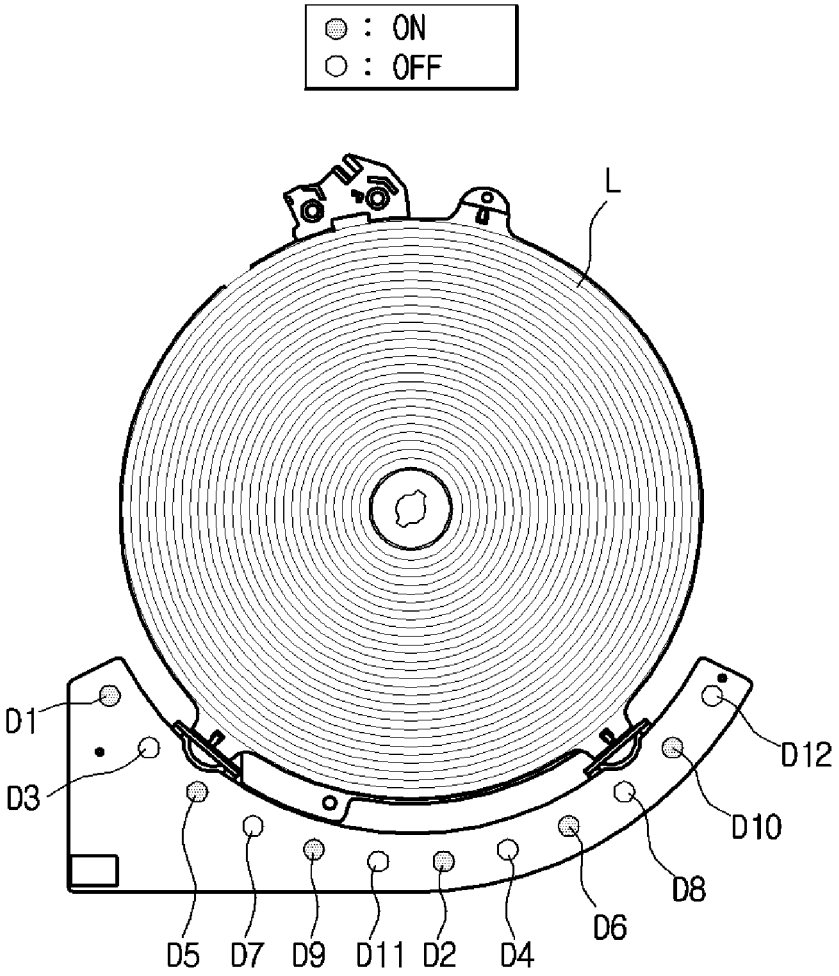
FIGS. 36A and 36B are views of an example of an operation of light sources arranged, as illustrated in FIG. 35.
Figure 36B:
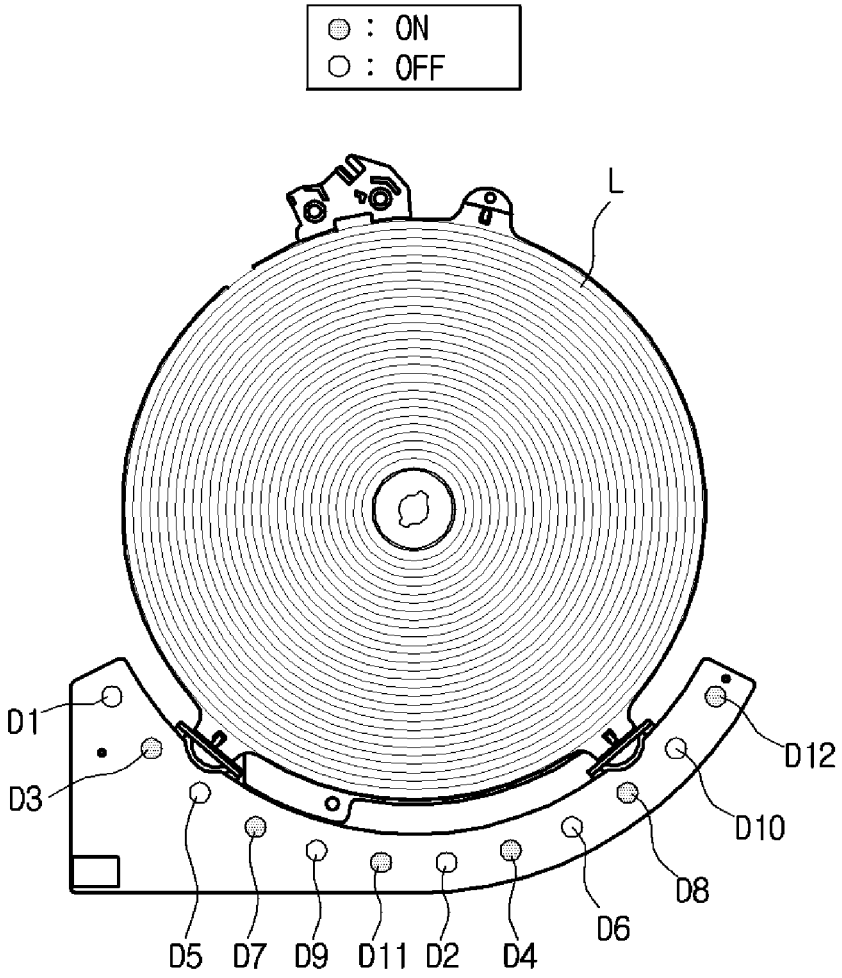
Figure 37A:
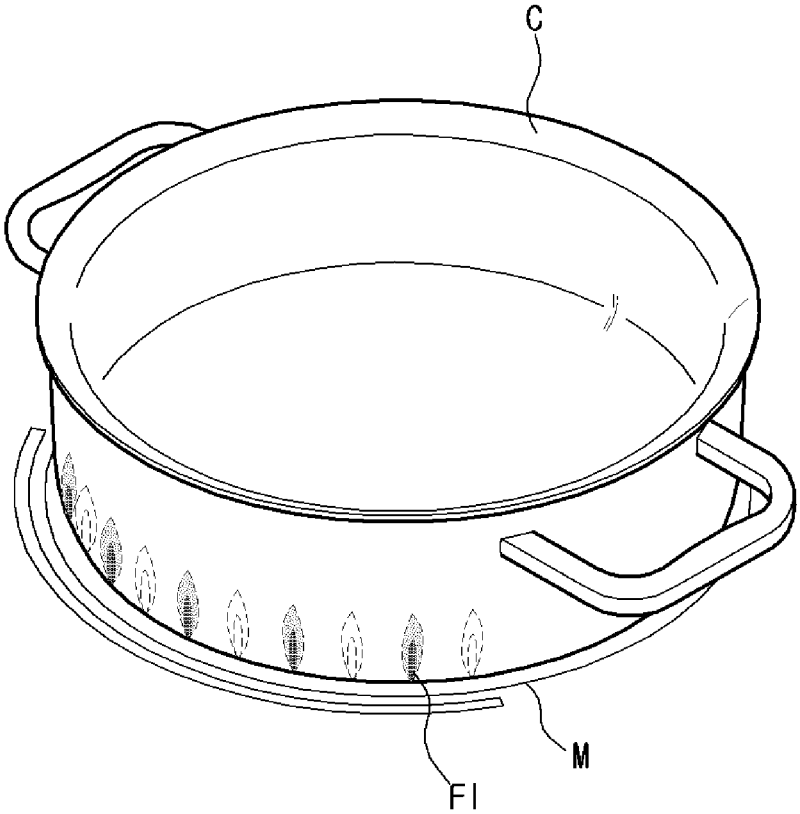
FIGS. 37A and 37B are views of movement of flame images formed by the light sources that operate, as illustrated in FIGS. 36A and 36B.
Figure 37B:
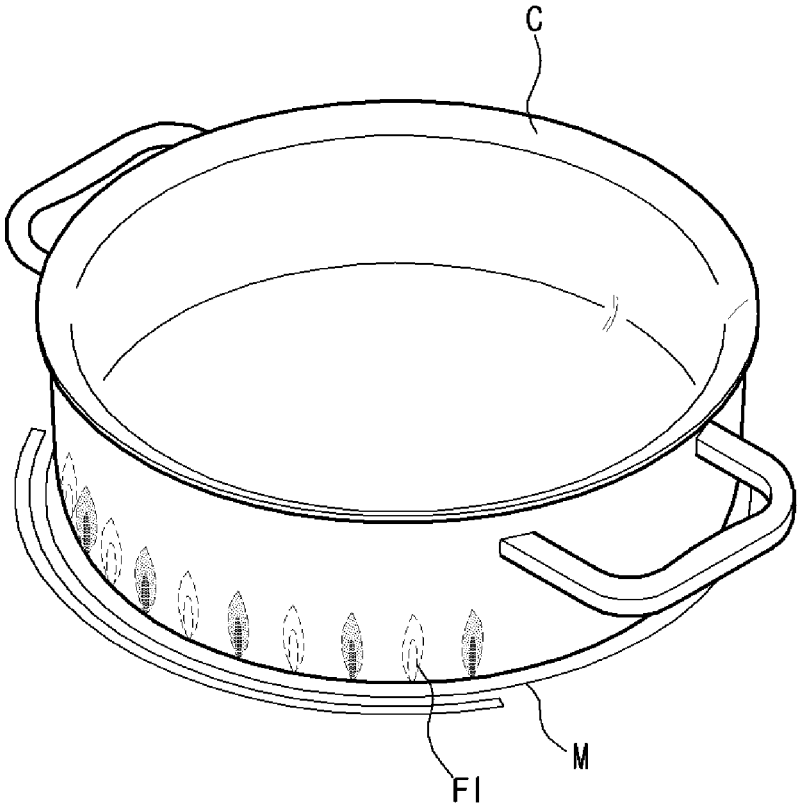

FIGS. 36A and 36B are views of an example of an operation of light sources arranged, as illustrated in FIG. 35, and FIGS. 37A and 37B are views of movement of flame images formed by the light sources that operate, as illustrated in FIGS. 36A and 36B.

As illustrated in FIGS. 36A and 36B, the light-emitting controller 211 may control the light source driving circuit 213 so that each of the adjacent light sources D1, D2, D3, . . . , and D12 may be alternately turned on/off.

In detail, the light-emitting controller 211 may turn on the first, third, and fifth switching units S1, S3, and S5 for the first time and may turn off the second, fourth, and sixth switching units S2, S4, and S6. Subsequently, the light-emitting controller 211 may turn off the first, third, and fifth switching units S1, S3, and S5 for the second time and may turn on the second, fourth, and sixth switching units S2, S4, and S6.

The controlling operation of the light-emitting controller 211 is the same as the controlling operation of the light-emitting controller 211 described in FIGS. 29A and 29B. However, due to a difference in the arrangement order of the plurality of light sources D1 through D12, in FIGS. 29A and 29B, the adjacent light source groups (D1, D2), (D3, D4), . . . , and (D11, D12) are alternately turned on/off, whereas, in FIGS. 36A and 36B, the adjacent light sources D1, D2, D3, . . . , and D12 are alternately turned on/off.

Also, when the plurality of light sources D1 through D12 are alternately turned on/off, as illustrated in FIGS. 36A and 36B, flame images FI are formed illustrated in FIGS. 37A and 37B.

In detail, the flame images FI that flicker respectively depending on whether the plurality of light sources D1 through D12 are turned on/off, are formed.

When malfunction of the cooking apparatus 1 is detected, the cooking apparatus 1 may generate the flame images that flicker respectively, so as to inform malfunction to the user.

The cooking apparatus 1 may generate the flame images FI that flicker respectively and may generate the flame images FI, a color of which changes.

In addition, the cooking apparatus 1 may change the first time and the second time. For example, the light-emitting controller 211 may gradually make the first time and the second time short or long.

Even when the light sources D1 through D12 are disposed, as illustrated in FIG. 35, the light-emitting controller 211 may control the light source driving circuit 213 so as to simultaneously change intensities of light output by the plurality of light sources D1 through D12.

The operation in which the intensities of light output by the plurality of light sources D1 through D12 are simultaneously changed, has been described. Thus, a description thereof will be omitted.

Figure 38A:
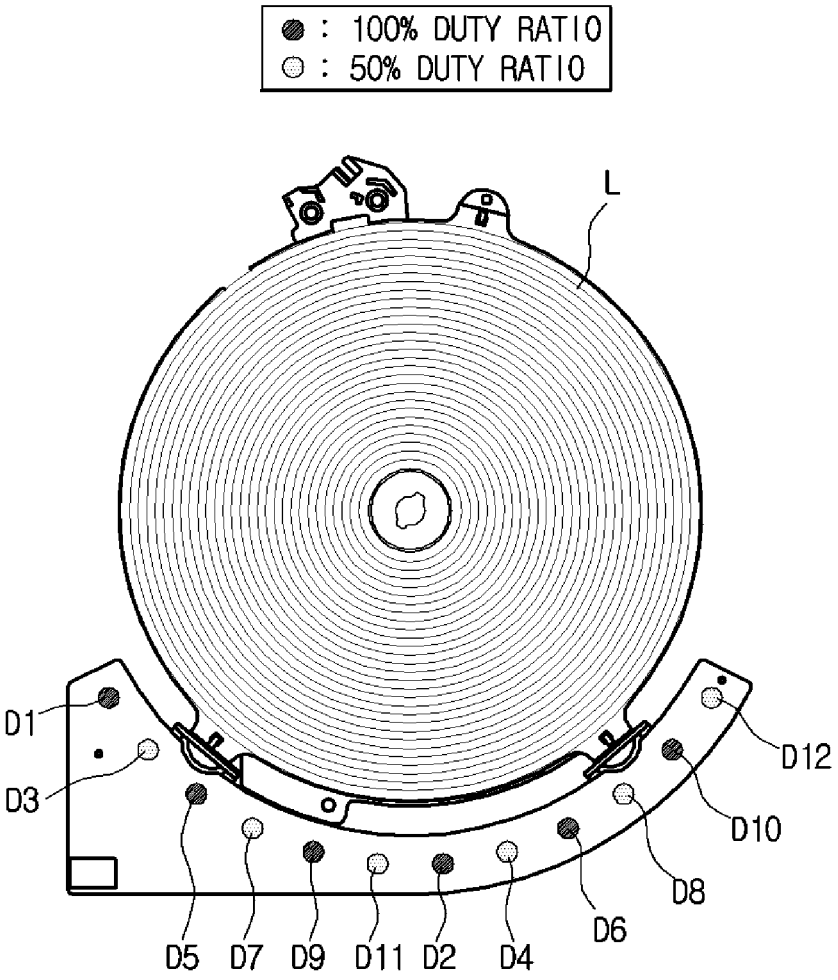
FIGS. 38A and 38B are views of another example of an operation of light sources arranged, as illustrated in FIG. 35.
Figure 38B:
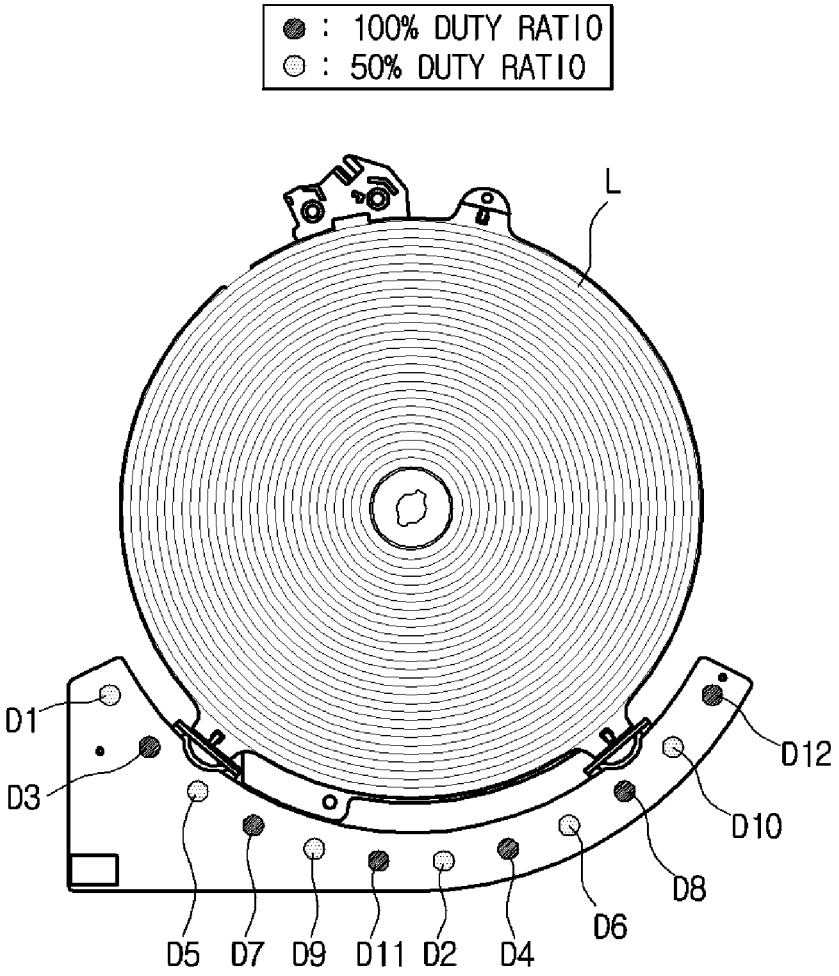
Figure 39A:
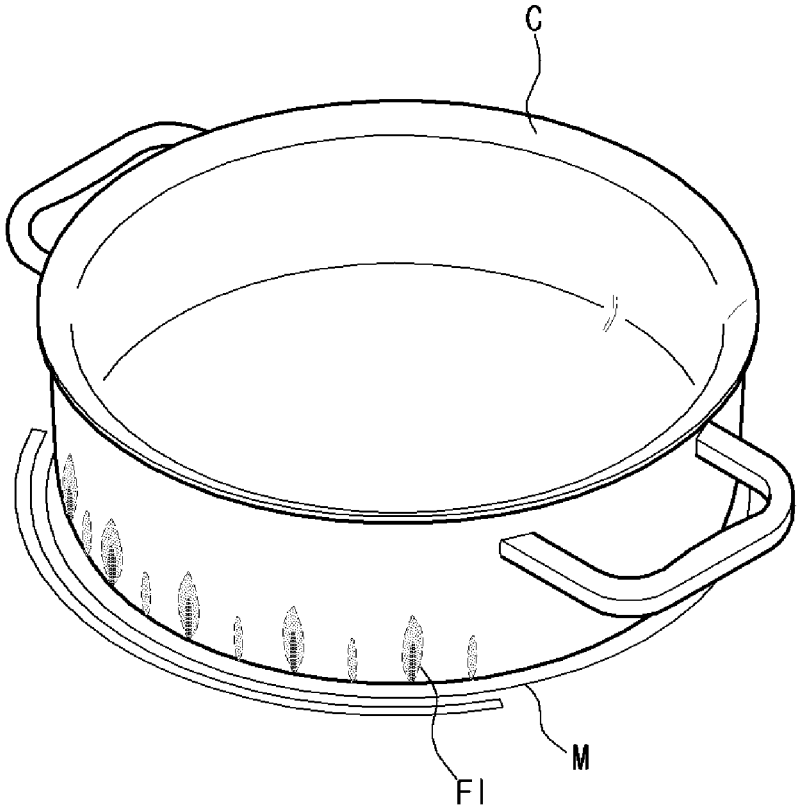
FIGS. 39A and 39B are views of movement of flame images formed by the light sources that operate, as illustrated in FIGS. 38A and 38B.
Figure 39B:
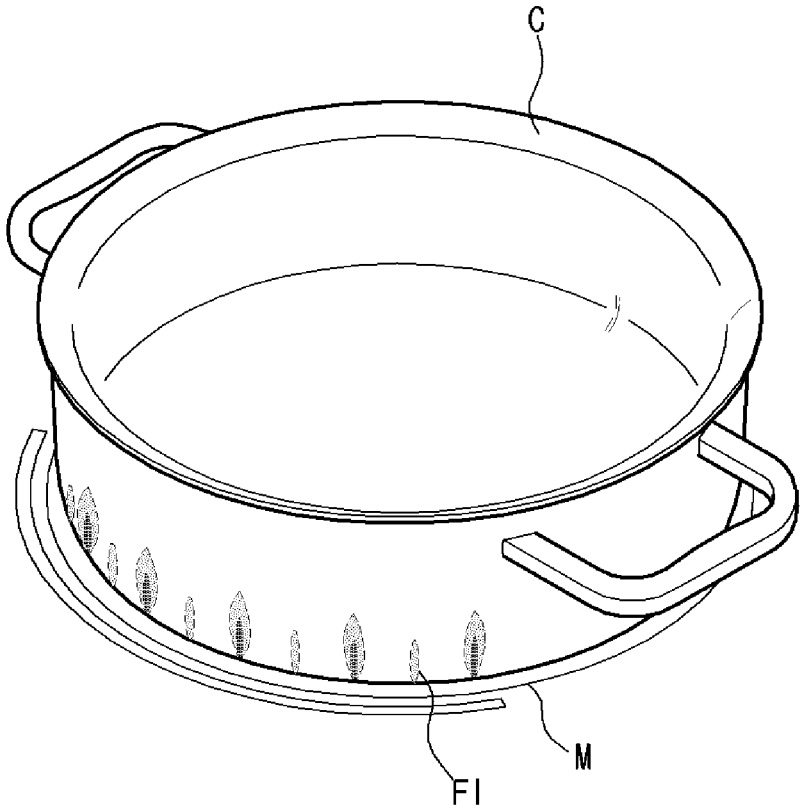

FIGS. 38A and 38B are views of another example of an operation of light sources arranged, as illustrated in FIG. 35, and FIGS. 39A and 39B are views of movement of flame images formed by the light sources that operate, as illustrated in FIGS. 38A and 38B.

As illustrated in FIGS. 38A and 38B, the light-emitting controller 211 may control the light source driving circuit 213 so as to alternately change the intensities of light output by the adjacent light sources D1, D2, D3, . . . , and D12.

In detail, the light-emitting controller 211 may control the switching units S1 through S6 so that the duty ratios of the turning-on time of the first, third, and fifth switching units S1, S3, and S5 may be 100% for the first time and the duty ratios of the turning-on of the second, fourth, and sixth switching units S2, S4, and S6 may be 50% for the second time. Subsequently, the light-emitting controller 211 may control the switching units S1 through S6 so that the duty ratios of the turning-on time of the first, third, and fifth switching units S1, S3, and S5 may be 50% for the first time and the duty ratios of the turning-on time of the second, fourth, and sixth switching units S2, S4, and S6 may be 100% for the second time.

The controlling operation of the light-emitting controller 211 is the same as the controlling operation of the light-emitting controller 211 described in FIGS. 31A and 31B. However, due to the difference in the arrangement order of the plurality of light sources D1 through D12, in FIGS. 31A and 31B, the adjacent light source groups (D1, D2), (D3, D4), . . . , and (D11, D12) output light having the same intensity, whereas, in FIGS. 38A and 38B, the adjacent light source groups D1, D2, D3, . . . , and D12 output light having different intensities.

Also, when the plurality of light sources D1 through D12 output light having different intensities, as illustrated in FIGS. 38A and 38B, flame images FI illustrated in FIGS. 39A and 39B are formed.

In detail, brightness and sizes of the flame images alternately change depending on whether the plurality of light sources D1 through D12 are turned on/off.

The cooking apparatus 1 may change brightness and a size of each of the flame images FI so as to display the user that the cooking apparatus 1 is normally in operation.

In other words, the cooking apparatus 1 changes brightness and sizes of the flame images FI, thereby forming the flame images FI that move like flames flickering similar to when a gas cooking apparatus (gas range) using gas is in operation.

In addition, the cooking apparatus 1 may switch between the first time and the second time. For example, the light-emitting controller 211 may gradually make the first time and the second time short or long.

As described above, the operation of the cooking apparatus 1 has been described based on the light-emitting module 210 in which light sources D1 and D2, D3 and D4, D5 and D6, . . . , and D11 and D12 of one group among the plurality of light sources D1 through D12 are connected to each other in series and adjacent light source groups (D1, D2), (D3, D4), . . . , and (D11, D12) are connected to each other in parallel.

However, embodiments of the present invention are not limited to the case where the plurality of light sources D1 through D12 are connected to each other in series by each group.

Figure 40:
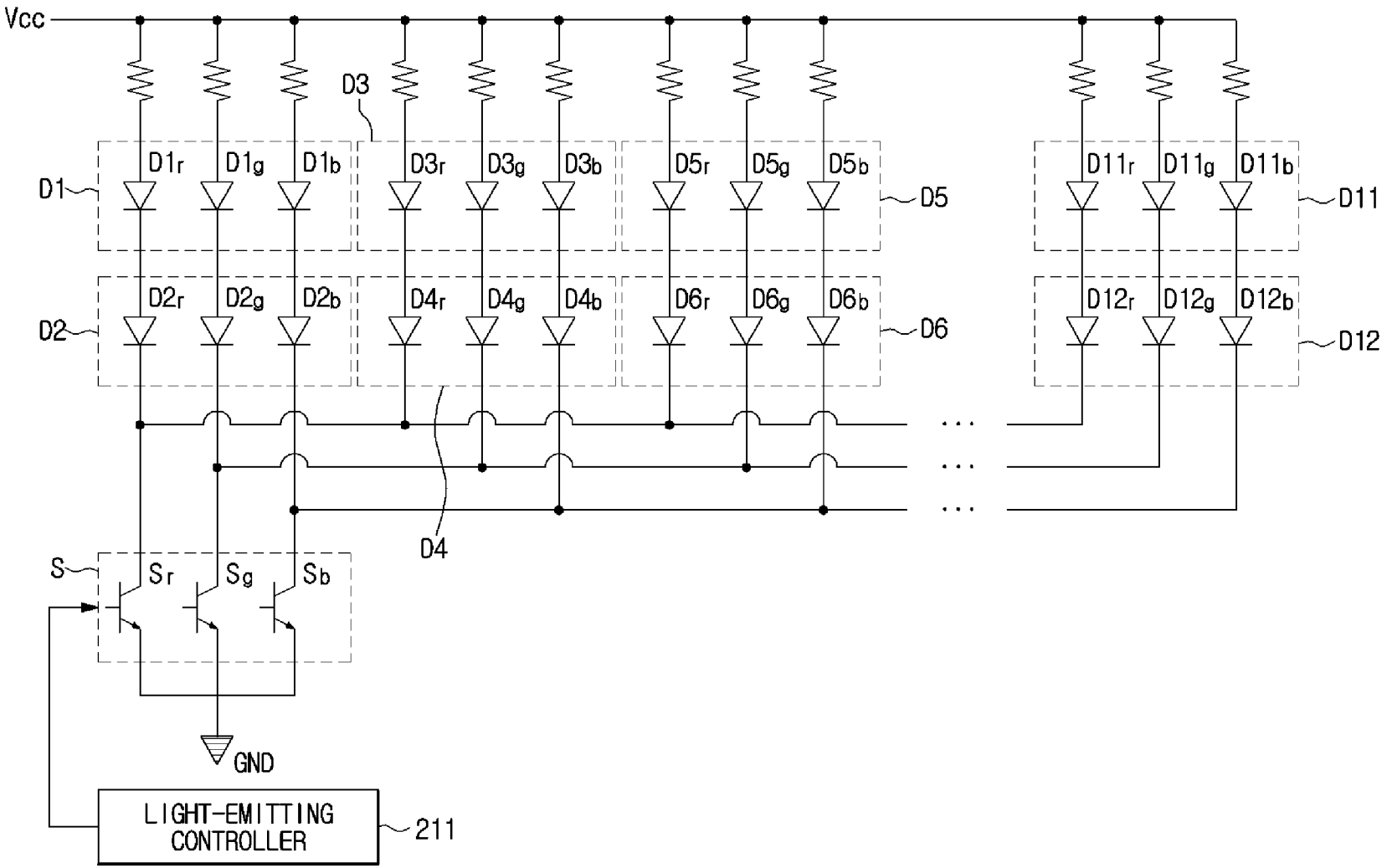
FIGS. 40 through 43 are views of another example of a circuit for implementing a light-emitting module included in the cooking apparatus in accordance with an embodiment of the present invention.

FIG. 40 is a view of another example of a circuit for implementing a light-emitting module included in the cooking apparatus in accordance with an embodiment of the present invention.

Referring to FIG. 40, the light-emitting module 210 includes a plurality of light sources D1 through D12 that output light, a switching unit S that controls driving currents supplied to the plurality of light sources D1 through D12, a plurality of resistive units R1 through R6 that limit sizes of the driving currents supplied to the light sources D1 through D12, and a light-emitting controller 211 that controls turning on/off of the switching unit S1.

Comparing the circuit configuration of the light-emitting module 210 illustrated in FIG. 40 with that of the light-emitting module 210 illustrated in FIG. 21, in terms of the arrangement of the plurality of light sources D1 through D12, the circuit configuration of the light-emitting module 210 illustrated in FIG. 40 is similar to that of the light-emitting module 210 illustrated in FIG. 21.

However, compared to the light-emitting module 210 illustrated in FIG. 21 includes six switching units S1 through S6 that control six light source groups (D1, D2), (D3, D4), . . . , and (D11, D12), the light-emitting module 210 illustrated in FIG. 40 controls six light source groups (D1, D2), (D3, D4), . . . , and (D11, D12) by using a single switching unit S1.

As a result, in the light-emitting module 210 illustrated in FIG. 40, all of six light source groups (D1, D2), (D3, D4), . . . , and (D11, D12) are simultaneously turned on/off, and the light-emitting controller 211 that controls the switching unit S1 may control turning on/off of all of the light sources D1 through D12 through a single control line.

Figure 41:
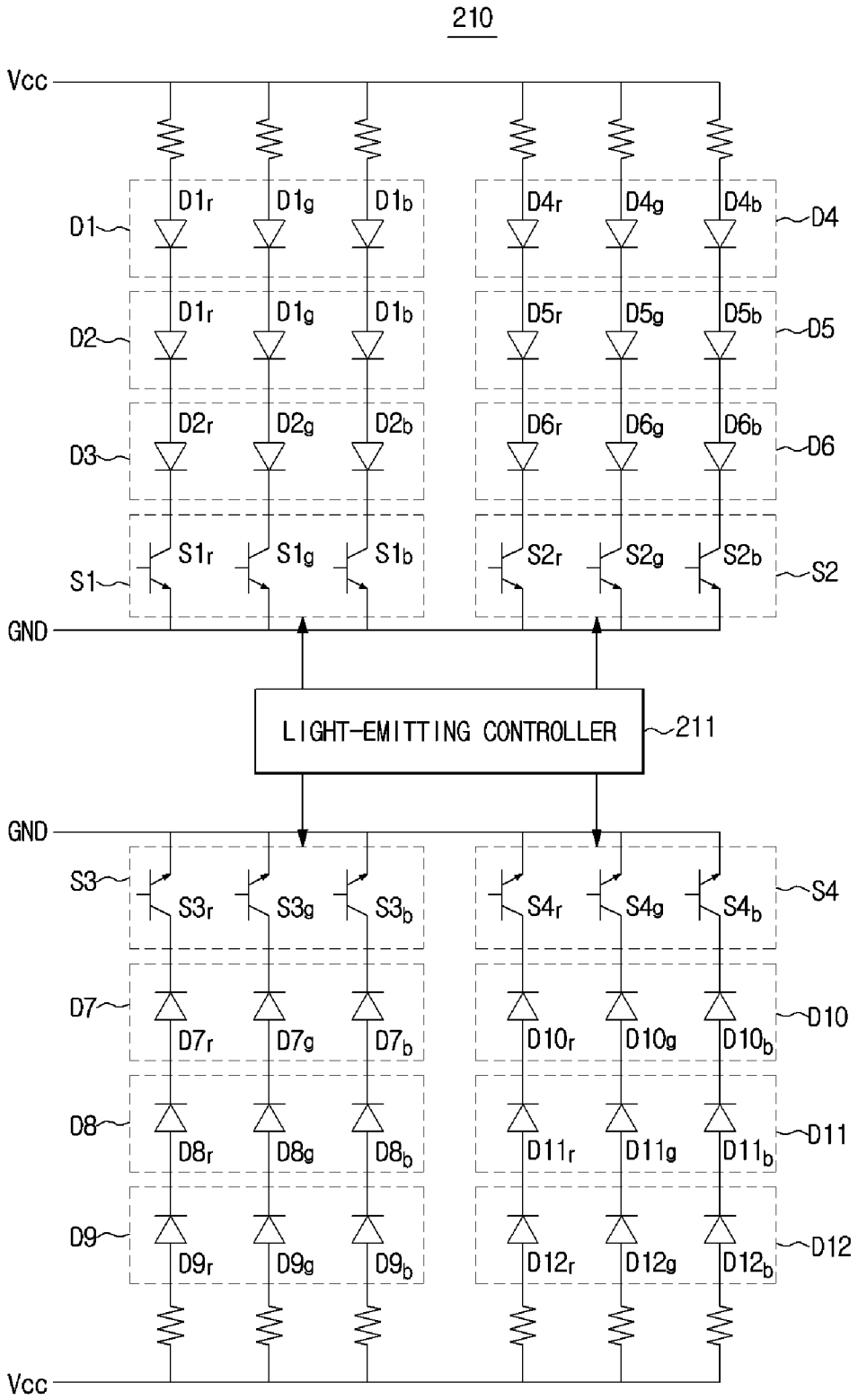

FIG. 41 is a view of still another example of a circuit for implementing a light-emitting module included in the cooking apparatus in accordance with an embodiment of the present invention.

Referring to FIG. 41, the light-emitting module 210 includes a plurality of light sources D1 through D12 that output light, a plurality of switching units S1 through S4 that control driving currents supplied to the plurality of light sources D1 through D12, a plurality of resistive units R1 through R4 that limit sizes of the driving currents supplied to the light sources D1 through D12, and a light-emitting controller 211 that controls turning on/off of the plurality of switching units S1 through S4.

Comparing the light-emitting module 210 illustrated in FIG. 41 with the light-emitting module 210 illustrated in FIG. 21, in the light-emitting module 210 illustrated in FIG. 21, two light sources D1 and D2, D3 and D4, . . . , and D11 and D12 form one group and are connected to each other in series, whereas, in the light-emitting module 210 illustrated in FIG. 41, three light sources D1, D2 and D3, D4, D5 and D6, . . . , and D10, D11 and D12 form four light source groups (D1, D2, D3), (D4, D5, D6), . . . , and (D10, D11, D12).

As a result, compared to the light-emitting module 210 illustrated in FIG. 21, in the light-emitting module 210 illustrated in FIG. 41, the number of light sources simultaneously turned on/off is increased from 2 to 3, and the number of light source groups that may be independently controlled is reduced from 6 to 4.

Also, compared to the light-emitting module 210 illustrated in FIG. 21 with the light-emitting module 210 illustrated in FIG. 41, the number of control lines output from the light-emitting controller 211 is reduced from 6 to 4.

Figure 42:
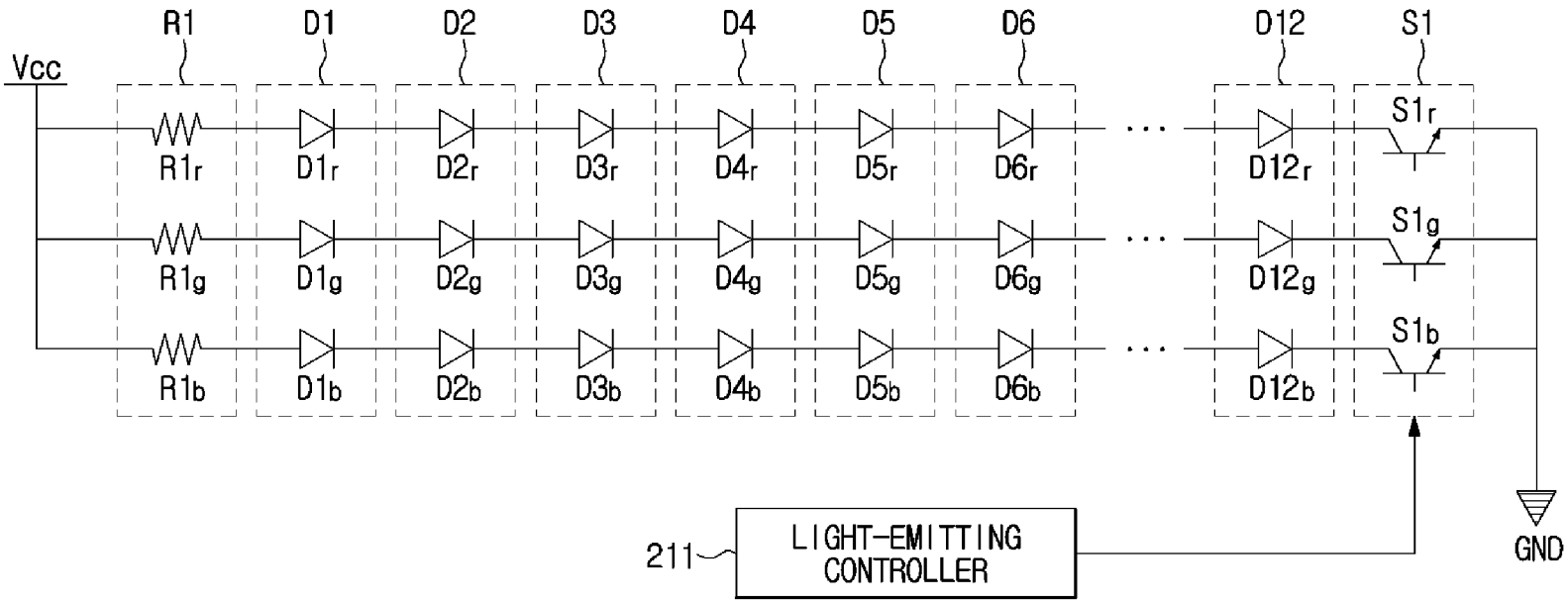

FIG. 42 is a view of another example of a circuit for implementing a light-emitting module included in the cooking apparatus in accordance with an embodiment of the present invention.

Referring to FIG. 42, the light-emitting module 210 includes a plurality of light sources D1 through D12 that output light, a switching unit S1 that controls driving currents supplied to the plurality of light sources D1 through D12, a resistive unit R1 that limits sizes of the driving currents supplied to the plurality of light sources D1 through D12, and a light-emitting controller 211 that controls turning on/off of the switching unit S.

All of the plurality of light sources D1 through D12 are connected to each other in series, and the switching unit S1 and the resistive unit R1 are also connected to the plurality of light sources D1 through D12 in series.

As a result, the plurality of light sources D1 through D12 are simultaneously turned on/off, and the light-emitting controller 211 that controls the switching unit S may control turning on/off of all of the light sources D1 through D12 through a single control line.

Thus, since all of the light sources D1 through D12 may be controlled through the single control line, the operation of the light sources D1 through D12 may be effectively controlled.

Figure 43:
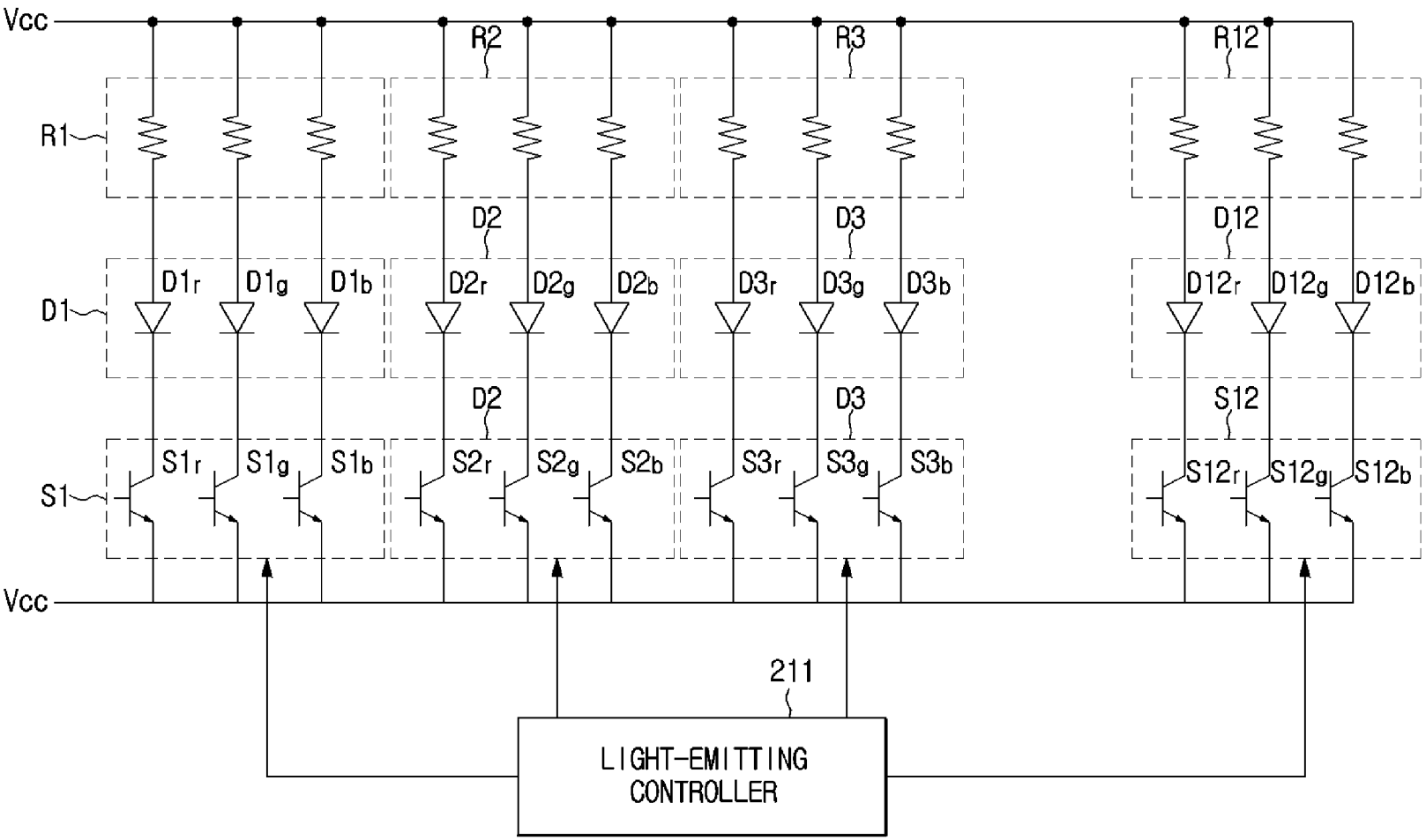

FIG. 43 is a view of another example of a circuit for implementing a light-emitting module included in the cooking apparatus in accordance with an embodiment of the present invention.

Referring to FIG. 43, the light-emitting module 210 may include a plurality of light sources D1 through D12 that output light, a plurality of switching units S1 through S12 that control driving currents supplied to the plurality of light sources D1 through D12, a plurality of resistive units R1 through R12 that limit sizes of the driving currents supplied to the light sources D1 through D12, and a light-emitting controller 211 that controls turning on/off of the plurality of switching units S1 through S12.

The plurality of light sources D1 through D12 are connected to each other in parallel, and each of the light sources D1 through D12 are connected to the switching units S1 through S12 and the plurality of resistive units R1 through R12 in series.

As a result, each of the light sources D1 through D12 may operate independently, and the light-emitting controller 211 that controls the plurality of switching units S1 through S12 may turn on/off each of the light sources D1 through D12 through twelve control lines having the same number as the number of light sources D1 through D12.

Since the light sources D1 through D12 may be respectively independently controlled, the light-emitting module 210 may implement various movement of flame images FI.

As described above, the cooking apparatus 1 may generate flame images by using the flame image generating unit 200. Thus, the cooking apparatus 1 may provide intuitive operation information to the user.

Hereinafter, an operation of the cooking apparatus 1 in accordance with an embodiment of the present invention will be described.

Figure 44:
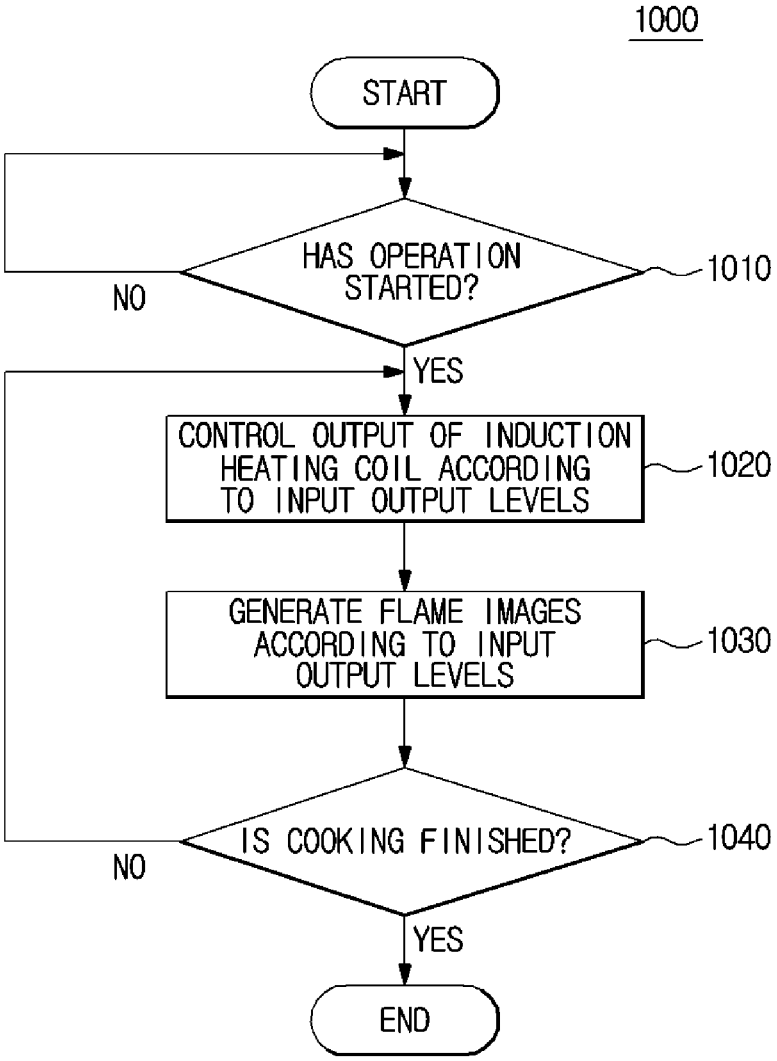
FIG. 44 is a view of an example of a heating operation of the cooking apparatus in accordance with an embodiment of the present invention.

FIG. 44 is a view of an example of a heating operation of the cooking apparatus in accordance with an embodiment of the present invention.

When describing a heating operation 1000 of the cooking apparatus 1 by referring to FIG. 44, the cooking apparatus 1 determines whether an operation starts being performed (1010).

For example, the user may input output levels by using the manipulation dial 15 included in the user interface 120, and if the output levels are input, the cooking apparatus may start a cooking operation.

If the operation has started (YES of 1010), the cooking apparatus 1 controls output of the induction heating coil L according to the input output levels (1020).

The cooking apparatus 1 adjusts the intensity of the magnetic field output by the induction heating coil L according to the input output levels.

As described above, the cooking apparatus 1 may control the sizes of the driving current supplied to the induction heating coil L by changing turning on/off frequencies of a pair of switches Q1 and Q2 included in the coil driving unit 110. Also, the intensity of the magnetic field generated by the induction heating coil L is changed according to the sizes of the supplied driving currents.

Thus, the cooking apparatus 1 determines the turning on/off frequencies of the pair of switches Q1 and Q2 included in the coil driving unit 110 according to the input output levels and turns on/off the pair of switches Q1 and Q2 included in the coil driving unit 110 according to the determined frequencies.

Subsequently, the cooking apparatus 1 generates flame images FI according to the input output levels (1030).

In detail, the cooking apparatus 1 transmits the output levels to the flame image generating unit 200, and the light-emitting controller 211 included in the flame image generating unit 200 receives the output levels.

The light-emitting controller 211 controls turning on/off of the plurality of switching units S1 through S6 included in the light source driving circuit 213 according to the output levels, and the plurality of light sources D1 through D12 output light corresponding to the output levels.

For example, the plurality of light sources D1 through D12 may output light having different intensities according to the output levels. The plurality of light sources D1 through D12 may output light having stronger intensity as the output levels increase and may output light having weak intensity as the output levels decrease.

As a result, the flame images FI having different brightness and different sizes are formed according to the output levels.

As another example, the plurality of light sources D1 through D12 may output light having different colors according to the output levels. The plurality of light sources D1 through D12 may output blue light as the output levels increase and may output red light as the output levels decrease. Also, when a medium output level is input, the plurality of light sources D1 through D12 may output yellow light.

As a result, flame images FI having different colors may be formed according to the output levels.

Subsequently, the cooking apparatus 1 determines whether cooking is finished (1040).

For example, if cooking is finished, the user may input an output level of "0" by using the manipulation dial 15 included in the user interface 120, and if the output level of "0" is input, the cooking apparatus 1 determines that cooking is finished.

If it is determined that cooking is finished (YES of 1040), the cooking apparatus 1 stops activation of the induction heating coil L and the flame image generating unit 200.

If it is determined that cooking is not finished (NO of 1040), the cooking apparatus 1 continuously performs activation of the induction heating coil L and the flame image generating unit 200 according to the input output levels.

As described above, the cooking apparatus 1 in accordance with an embodiment of the present invention may generate the flame images FI having various shapes according to the user's control instructions or an operation state of the cooking apparatus 1.

Hereinafter, a cooking apparatus in accordance with another embodiment of the present invention will be described.

The cooking apparatus in accordance with another embodiment of the present invention may perform all of functions of the cooking apparatus in accordance with an embodiment of the present invention although there is no description and may further perform an additional function by means of a separately-added configuration.

Also, like reference numerals as those of the cooking apparatus in accordance with an embodiment of the present invention are used for the same configuration of a configuration included in the cooking apparatus in accordance with another embodiment of the present invention as the configuration included in the cooking apparatus in accordance with an embodiment of the present invention.

Figure 45:
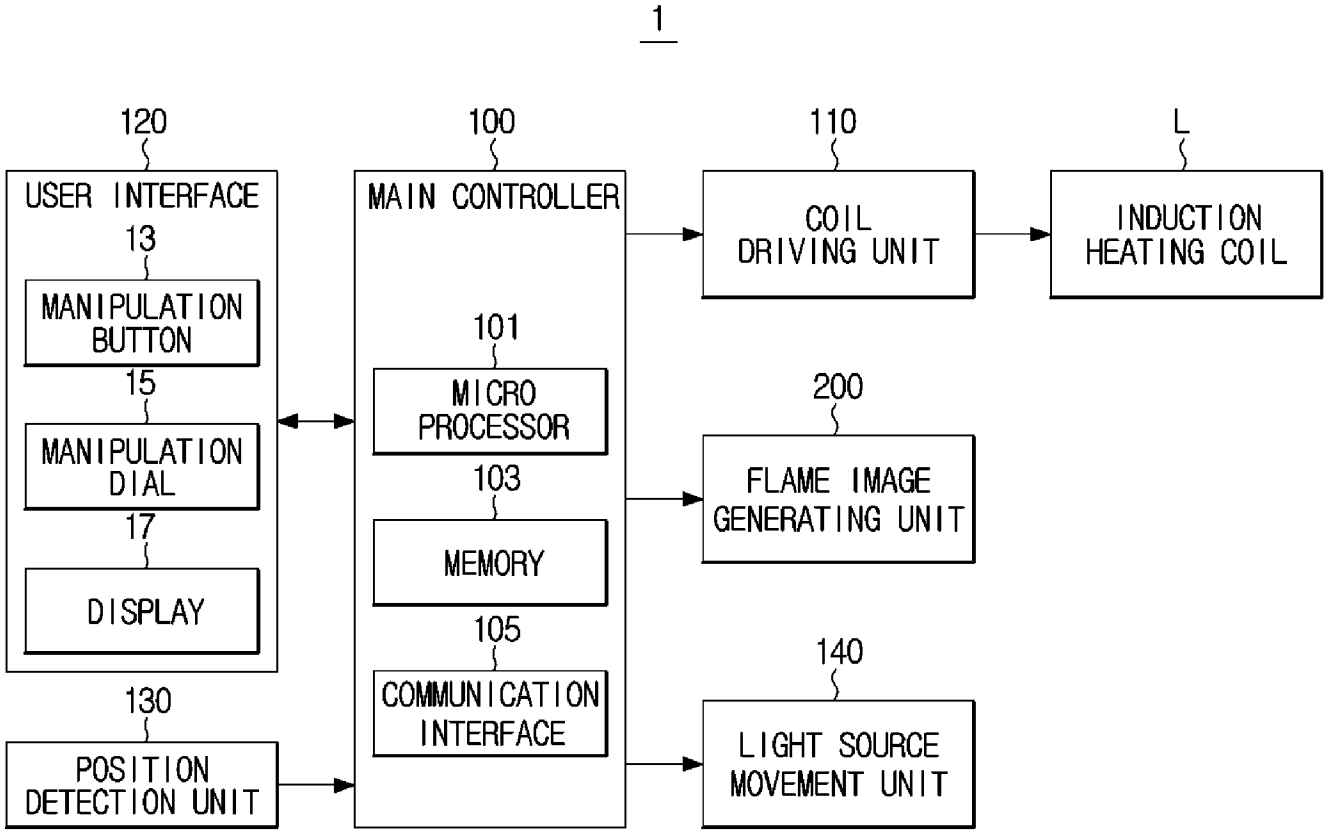
FIG. 45 is a view of a configuration of a cooking apparatus in accordance with another embodiment of the present invention.
Figure 46:
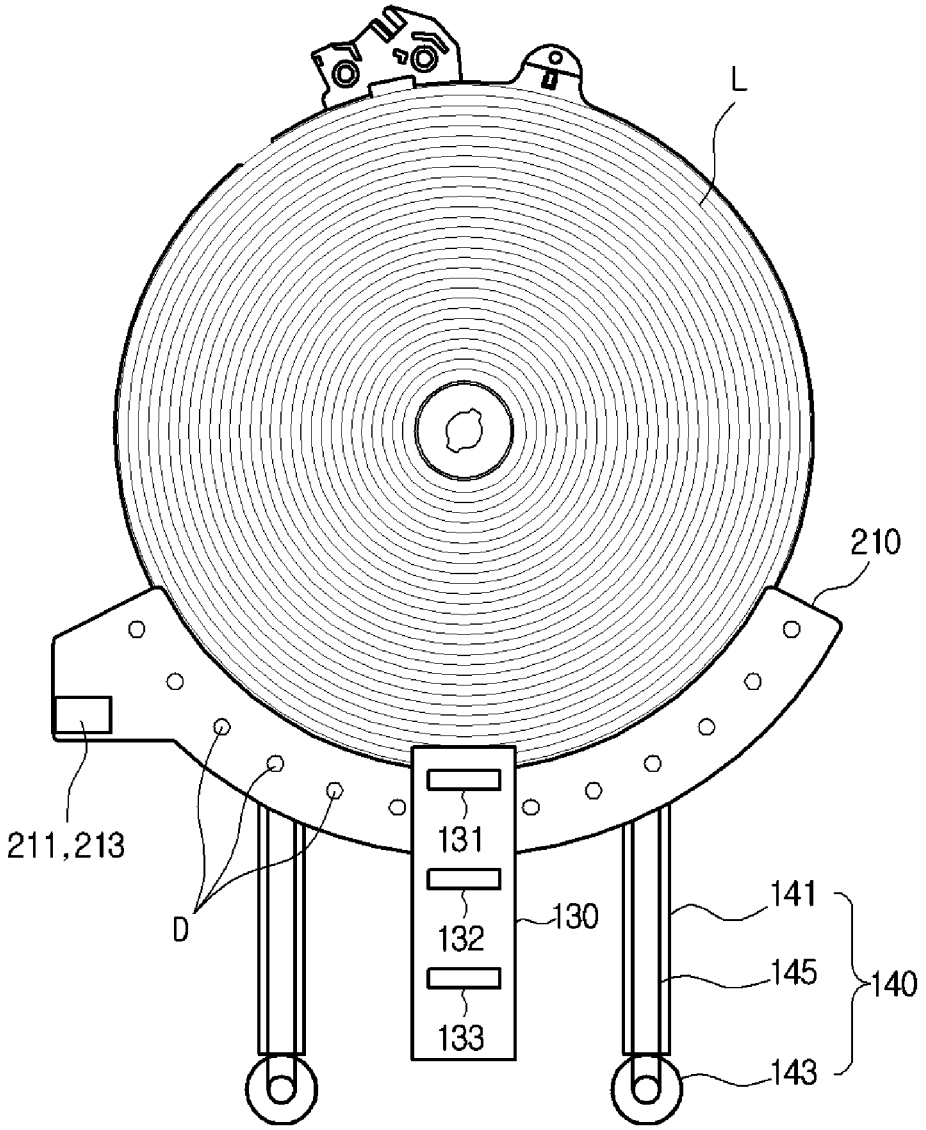
FIGS. 46 and 47 are views of an example of a position detection portion and a light source movement portion included in the cooking apparatus in accordance with another embodiment of the present invention.
Figure 47:
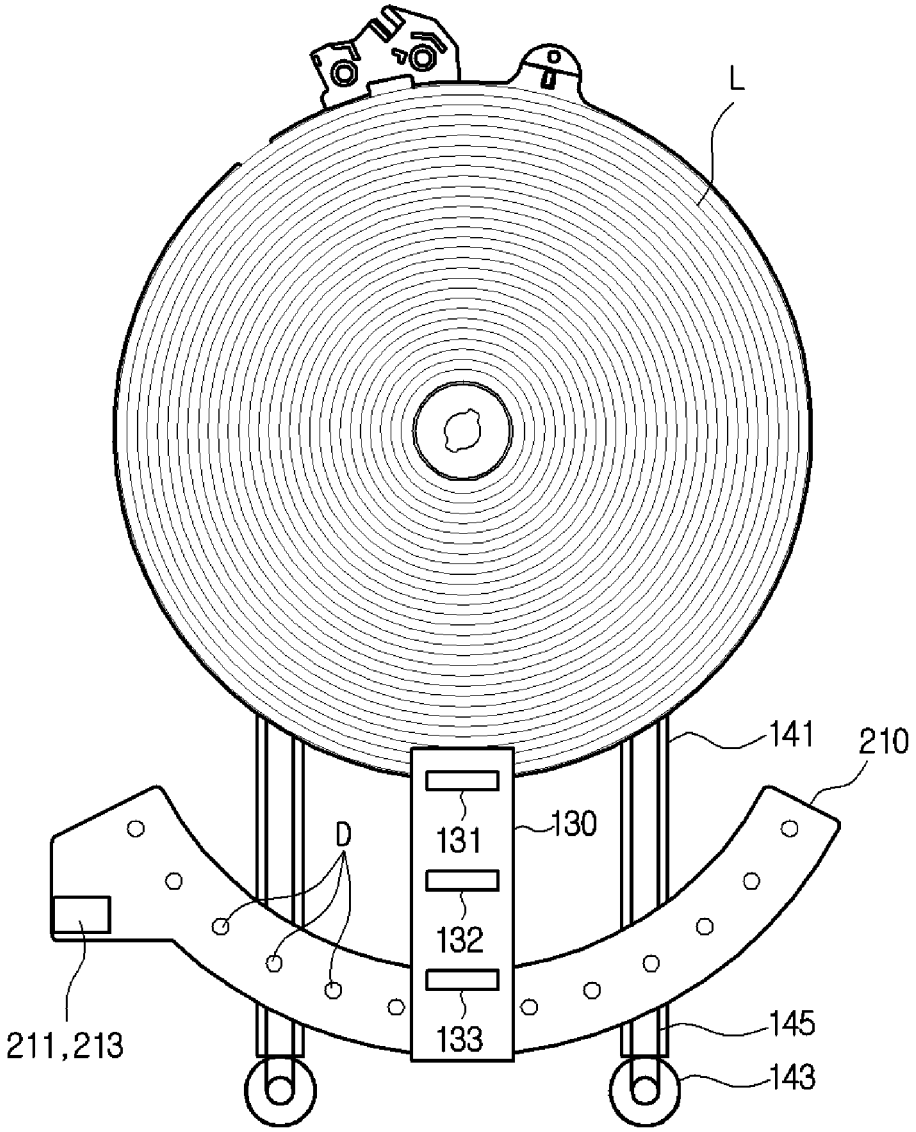

FIG. 45 is a view of a configuration of a cooking apparatus in accordance with another embodiment of the present invention, and FIGS. 46 and 47 are views of an example of a position detection portion and a light source movement portion included in the cooking apparatus in accordance with another embodiment of the present invention.

Referring to FIGS. 45 through 48, the cooking apparatus 1 in accordance with another embodiment of the present invention includes a user interface 120, an induction heating coil L, a coil driving unit 110, a flame image generating unit 200, a main controller 100, a position detection unit 130, and a light source movement unit 140.

Configurations and functions of the user interface 120, the induction heating coil L, the flame image generating unit 200, and the main controller 100 have been described as above and thus, a description thereof will be omitted.

As described above, guide marks M1 through M4 are formed on a cooking plate 11 of the cooking apparatus 1 so as to guide the position of a cooking container C.

However, regardless of disposing the cooking container C out of positions of the guide marks M1 through M4, the use of a larger cooking container C than a cooking container C having an appropriate size cannot be excluded.

Also, when the user disposes the cooking container C out of the positions of the guide marks M1 through M4 or uses the larger cooking container C than the cooking container C having an appropriate size, appropriate flame images F are not formed in sides of the cooking container C.

In order to prevent this phenomenon, the cooking apparatus 1 may detect the position of the cooking container C, or may move the light-emitting module 210 to an appropriate position according the detected position of the cooking container C or may select the light-emitting module 210 disposed in an appropriate position according to the detected position of the cooking container C.

First, the position detection unit 130 may detect the position of the cooking container C disposed by the user on the cooking plate 11 and may provide position detection signals to the main controller 100 according to the result of detection.

The position detection unit 130 includes position sensors 131, 132, and 133 disposed at various distance from the center of the induction heating coil L.

For example, as illustrated in FIGS. 46 and 47, the position detection unit 130 may include a first position sensor 131 disposed at a first distance from the center of the induction heating coil L, a second position sensor 132 disposed at a second distance from the center of the induction heating coil L, and a third position sensor 133 disposed at a third distance from the center of the induction heating coil L.

Also, each of the position detectors 131, 132, and 133 detects whether the cooking container C is disposed in positions corresponding to the position sensors 131, 132, and 133 and outputs the position detection signals according to the result of detection.

For example, if the cooking container C is disposed in a position corresponding to the first distance from the center of the induction heating coil L, the first position sensor 131 provides the position detection signals to the main controller 100, and if the cooking container C is disposed in a position corresponding to the second distance from the center of the induction heating coil L, the first position sensor 131 and the second position sensor 132 provide the position detection signals to the main controller 100. Also, if the cooking container C is disposed in a position corresponding to the third distance from the center of the induction heating coil L, the first, second, and third position sensors 131, 132, and 133 provide the position detection signals to the main controller 100.

The main controller 100 may determine the position of the cooking container C according to the position detection signals provided by the first, second, and third position sensors 131, 132, and 133. In detail, the main controller 100 may determine a position in which the sides of the cooking container C are placed, according to the position detection signals provided by the first, second, and third position sensors 131, 132, and 133.

For example, when all of the position sensors 131, 132, and 133 do not provide the position detection signals, the main controller 100 may determine that the sides of the cooking container C are placed in an inner position than the first position sensor 131.

Also, when only the first position sensor 131 provides the position detection signals, the main controller 100 may determine that the sides of the cooking container C are placed between the first position sensor 131 and the second position sensor 132.

Also, when the first position sensor 131 and the second position sensor 132 provide the position detection signals, the main controller 100 may determine that the sides of the cooking container C are placed between the second position sensor 132 and the third position sensor 133.

Also, when all of the position sensors 131, 132, and 133 provide the position detection signals, the main controller 100 may determine that the sides of the cooking container C are placed in an outer position than the third position sensor 133.

The position sensors 131, 132, and 133 may employ infrared sensors that emit infrared rays and detect the infrared rays reflected from the cooking container C, or ultrasonic sensors that emit ultrasonic waves and detect the ultrasonic waves reflected from the cooking container C.

The light source movement unit 140 moves the light-emitting module 210, the condensing member 220, and the optical filter 230 according to movement control signals of the main controller 100.

As illustrated in FIGS. 46 and 47, the light source movement unit 140 may include a guide bar 141 that guides movement of the light-emitting module 210, a driving motor 143 that generates a rotational force for moving the light-emitting module 210, and a driving belt 145 that makes a rectilinear motion of the light-emitting module 210 by using the rotational force generated by the driving motor 143.

The driving motor 143 generates the rotational force, and the generated rotational force is transmitted to the driving belt 145. The driving belt 145 moves the light-emitting module 210 along the guide bar 141 forward/backward by using the rotational force of the driving motor 143.

The main controller 100 may receive the position detection signals from the position detection unit 130 and may provide the movement control signals to the light source movement unit 140.

In detail, the main controller 100 may output the movement control signals for controlling time at which driving currents are supplied to the driving motor 143 included in the light source movement unit 140 and the direction of the driving currents so as to move the light-emitting module 210 to an appropriate position.

Also, the main controller 100 controls the light source movement unit 140 so as to move the light-emitting module 210 to the appropriate position according to the position detection signals received from the position detection unit 130.

For example, if the position detection signals are received only from the first position sensor 131, the main controller 100 controls the light source movement unit 140 so that the light-emitting module 210 may be placed between the first position sensor 131 and the second position sensor 132, as illustrated in FIG. 46.

As another example, if the position detection signals are received from all of the position sensors 131, 132, and 133, the main controller 100 controls the light source movement unit 140 so that the light-emitting module 210 may be disposed outside the third position sensor 133, as illustrated in FIG. 47.

As described above, the cooking apparatus 1 may detect the position of the cooking container C so that the flame images FI having an appropriate shape may be formed, and may move the light-emitting module 210 according to the detected position of the cooking container C.

However, the cooking apparatus 1 is not limited to move the light-emitting module 210 so that the flame images FI having the appropriate shape may be formed, and the light sources D may also be installed to be disposed at various distances from the induction heating coil L.

Figure 48:
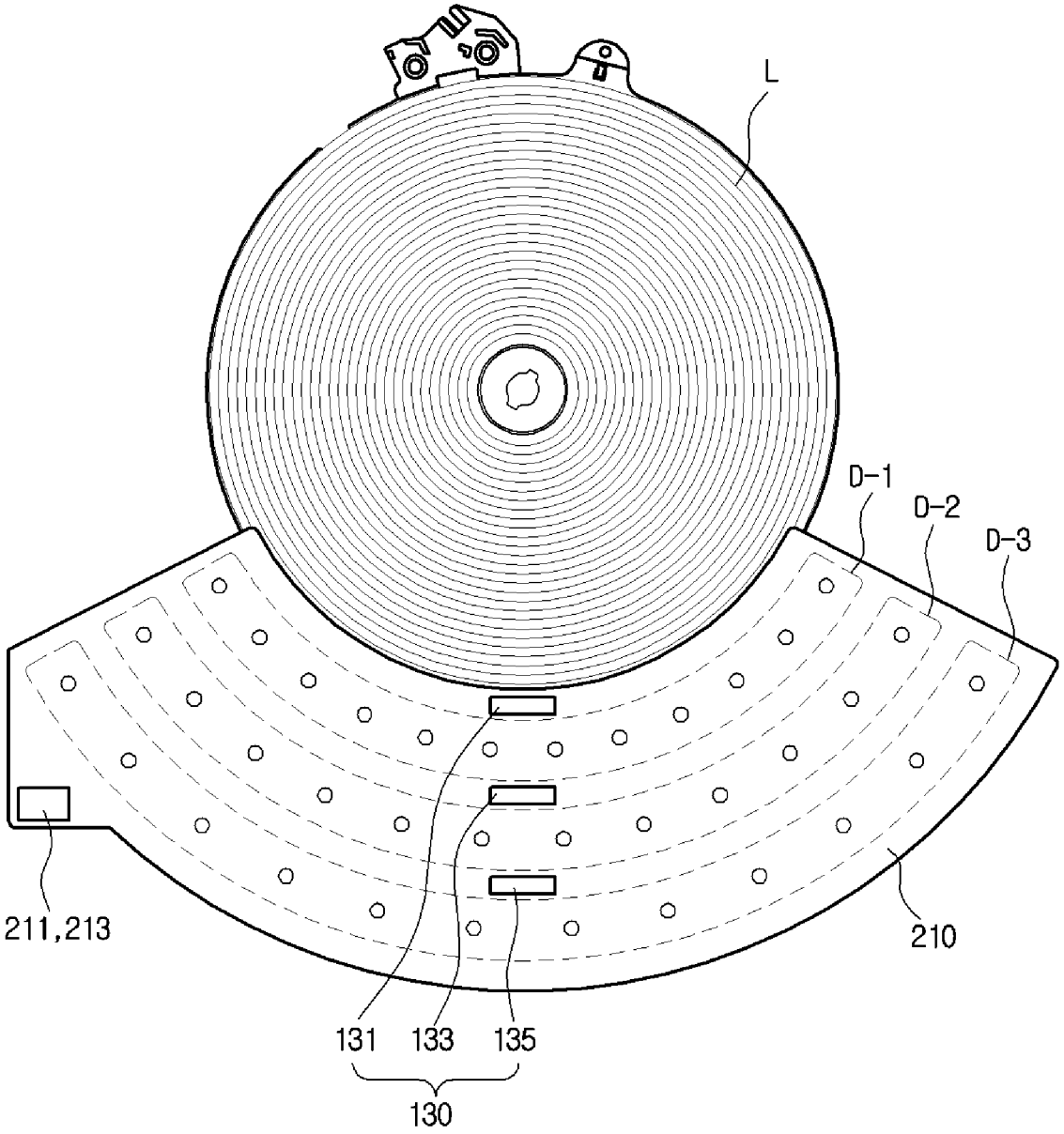
FIG. 48 is a view of another example of a light-emitting module and a position detection portion included in the cooking apparatus in accordance with another embodiment of the present invention.

FIG. 48 is a view of another example of a light-emitting module and a position detection portion included in the cooking apparatus in accordance with another embodiment of the present invention.

As illustrated in FIG. 48, the position detection unit 130 may include a first position sensor 131 disposed at a first distance from the center of the induction heating coil L, a second position sensor 132 disposed at a second distance from the center of the induction heating coil L, and a third position sensor 133 disposed at a third distance from the center of the induction heating coil L.

Also, each of the position sensors 131, 132, and 133 detects whether the cooking container C is disposed in positions corresponding to the position sensors 131, 132, and 133 and outputs position detection signals according to the result of detection.

The main controller 100 may determine the position of the cooking container C according to the position detection signals provided by the first, second, and third position sensors 131, 132, and 133. In detail, the main controller 100 may determine a position in which the sides of the cooking container C are placed, according to the position detection signals provided by the first, second, and third position sensors 131, 132, and 133.

Also, the light-emitting module 210 may include a plurality of light source groups D-1, D-2, and D-3 that are disposed at various distance from the center of the induction heating coil L.

For example, the light-emitting module 210 includes a first light source group D-1 disposed between the first distance and the second distance from the center of the induction heating coil L, a second light source group D-2 disposed between the second distance and the third distance from the center of the induction heating coil L, and a third light source group D-3 disposed at the third distance or more from the center of the induction heating coil L, as illustrated in FIG. 48.

Also, light source groups selected from the main controller 100 among the plurality of light source groups D-1, D-2, and D-3 output light for forming flame images FI.

The main controller 100 may receive the position detection signals from the position detection unit 130 and may select one light source group from among the plurality of light source groups D-1, D-2, and D-3 according to the position detection signals received from the position detection unit 130.

For example, if the position detection signals are received from the first position sensor 131, the main controller 100 may select a first light source group D-1, and if the position detection signals are received from the first position sensor 131 and the second position sensor 132, the main controller 100 may select a second light source group D-2. Also, if the position detection signals are received from all of the position sensors 131, 132, and 133, the main controller 100 may select a third light source group D-3.

As described above, the cooking apparatus 1 may detect the position of the cooking apparatus C so that the flame images FI having an appropriate shape may be formed, and the light sources D in appropriate positions may output light according to the detected position of the cooking container C.

Figure 49:
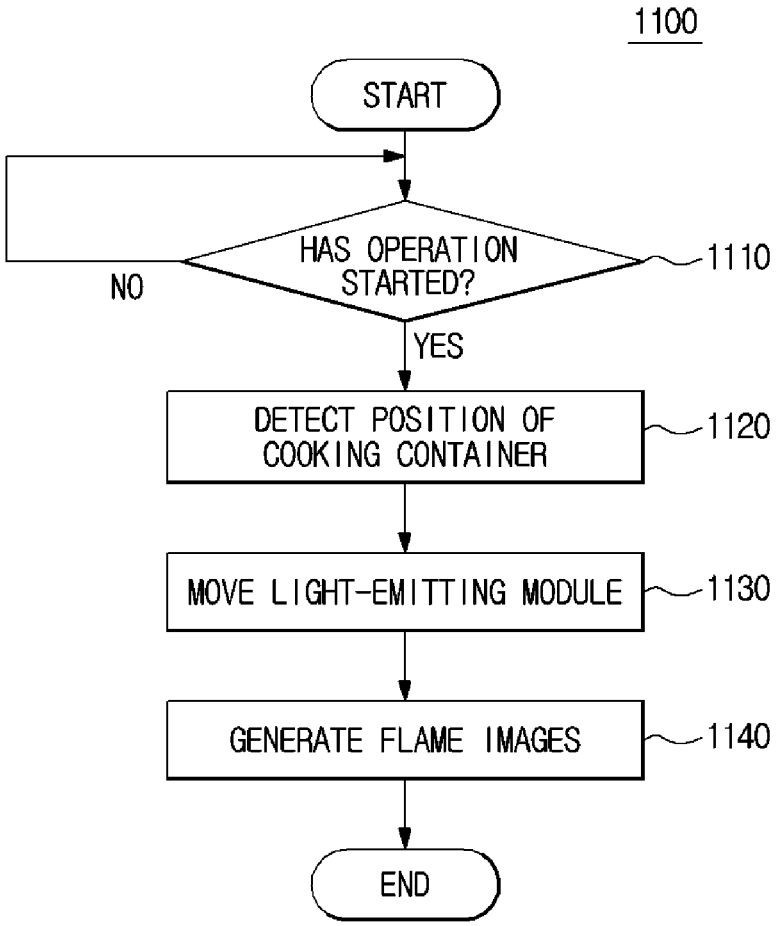
FIG. 49 is a view of an example of an operation of generating flame images of the cooking apparatus in accordance with another embodiment of the present invention.

FIG. 49 is a view of an example of an operation of generating flame images of the cooking apparatus in accordance with another embodiment of the present invention.

When describing the operation 1100 of generating flame images by referring to FIG. 49, the cooking apparatus 1 determines whether an operation has started (1110).

For example, the user may input output levels by using the manipulation dial 15 included in the user interface 120, and if the output levels are input, the cooking apparatus 1 may start a cooking operation.

If the operation has started (YES of 1110), the cooking apparatus 1 detects a position of the cooking container C (1120).

In detail, the position detection unit 130 may detect the position of the cooking container C and may provide position detection signals to the main controller 100 according to the position of the cooking container C, and the main controller 100 may determine the position of the cooking container C according to the received position detection signals.

Subsequently, the cooking container C moves the light-emitting module 210 according to the position of the cooking container C (1130).

In detail, the main controller 100 may control the light source movement unit 140 so as to move the light-emitting module 210 to an appropriate position according to the determined position of the cooking container C.

The cooking apparatus 1 is not limited to move the light-emitting module 210 according to the position of the cooking container C, and the cooking apparatus 1 may control the light-emitting module 210 so that the light sources D disposed in appropriate positions according to the cooking container C may output light for forming the flame images FI.

Subsequently, the cooking apparatus 1 generates flame images FI (1140).

In detail, when the light-emitting module 210 disposed in an appropriate position according to the position of the cooking container C outputs light, the flame images FI are formed in the sides of the cooking container C.

As described above, the cooking apparatus 1 in accordance with another embodiment of the present invention may detect the position of the cooking container C and may generate flame images FI by using the light-emitting module 210 disposed in the appropriate position according to the detected position of the cooking container C.

Hereinafter, a cooking apparatus in accordance with still another embodiment of the present invention will be described.

The cooking apparatus in accordance with still another embodiment of the present invention may perform all of functions of the cooking apparatus in accordance with an embodiment of the present invention and the cooking apparatus in accordance with another embodiment of the present invention although there is no description and may further perform an additional function by means of a separately-added configuration.

Also, like reference numerals as those of the cooking apparatus in accordance with an embodiment of the present invention and the cooking apparatus in accordance with another embodiment of the present invention are used for the same configuration of a configuration included in the cooking apparatus in accordance with still another embodiment of the present invention as the configuration included in the cooking apparatus in accordance with an embodiment of the present invention and the configuration included in the cooking apparatus in accordance with another embodiment of the present invention.

Figure 50:
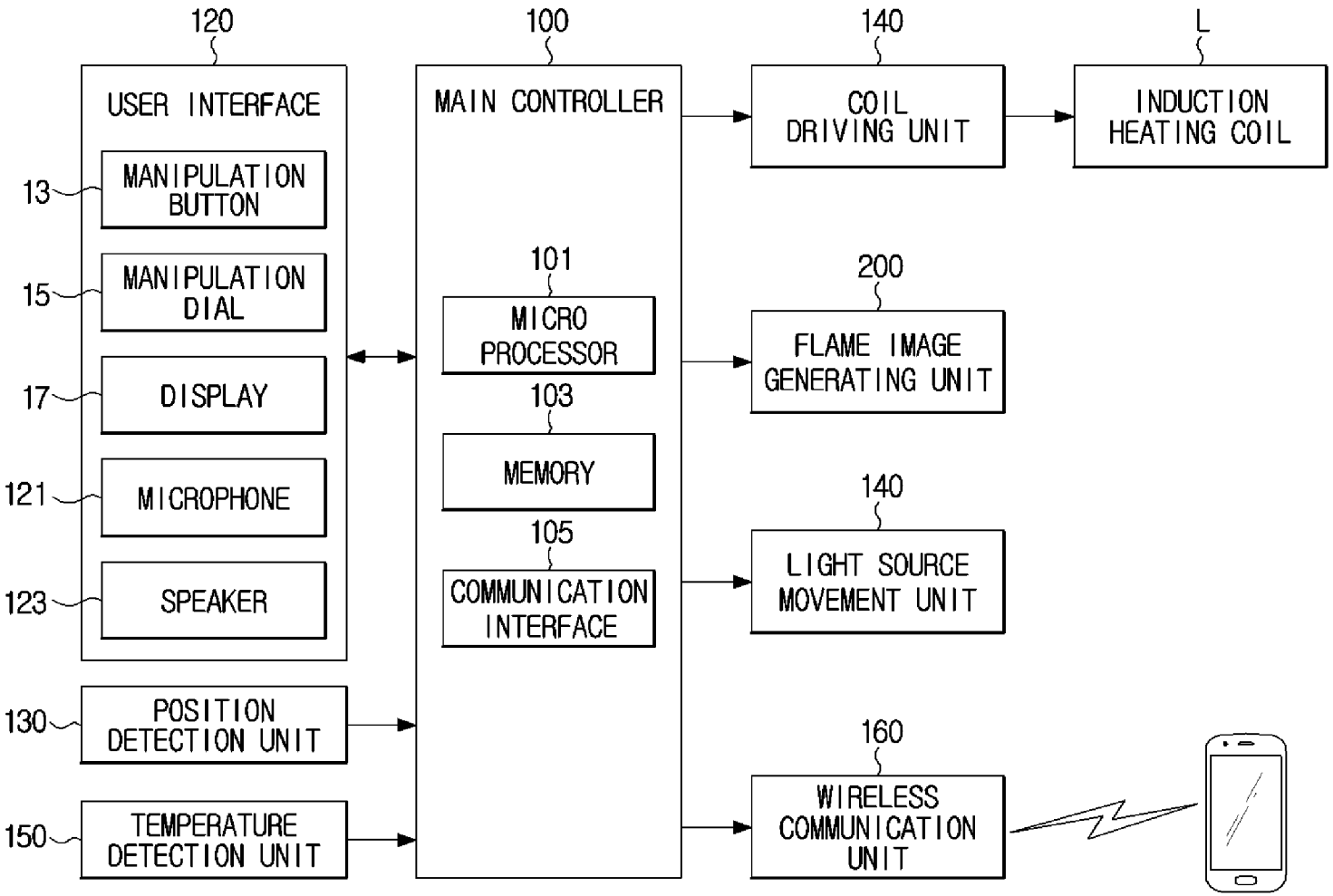
FIG. 50 is a view of a configuration of a cooking apparatus in accordance with still another embodiment of the present invention.

FIG. 50 is a view of a configuration of a cooking apparatus in accordance with still another embodiment of the present invention.

Referring to FIG. 50, a cooking apparatus 1 in accordance with still another embodiment of the present invention includes a user interface 120, an induction heating coil L, a coil driving unit 110, a flame image generating unit 200, a main controller 100, a position detection unit 130, a light source movement unit 140, a temperature detection unit 150, and a wireless communication unit 160.

Configurations and functions of the induction heating coil L, the coil driving unit 110, the flame image generating unit 200, the main controller 100, the position detection unit 130, and the light source movement unit 140 have been described as above and thus, a description thereof will be omitted.

The user interface 120 performs interaction with the user and includes a manipulation button 13, a manipulation dial 15, a display 17, a microphone 121, and a speaker 123.

The microphone 121 receives the user's voice signals, converts the received voice signals into electrical signals, and provides the electrical signals to the main controller 100.

Also, the main controller 100 may recognize the user's control instructions based on the voice signals received by the microphones 121.

For example, the user may input output levels by using voice, may convert the received voice signals into electrical signals, and may provide the electrical signals to the main controller 100.

The main controller 100 may analyze signals provided from the microphone 121 and may recognize the output levels input by the user.

The speaker 123 outputs various sounds according to the control signals of the main controller 100. For example, if malfunction of the cooking apparatus 1 is detected, the speaker 123 may output a warning sound according to warning sound output signals of the main controller 100.

The temperature detection unit 150 may detect the temperature of the cooking container C.

In detail, the temperature detection unit 150 may be in contact with the cooking container C and may detect the temperature of the cooking container C or may not be in contact with the cooking container C and may detect the temperature of the cooking container C. Also, the temperature detection unit 150 provides temperature detection signals corresponding to the detected temperature of the cooking container C to the main controller 100.

The temperature detection unit 150 may employ a thermistor, electrical resistance values of which vary according to temperature, or an infrared radiation thermometer that detects infrared rays radiated from an object to be measured and detects temperature according to the amount of the detected infrared rays.

The wireless communication unit 160 performs wireless communication with portable mobile terminal equipment MT held by the user.

In detail, the wireless communication unit 160 may perform communication with the portable mobile terminal equipment MT by using a wireless fidelity (Wi-Fi) communication method, a Bluetooth communication method, a near field communication (NFC) method, or a Zigbee communication method.

The Wi-Fi communication method may be used in communication between a wireless relay device and terminal equipment for forming a near field communication network, and the Bluetooth communication method may be used in low-power communication between terminal equipment and terminal equipment. Also, the NFC method may be used in ultra near field communication of 10 cm or less so as to improve security, and the Zigbee communication method may be used to form a low-power communication network between a plurality of terminal equipment.

The main controller 100 may control the coil driving unit 110 so that the induction heating coil L may generate a magnetic field B according to the output levels input through the user interface 120 as described above and may control the flame image generating unit 200 to generate flame images FI.

Also, the main controller 100 may control the light source movement unit 140 so that the light-emitting module 210 may be moved according to the position of the cooking container C detected by the position detection unit 130.

In addition, the main controller 100 may control the coil driving unit 110 so that the intensity of the magnetic field B generated by the induction heating coil L may be adjusted according to the temperature of the cooking container C detected by the temperature detection unit 150. Also, the main controller 100 may receive a cooking method from the portable mobile terminal equipment MT through the wireless communication unit 160 and may transmit cooking progression information to the portable mobile terminal equipment MT through the wireless communication unit 160.

Figure 51:
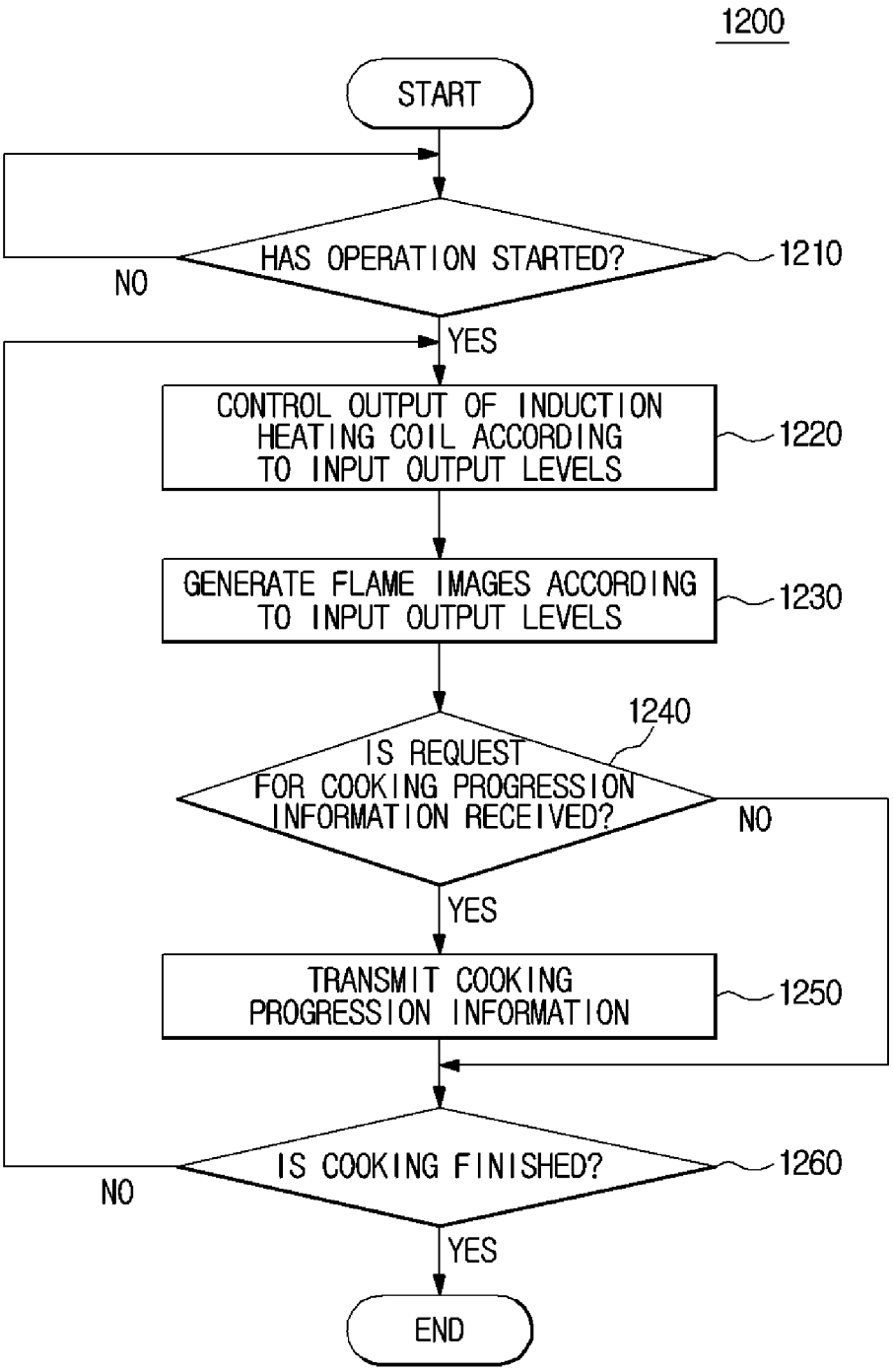
FIG. 51 is a view of an example of a heating operation of the cooking apparatus in accordance with still another embodiment of the present invention.

FIG. 51 is a view of an example of a heating operation of the cooking apparatus in accordance with still another embodiment of the present invention.

The user may check the cooking progression information regarding the cooking apparatus 1 through the portable mobile terminal equipment MT.

In detail, the portable mobile terminal equipment MT may request the cooking apparatus 1 of the cooking progression information, and the cooking apparatus 1 may transmit the cooking progression information including a cooking progression time and the temperature of the cooking container C to the portable mobile terminal equipment MT through the wireless communication unit 160.

The portable mobile terminal equipment MT that receives the cooking progression information displays the received cooking progression information to the user.

A heating operation 1200 of the cooking apparatus 1 will be described in detail with reference to FIG. 51.

First, the cooking apparatus 1 determines whether an operation has started (1210).

For example, the user may input output levels by using the manipulation dial 15 included in the user interface 120, and if the output levels are input, the cooking apparatus 1 may start a cooking operation.

If the operation has started (YES of 1210), the cooking apparatus 1 controls output of the induction heating coil L according to the input output levels (1220).

The cooking apparatus 1 adjusts the intensity of a magnetic field generated by the induction heating coil L according to the input output levels.

As described above, the cooking apparatus 1 may control the sizes of driving currents supplied to the induction heating coil L by changing turning on/off frequencies of a pair of switches Q1 and Q2 included in the coil driving unit 110. Also, the intensity of the magnetic field B generated by the induction heating coil L is changed according to the sizes of the supplied driving currents.

Thus, the cooking apparatus 1 determines the turning on/off frequencies of the pair of switches Q1 and Q2 included in the coil driving unit 110 according to the input output levels and turns on/off the pair of switches Q1 and Q2 included in the coil driving unit 110 according to the determined frequencies.

Subsequently, the cooking apparatus 1 generate flame images FI according to the input output levels (1230).

In detail, the cooking apparatus 1 transmits the output levels to the flame image generating unit 200, and the light-emitting controller 211 included in the flame image generating unit 200 receives the output levels.

The light-emitting controller 211 controls turning on/off of the plurality of switching units S1 through S6 included in the light source driving circuit 213 according to the output levels, and the plurality of light sources D1 through D12 output light corresponding to the output levels.

For example, the plurality of light sources D1 through D12 may output light having different intensities according to the output levels. The plurality of light sources D1 through D12 may output light having a stronger intensity as the output levels increase and may output light having a weaker intensity as the output levels decrease.

As a result, flame images FI having different brightness and different sizes are formed according to the output levels.

As another example, the plurality of light sources D1 through D12 may output light having different colors according to the output levels. The plurality of light sources D1 through D12 may output blue light as the output levels increase and may output red light as the output levels decrease. Also, if a medium output level is input, the plurality of light sources D1 through D12 may output yellow light.

As a result, flame images FI having different colors may be formed according to the output levels.

Subsequently, the cooking apparatus 1 determines whether a request for cooling progression information is received from the portable mobile terminal equipment MT (1240).

In detail, the portable mobile terminal equipment MT may request the cooking apparatus 1 of the cooking progression information, and the cooking apparatus 1 may receive the request for the cooking progression information of the portable mobile terminal equipment MT through the wireless communication unit 160.

If the request for the cooking progression information is received (YES of 1240), the cooking apparatus 1 transmits the cooking progression information to the portable mobile terminal equipment MT (1250).

In detail, the cooking apparatus 1 that receives the request for the cooking progression information may generate cooking progression information including a cooking elapse time and the temperature of the cooking container C and may transmit the cooking progression information to the portable mobile terminal equipment MT through the wireless communication unit 160.

The portable mobile terminal equipment MT that receives the cooking progression information displays the cooking elapse time and the temperature of the cooking container C to the user.

If the cooking progression information is transmitted according to the request for the cooking progression information or the request for the cooking progression information is not received (NO of 1240), the cooking apparatus 1 determines whether cooking is finished (1260).

For example, if cooking is finished, the user may input an output level of "0" by using the manipulation dial 15 included in the user interface 120, and if the output level of "0" is input, the cooking apparatus 1 determines that cooking is finished.

If it is determined that cooking is finished (YES of 1260), the cooking apparatus 1 stops activation of the induction heating coil L and the flame image generating unit 200.

If it is determined that cooking is not finished (NO of 1260), the cooking apparatus 1 activates the induction heating coil L and the flame image generating unit 200 according to the input output levels.

As described above, the cooking apparatus 1 in accordance with an embodiment of the present invention may transmit the cooking progression information to the user's portable mobile terminal equipment MT through the wireless communication unit 160 in response to the user's request for the cooking progression information through the portable mobile terminal equipment MT.

Figure 52:
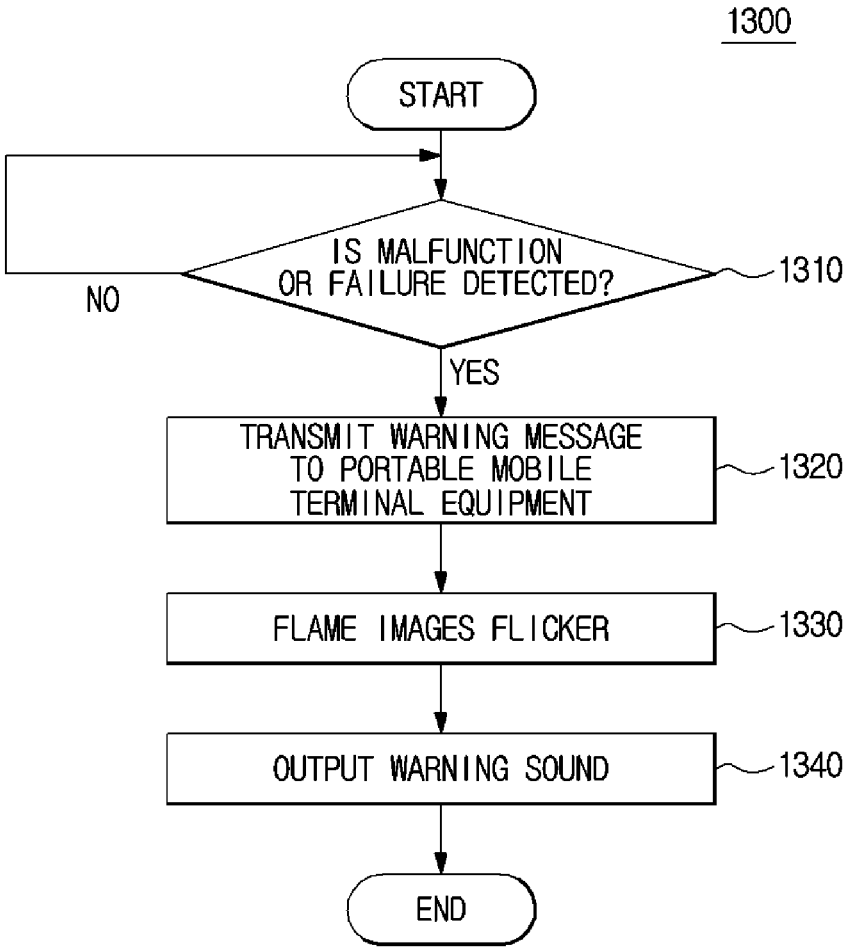
FIG. 52 is a view of an example of a warning operation of the cooking apparatus in accordance with still another embodiment of the present invention.

FIG. 52 is a view of an example of a warning operation of the cooking apparatus in accordance with still another embodiment of the present invention.

The cooking apparatus 1 detects whether malfunction occurs in the cooking apparatus 1, and if malfunction is detected, the cooking apparatus 1 may give a warning to the user by using the flame images FI and a warning sound.

A warning operation 1300 of the cooking apparatus 1 will be described in detail with reference to FIG. 52.

First, the cooking apparatus 1 determines whether malfunction or failure is detected (1310).

For example, the main controller 100 controls the coil driving unit 110 so that the induction heating coil L may generate a magnetic field. However, when the temperature of the cooking container C does not rise for a considerable time, the cooking apparatus 1 may determine that failure occurs.

As another example, the main controller 100 controls the coil driving unit 110 so that the induction heating coil L may generate a magnetic field B having an appropriate intensity. However, when the cooking apparatus C is overheated, the cooking apparatus 1 may determine that failure occurs.

If malfunction or failure is detected (YES of 1310), the cooking apparatus 1 transmits a warning message to the portable mobile terminal equipment MT (1320).

In detail, the cooking apparatus 1 may transmit the warning message to the portable mobile terminal equipment MT through the wireless communication unit 160, and the portable mobile terminal equipment MT that receives the warning message may give a warning of failure of the cooking apparatus 1 to the user by using vibration or sound.

Also, the cooking apparatus 1 generates flame images FI that flicker (1330).

As described above, the cooking apparatus 1 may generate the flame images FI that flicker, so as to give a warning of malfunction or failure to the user.

In detail, the light-emitting controller 211 may control the light source driving circuit 213 so that all of the plurality of light sources D may be turned on/off in a predetermined period, and the light-emitting controller 211 may control the light source driving circuit 213 so that the plurality of light sources D may be repeatedly turned on/off by each pair.

Also, the cooking apparatus 1 outputs a warning sound (1340).

In detail, the main controller 100 may transmit warning sound output signals to the speaker 123 so as to output the warning sound.

The speaker 123 may output the warning sound that may call the user's attention according to the warning sound output signals.

As described above, if malfunction or failure is detected, the cooking apparatus 1 may give a warning of malfunction or failure to the user by using various methods.

Figure 53:
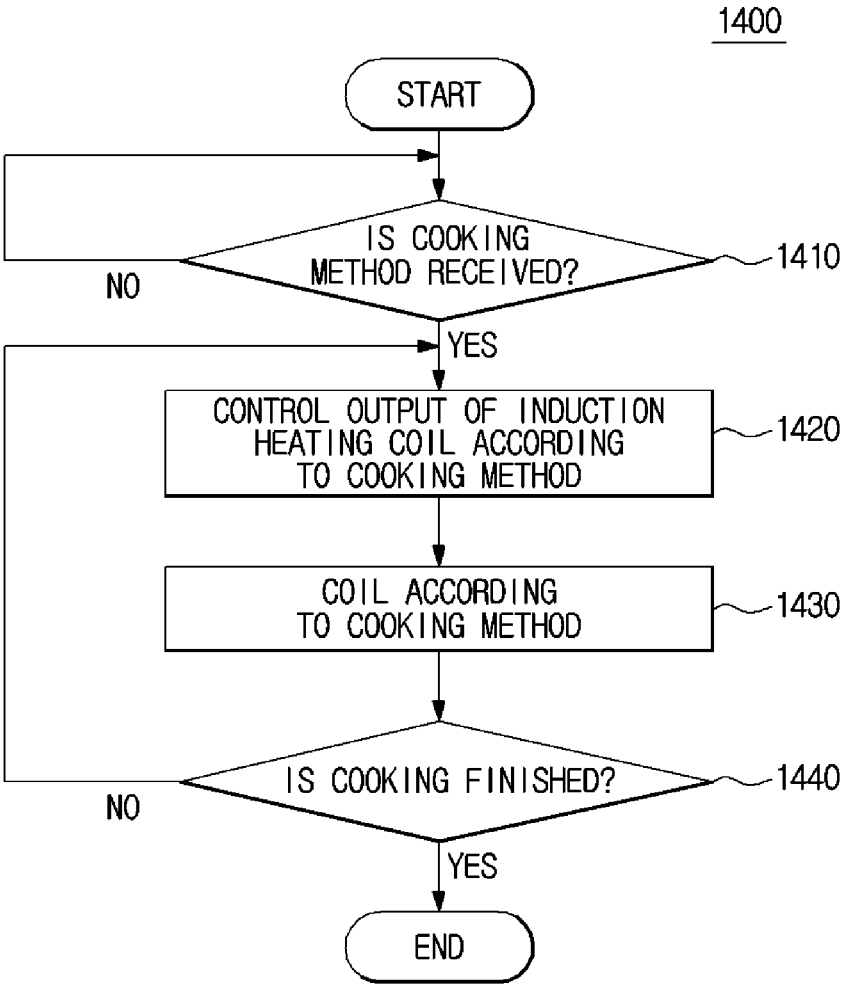
FIG. 53 is a view of an example of a heating operation of heating a cooking container by using a cooking method received by the cooking apparatus in accordance with still another embodiment of the present invention from portable terminal equipment.

FIG. 53 is a view of an example of a heating operation of heating a cooking container by using a cooking method received by the cooking apparatus in accordance with still another embodiment of the present invention from portable terminal equipment.

The user may input output levels directly to the cooking apparatus 1 by using the user interface 120 and may transmit a cooking method to the cooking apparatus 1 by using the portable mobile terminal equipment MT.

A heating operation 1400 of the cooking apparatus 1 according to the cooking method will be described with reference to FIG. 53.

First, the cooking apparatus 1 determines whether the cooking method is received from the portable mobile terminal equipment MT (1410).

The user may transmit the cooking method including a cooking time and a cooking temperature to the cooking apparatus 1 through the portable mobile terminal equipment MT, and the cooking apparatus 1 may receive the cooking method through the wireless communication unit 160.

If the cooking method is received (YES of 1410), the cooking apparatus 1 controls output of the induction heating coil L according to the received cooking method (1420).

In detail, the cooking apparatus 1 obtains the cooking temperature included in the cooking method and calculates the intensity of the magnetic field B corresponding to the cooking temperature. Subsequently, the cooking apparatus 1 may control the coil driving unit 110 so that the induction heating coil L may generate the magnetic field B having the calculated intensity.

Also, the cooking apparatus 1 may detect the temperature of the cooking container C by using the temperature detection unit 150, may compare the temperature of the cooking container C with the cooking temperature of the cooking method, and may adjust the intensity of the magnetic field B generated by the induction heating coil L.

Subsequently, the cooking apparatus 1 generates flame images FI according to the received cooking method (1430).

In detail, the cooking apparatus 1 obtains the cooking temperature included in the cooking method and calculates the intensity of the magnetic field B corresponding to the cooking temperature. Subsequently, the cooking apparatus 1 may control the flame image generating unit 200 so as to generate the flame images FI corresponding to the calculated intensity of the magnetic field B.

Also, if the intensity of the magnetic field generated by the induction heating coil L is changed, the cooking apparatus may control the flame image generating unit 200 so as to generate the flame images FI corresponding to the changed intensity of the magnetic field B.

Subsequently, the cooking apparatus 1 determines whether cooking is terminated (1440).

In detail, the cooking apparatus 1 may obtain the cooking time from the received cooking method and may determine whether the cooking time has elapsed after heating has started.

If it is determined that cooking is finished (YES of 1440), the cooking apparatus 1 stops activation of the induction heating coil L and the flame image generating unit 200.

If it is determined that cooking is not finished (NO of 1040), the cooking apparatus 1 continuously performs activation of the induction heating coil L and the flame image generating unit 200 according to the received cooking method.

As described above, the cooking apparatus 1 may generate flame images so as to intuitively provide operation information of the cooking apparatus 1 to the user.

As described above, in accordance with embodiments of the present invention, a cooking apparatus that displays visual flame images on a cooking container can be provided.

In addition, a cooking apparatus that is capable of delivering various messages to a user by using movement of the flame images displayed on the cooking container can be provided.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A cooking apparatus to heat a cooking container, the cooking apparatus comprising:

an induction heating coil configured to generate a magnetic field to heat the cooking container; and an image source device including a plurality of light sources configured to emit light, a plurality of lenses to refract the light emitted from the plurality of light sources, where each lens of the plurality of lenses includes a surface disposed to be oblique with respect to a direction in which the light is emitted from each of the plurality of light sources, and the emitted light is refracted toward the cooking container at the surface disposed to be oblique, an optical filter including a filter body formed with a slit, where the filter body is arranged to block at least part of the refracted light, the slit is arranged to transmit at least another part of the refracted light toward the cooking container, and the transmitted light forms, on a surface of the cooking container, at least one image indicative of an operation, and a light-emitting controller configured to control the emitting of the light, responsive to a control signal input for adjusting the heat by the magnetic field of the induction heating coil, thereby controlling the forming, on the surface of the cooking container, of the least one image indicative of the operation.

2. The cooking apparatus of claim 1, wherein the plurality of light sources comprise at least two first light source groups, a first light source group including at least two light sources connected to each other in series, and the at least two first light source groups are connected to each other in parallel.

3. The cooking apparatus of claim 2, further comprising a light source driving circuit to provide driving currents to the plurality of light sources, wherein the light source driving circuit comprises a plurality of switches that are connected to the at least two first light source groups in series and control driving currents supplied to the at least two first light source groups.

4. The cooking apparatus of claim 3, wherein the light-emitting controller controls the light source driving circuit so that a combination of the plurality of light sources of the at least two first light source groups are simultaneously turned on/off.

5. The cooking apparatus of claim 3, wherein the light-emitting controller controls the light source driving circuit so that the at least two light sources that belong to same first light source group are simultaneously turned on/off.

6. The cooking apparatus of claim 3, wherein the light-emitting controller controls the light source driving circuit so that the at least two first light source groups is turned on/off at different times.

7. The cooking apparatus of claim 3, wherein the light source driving circuit comprises a single switch that is connected to the at least two first light source groups in series and controls driving currents supplied to the at least two first light source groups.

8. The cooking apparatus of claim 1, wherein the plurality of light sources are connected to each other in parallel.

9. The cooking apparatus of claim 1, wherein the plurality of light sources are connected to each other in series.

10. The cooking apparatus of claim 9, further comprising a light source driving circuit to provide driving currents to the plurality of light sources, wherein the light source driving circuit comprises one switch that is connected to the plurality of light sources in series and controls driving currents supplied to the plurality of light sources.

11. The cooking apparatus of claim 1, further comprising:

a user interface that receives control instructions from a user, and a controller configured to control an intensity of the magnetic field according to output levels corresponding to the control instructions and outputs the control signal input to the image source device to control the forming of the at least one image indicative of the operation according to the output levels.

12. The cooking apparatus of claim 11, wherein the controller controls the forming of the at least one image indicative of the operation so that a size, color, shape, brightness or any combination thereof of the at least one image is changed according to the output levels.

13. The cooking apparatus of claim 11, further comprising:

a position detection device configured to detect a position of the cooking container, and a light source movement device configured to move the image source device, wherein the controller controls the light source movement device so as to move the image generating device according to the position of the cooking container.

14. The cooking apparatus of claim 11, further comprising:

a position detection device configured to detect the position of the cooking container, wherein the plurality of light sources comprise at least two second light source groups disposed at a different distance from the induction heating coil than the at least two first light source groups, wherein the controller controls the image source device so that at least one of the light source groups from among the at least two first or second light source groups operates according to the position of the cooking container.

15. The cooking apparatus of claim 11, further comprising:

a temperature detection device configured to detect a temperature of the cooking container, and a communication device configured to communicate the temperature to a portable mobile terminal equipment.

16. The cooking apparatus of claim 15, wherein, when a request for cooking progression information is received from the portable mobile terminal equipment, the controller transmits the cooking progression information comprising the temperature of the cooking container and a cooking progression time to the portable mobile terminal equipment through the communication device.

17. The cooking apparatus of claim 11, further comprising:

a microphone configured to receive voice signals from the user, and a speaker configured to output a sound, wherein, upon receipt of the voice signals through the microphone, the controller recognizes the control instructions from the voice signals.

18. The cooking apparatus of claim 17, wherein, when failure is detected, the controller controls the speaker so as to output a warning sound and controls output of the control signal input to the image source device to control the forming of the at least one image that flickers indicative of the operation of the warning.

* * * * *